US012146288B2

(12) United States Patent
Anderson et al.

(10) Patent No.: US 12,146,288 B2
(45) **Date of Patent: *Nov. 19, 2024**

(54) QUICK COUPLER

(71) Applicant: WEDGELOCK EQUIPMENT LIMITED, Upper Hutt (NZ)

(72) Inventors: Andre Richard Anderson, Carterton (NZ); Marshall Andrew Stewart Hanlon, Upper Hutt (NZ); Garth Colin Keighley, Upper Hutt (NZ); Andrew James Phillip Rider, Otaki (NZ); Michael Hugh James Rider, Otaki (NZ)

(73) Assignee: WEDGELOCK EQUIPMENT LIMITED, Upper Hutt (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 18/202,923

(22) Filed: May 28, 2023

(65) Prior Publication Data

US 2024/0018740 A1 Jan. 18, 2024

Related U.S. Application Data

(63) Continuation of application No. 16/785,215, filed on Feb. 7, 2020, now Pat. No. 11,702,816.

(30) Foreign Application Priority Data

Jan. 30, 2020 (NZ) ..... 761283

(51) Int. Cl.
*E02F 3/36* (2006.01)

(52) U.S. Cl.
CPC ..... *E02F 3/3622* (2013.01); *E02F 3/364* (2013.01); *E02F 3/3672* (2013.01)

(58) Field of Classification Search
CPC ..... E02F 3/3622; E02F 3/3645; E02F 3/364; E02F 3/3672
See application file for complete search history.

(56) References Cited

U.S. PATENT DOCUMENTS 3,531,140 A * 9/1970 Fadden ..... A01B 59/062 172/275
3,807,769 A * 4/1974 Thompson ..... A01B 59/062 172/272
4,398,745 A * 8/1983 Azzarello ..... B60D 1/04 280/508
4,549,744 A * 10/1985 Herr ..... B60D 1/04 280/416.2
7,530,405 B2 * 5/2009 Kollath ..... A01B 59/006 172/272

(Continued)

*Primary Examiner* — Jamie L McGowan
(74) *Attorney, Agent, or Firm* — JCIP; Joseph G. Chu

(57) ABSTRACT

A coupler for securing an attachment to an earth working machine. The coupler Includes a coupler body that presents a receptacle having a capture region. A pin of an attachment can move into and out of the capture region. A retainer can capture the pin in the capture region but the retainer can be moved by a hydraulically driven driver to a position to allow release of the pin from the capture region. A trigger that the pin will strike when the pin moves into or out of the capture region, decouples the driver from the retainer and the retainer is then allowed to be biased back to its retaining position by a spring.

20 Claims, 40 Drawing Sheets

(56) References Cited

U.S. PATENT DOCUMENTS

| | | | | |
|---|---|---|---|---|
| 8,011,121 | B2 * | 9/2011 | Daraie | E02F 3/365 37/444 |
| 8,585,345 | B2 * | 11/2013 | Sikorski | E02F 3/3618 414/723 |
| 2010/0031539 | A1 * | 2/2010 | Daraie | E02F 3/365 37/468 |
| 2011/0286788 | A1 * | 11/2011 | Sikorski | E02F 3/3663 403/315 |
| 2012/0266432 | A1 * | 10/2012 | Balemi | E02F 3/3618 403/376 |
| 2014/0373401 | A1 * | 12/2014 | Friedrich | E02F 3/365 37/468 |
| 2015/0330053 | A1 * | 11/2015 | Ravindran | E02F 3/3618 403/91 |
| 2017/0107687 | A1 * | 4/2017 | Ito | E02F 3/3618 |
| 2021/0222392 | A1 * | 7/2021 | Miller | E02F 3/3663 |

* cited by examiner

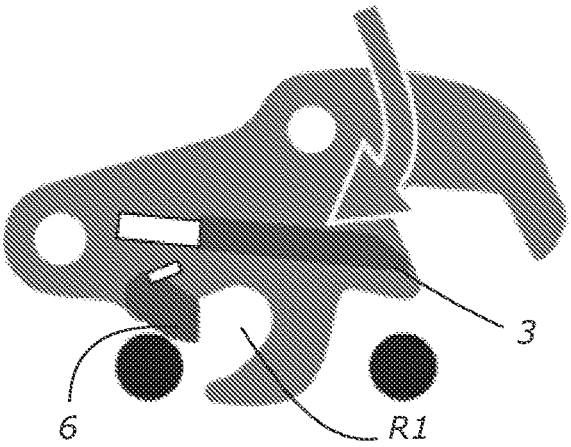
FIGURE 7
(Prior Art)
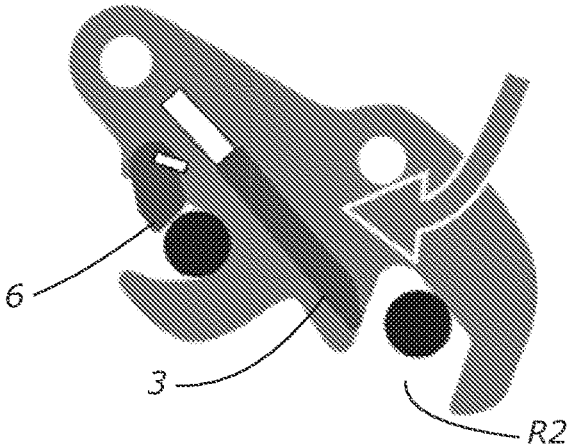
FIGURE 8
(Prior Art)
FIGURE 9
(Prior Art)
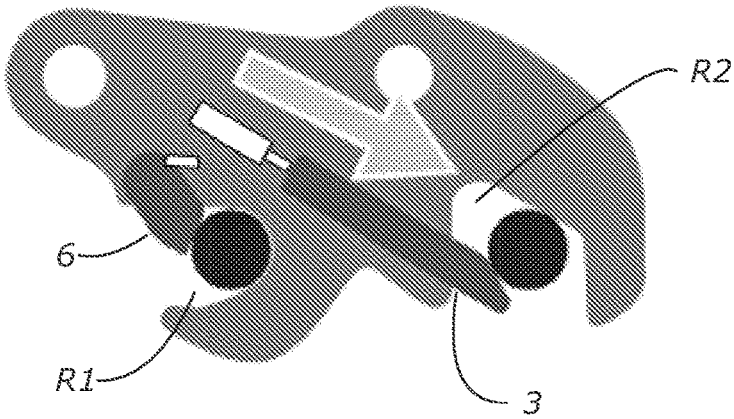
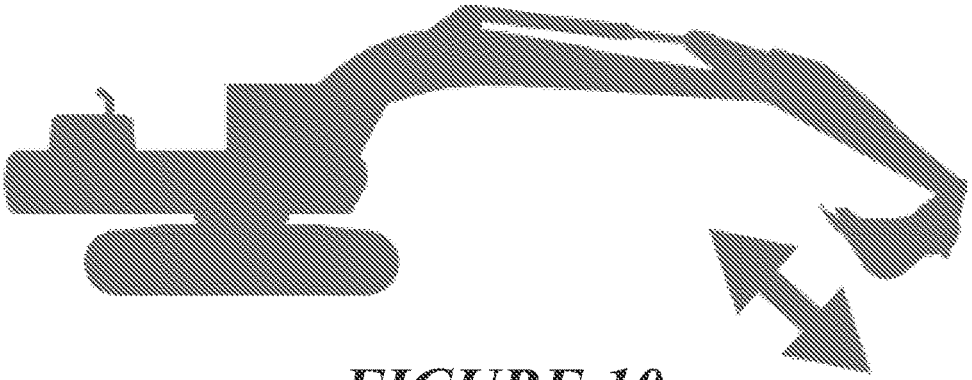
FIGURE 10
(Prior Art)

QUICK COUPLER

CROSS REFERENCE TO RELATED APPLICATIONS

This is a continuation application of U.S. application Ser. No. 16/785,215 filed on Feb. 7, 2020, which claims the right of priority to New Zealand provisional patent application NZ 761283 having a filing date of Jan. 30, 2020. The entirety of the contents of these respective applications are hereby incorporated by reference.

TECHNICAL FIELD OF INVENTION

The present invention relates to a quick coupler for earth working machines. More particularly but not exclusively it relates to a quick coupler having a trigger mechanism to reset a retaining member for an attachment.

BACKGROUND ART

Quick couplers are used to quickly engage or disengage an attachment such as for example a bucket to an excavator. The quick coupler may be attached to the end of an excavator arm. A quick coupler may permit the operator of a machine to engage and disengage attachments without them needing to move from the cab or operating position of the excavator. An attachment lying on ground can be connected by the operator by manoeuvring the arm of the excavator to couple with the attachment. No other assistance is needed manoeuvre the attachment to achieve a coupling, hence being "quick" to achieve a coupling.

One type of quick coupler is described in NZ546893 for coupling attachments such as buckets to an excavator. As can be seen NZ546893 and also in FIGS. 1A-B and 2, attachments typically have two parallel pins, PI and P2, presented in a spaced apart manner and that are each able to be releasable retained at respective receptacles of a quick coupler. A front pin PI is able to be held nearer to the excavator and a rear pin P2 is held more distal the excavator. Quick couplers need to be able to safely hold their attachments. The attachments can be heavy and carry large loads. An error in establishing a safe coupling can result in a fatal accident or damage occurring. Yet a fast coupling and decoupling of the attachment with a quick coupler is also desired to help increase productivity. There is hence a tension between safe coupling and fast coupling. As seen in FIG. 1, the pin PI is able to be received at receptacle R1 and pin P2 is able to be received at receptacle R.2. At receptacle R1 there is a provided a safety retainer 6 that is able to retain the pin PI at receptacle RI. At receptacle R2 there is provided a wedge 3 that is able move to retain the pin P2 at receptacle R2.

Excavators traditionally come supplied with a hydraulic delivery and return line and a hydraulic 4/2 valve for servicing hydraulic components at the end of an arm. Such may be used by a hydraulic ram of the quick coupler to actuate both the retainer 6 and wedge 3 to engage and/or disengage one or both pins. In NZ546893 there are two hydraulic rams used. One for the retainer and one for the wedge.

An example of how an attachment is able to be detached from a quick coupler of a kind as described in NZ546893 is described in FIGS. 2-6. FIG. 2 shows an excavator 5 with its attachment secured to at the end of the arm 7. The attachment may be placed on a surface such as the ground, to take load off the coupler. FIG. 3 shows the coupler with the pins secure. FIG. 4 shows retraction of both the retainer 6 and wedge 3. This may occur by the operator triggering a building of hydraulic pressure on the appropriate hydraulic circuit to actuate the hydraulic rams for each of the retainer and the wedge. The two hydraulic rams move the retainer and wedge respectively to a release condition. FIG. 5 shows how an operator can move the coupler away from the attachment so that the pins PI and pin P2 can egress from the respective receptacle R1 and R.2. After a set period of time from the wedge and retainer being in the release condition, a timer system can trigger the actuation of the retainer 6 for it to move to its retaining position as seen in FIG. 6.

FIGS. 7-10 show how an attachment is able to be attached to a quick coupler of a kind as described in NZ546893. FIGS. 7 and 8 show that the wedge 3 is retracted. FIGS. 7 and 8 show the entry of the pin PI into the receptacle R1 and the retainer 6 being moved to allow entry. The retainer is able to pivot against a spring bias to allow the pin pI to be received at the receptacle RI. The retainer 3 is spring loaded to move it back to its retaining condition once the pin PI has moved far enough into the receptacle RI. The retainer will snap into the retaining condition under the influence of the spring once the pin PI is far enough into the receptacle RI. The snap fit retention means that no operator input is required in order to cause the retainer to move to its retaining condition, during attachment. The pin PI merely needs to move sufficiently deep into the receptacle RI. FIG. 9 shows that the operator has triggered a build-up of hydraulic pressure to extend the wedge to retain pin P2 at receptacle R2. A quick rattle test is then performed to ensure that the attachment is secured to the coupler.

For safety, the quick coupler of FIGS. 2-10 may have the retainer operation on a timer system. After a set period of time from the release of the retainer, to release the pin PI as seen in FIG. 6, the retainer is reset back to its retaining position. This means that the retainer is reset to a retaining condition where it can retain the pin PI. This may be achieved by electric and hydraulic means to reset the retainer back to the retaining position. A pre-set time is involved between actuating the retainer to move to its release condition before it is able to return back to its retaining condition. This gives the operator enough time to remove the pin PI from the receptacle RI. An alarm may sound whilst the retainer 6 is raised, so the operator is aware that pin PI can be removed from the receptacle RI. The time delay may be 10 seconds. This can be too long and time consuming.

Timer utilising quick couplers are able to be damaged by users not familiar with the system. An operator may control the hydraulic ram to release the second pin P2, and substantially simultaneously releases the retainer, retaining the first pin PI, for a set time period. If the operator does not remove the attachment from the quick coupler within the set time period the retainer will reset into a retaining position. As the operator may not realise that the retainer is back in the retaining position and pin PI is still connected, they may try and remove the attachment, thus damaging the retainer.

The quick coupler of FIGS. 2-10 may use a hydraulic ram to drive the wedge and a separate hydraulic ram to retract the retainer. This means that a traditional 4/2 valve is not sufficient to control both hydraulic rams and retain the timeout function. A non-OEM hydraulic valve is required to be retrofitted to the excavator to allow both rams to be operated or an additional pair of hydraulic lines could be run. This adds expense.

SUMMARY OF THE INVENTION

Known quick couplers may also require an attachment to be fully crowded towards the excavator to allow removal of the attachment. This may be troublesome for some attachments where the centre of gravity is quite remote from the quick coupler attachment region, for example for breaker bars. Breaker bars may also be stored vertically in a cradle for transportation. Problems may occur when the breaker bar is crowded towards the excavator for disengagement, and is then required to be loaded into a vertical cradle position. Handling of the disengaged, or partially disengaged attachment can be unsafe.

It is therefore a preferred object of the present invention to provide a coupler and/or an earth working machine that includes a coupler that overcomes at least one of more of the disadvantages mentioned above and/or to provide the public with a useful choice.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

For the purpose of this specification, where method steps are described in sequence, the sequence does not necessarily mean that the steps are to be chronologically ordered in that sequence, unless there is no other logical manner of interpreting the sequence.

Accordingly in a first aspect the present invention may be said to be a coupler for securing an attachment to an earth working machine, the coupler comprising a coupler body that comprises a receptacle comprising a mouth opening via which a pin of the attachment can pass to move through a passage of the receptacle to a captive region of the receptacle, the passage of the receptacle able to be occluded sufficient to prevent the pin from moving out of the captive region by a retainer moveably presented from and relative to the coupler body, the retainer being biased to a passage occluded first position at which the retainer prevents the pin from moving out of the captive region and being movable to a second position relative the passage to allow:

(i) ingress of said pin into the captive region by forcing said pin against the retainer to move the retainer against its bias towards said second position; and (ii) egress of said pin from the captive region, by a driver able to be moved relative the coupler body to be (a) coupled with the retainer, to allow the retainer to be moved by the driver to its second position and (b) decoupled from the retainer, preventing the driver from controlling the retainer position between its first and second positions, wherein the driver is coupled to or engageable with a driver actuator to cause the driver to move in a manner able to move the retainer, wherein a second receptacle is provided by the coupler body at a location away from said first mentioned receptacle, said second receptacle provided to receive and retain a second pin of the attachment when said first receptacle is retaining said first pin, wherein a second retainer is provided, the second retainer able to be moved relative the coupler body between a second retainer first position where it prevents the second pin located in the second receptacle from moving out of the second receptacle, and a second retainer second position where the retained second pin can be released from the second receptacle, wherein the second retainer is actuated for movement by a second retainer actuator between the second retainer's first position and second position, and wherein the driver actuator is actuated directly or indirectly by the second retainer actuator.

In one embodiment, the coupler further comprises a trigger that is movable relative the coupler body in a manner to be engaged and able to be moved by said pin as the pin moves through the passage in a manner so that the trigger can, when so moved by said pin, cause the driver to decouple from the retainer.

In one embodiment, the trigger can cause the coupled retainer and driver to decouple so that the retainer, if not in its first position, is able to move to its first position under influence of the bias.

In one embodiment, the trigger can cause the coupled retainer and driver to move relative each other to decouple so that the retainer is not held from moving to its first position by the driver.

In one embodiment, the driver is to be able to move between a coupled and decoupled condition with the driver actuator.

In one embodiment, the retainer is mounted to move in a rotational manner relative the body about a retainer rotational axis.

In one embodiment, the coupler body is able to be secured or is attached to the earth working machine.

In one embodiment, the driver is coupled to a driver actuator to cause the driver to move in a manner able to move the retainer.

In one embodiment, the driver actuator when actuated, is able to cause the driver to move in an actuation direction to, when the driver is coupled to the retainer, move the retainer to or towards its second position.

In one embodiment, the driver actuator, when de-actuated, will allow the driver to move in a de-actuation direction opposite the actuation direction, when coupled to the retainer, to allow the retainer to move to or towards its first position.

In one embodiment, the trigger is translatable.

In one embodiment, the trigger is mounted relative the body to translate in a trigger direction relative the body and orthogonal to the retainer rotational axis.

In one embodiment, the trigger direction is orthogonal to the de-actuation direction.

In one embodiment, driver is mounted on the trigger to slidably translate in the actuation/de-actuation direction relative the trigger for moving the retainer between the retainer first position and retainer second position.

In one embodiment, the driver is configured to only move in the actuation/de-actuation direction with respect to the trigger.

In one embodiment, the driver is carried by the trigger.

In one embodiment, the driver has an abutting and/or sliding engagement with the driver actuator.

In one embodiment, the driver is biased in the de-actuation direction.

In one embodiment, the driver is configured to move laterally between a driver first position where the driver is coupled with the retainer when the retainer is in the retainer first position; a driver second position where the driver is coupled with the retainer when the retainer is in the retainer second position; and a driver third position where the driver is decoupled from the retainer.

In one embodiment, the driver is kept in contact with the driver actuator via a bias.

In one embodiment, the bias is a spring bias.

In one embodiment, the driver is kept in contact with the driver actuator via a spring.

In one embodiment, the driver is configured to lose contact, or decouple, from the driver actuator.

In one embodiment, in the driver third position the driver is decoupled from the driver actuator.

In one embodiment, when the driver decouples from the retainer, the driver will also decouple from the driver actuator.

In one embodiment, when the driver decouples from the driver actuator the driver will be biased back in the de-actuation direction.

In one embodiment, the second retainer actuator is a hydraulic actuator.

In one embodiment, the driver actuator is not self-powered.

In one embodiment, the driver actuator is mechanically driven by the second retainer actuator.

In one embodiment, the driver actuator is configured for lost motion with the second retainer actuator.

In one embodiment, the driver actuator comprises a lost motion arrangement, configured for lost motion between the driver actuator and the second retainer actuator.

In one embodiment, the lost motion arrangement causes lost motion between full extension of the second retainer actuator, and an engaging position between extension of the second retainer and full retraction of the second retainer actuator.

In one embodiment, the between the engaging position and the full retraction of the second retainer actuator the second retainer actuator and the driver actuator are paired or coupled.

In one embodiment, the driver actuator and second retainer actuator act in paired motion between the engaging point and full retraction of the second retainer actuator.

In one embodiment, the paired motion distance travelled is equal to the distance required to drive the driver to lift the retainer to its retracted position.

In one embodiment, the driver actuator is pivotably connected with the driver.

In one embodiment, the driver is slidably mounted to the coupler body.

In one embodiment, the driver actuator slidably mounted to the coupler body.

In one embodiment, the driver actuator is biased to slide in de-actuation direction towards the second retainer, and/or the driver actuator is biased to slide in the de-actuation direction.

In one embodiment, the driver actuator is biased to move in a direction that when coupled with the retainer will move the retainer to the retainer first position.

In one embodiment, the driver actuator is spring biased.

In one embodiment, the driver actuator is a push-rod.

In one embodiment, the driver actuator is configured to be engaged by the second retainer actuator or second retainer when they are retracted to an engaging position, once at or past the engaging position the push-rod moves with the second retainer actuator or second retainer to simultaneously move the driver.

In one embodiment, the driver actuator is configured to be abutted by the second retainer actuator or second retainer when they are moved or moving to the second retainer second position.

In one embodiment, the driver actuator is configured to be engaged by the second retainer actuator or second retainer via an abutting engagement.

In one embodiment, the driver actuator is configured to be engaged by the second retainer actuator or second retainer via a sliding abutting engagement.

In one embodiment, the driver actuator is a combination of a first hydraulic actuator and a second hydraulic actuator connected hydraulically together.

In one embodiment the driver actuator is a combination of a first hydraulic actuator and a second hydraulic actuator that operate on the same circuit.

In one embodiment, the driver actuator comprises an arm driven by the second retainer or second retainer actuator, and the arm hydraulically drives the first hydraulic actuator and thus the second hydraulic actuator which drives the driver.

In one embodiment, the first hydraulic actuator and second hydraulic actuator do not share hydraulic fluid with the second retainer actuator.

In one embodiment, the first hydraulic actuator and second hydraulic actuator are an isolated hydraulic system.

In one embodiment, the first hydraulic actuator and second hydraulic actuator does not comprise a hydraulic pump, and/or are passively driven.

In one embodiment, the driver actuator comprises a lost motion arrangement, configured for lost motion between the arm and one selected from the second retainer actuator and second retainer.

In one embodiment, the driver actuator is an actively driven hydraulic ram and associated cylinder configured to engage and drive the driver to move the retainer to its second position.

In one embodiment, the driver actuator is a hydraulic actuator.

In one embodiment, the driver actuator is separate from the second retainer actuator.

In one embodiment, the driver actuator is hydraulically dependent from the second retainer actuator, and/or shares the same hydraulic fluid.

In one embodiment, the driver actuator comprises a cam that is configured to follow the second retainer actuator, the cam in turn directly or indirectly drives the driver.

In one embodiment, the driver actuator comprises a push rod configured to follow and to be driven by the cam as the cam rotates, the push rod configured to in turn drive the driver.

In one embodiment, the cam is spring biased.

In one embodiment, the cam has a rotational axis orthogonal the direction of the movement of the second retainer actuator.

In one embodiment, the cam comprises a periphery with a portion configured to create lost motion between the second retainer actuator and push rod.

Accordingly in a second aspect the present invention may be said to be a coupler for securing an attachment to an earth working machine, the coupler comprising a coupler body that presents a receptacle comprising a mouth opening via which a pin of an attachment can pass to move through a passage of the receptacle to a captive region of the receptacle, the passage of the receptacle able to be occluded sufficient to prevent the pin from moving out of the captive region by a retainer moveably presented from and relative to the coupler body, biased to a passage occluded first position at which the retainer prevents the pin from moving out of the captive region and that can be moved to a second position relative the passage to allow:

(i) the ingress of said pin into the captive region by forcing said pin against the retainer to move the retainer against its bias towards said second position; and (ii) egress of said pin from the captive region, by a driver able to be moved relative the coupler body to be (a) coupled with the retainer, to allow the retainer to be moved by the driver to its second position and able to (b) decoupled from the retainer, preventing the driver from controlling the retainer position between its first and second positions, wherein the coupler further comprises a trigger that is translatable relative the coupler body in a manner to be engaged and able to be translated by said pin as said pin moves through the passage in a manner so that the trigger can, when so translated by said pin, cause the driver to decouple from the retainer, wherein the driver is carried by the trigger.

In one embodiment, the trigger can cause the coupled retainer and driver to decouple so that the retainer, if not in its first position, is able to move to its first position under influence of the bias.

In one embodiment, the trigger can cause the coupled retainer and driver to move relative each other to decouple so that the retainer is not held from moving to its first position by the driver.

In one embodiment, the driver is able to move between a coupled and decoupled condition with the driver actuator.

In one embodiment, the retainer is mounted to move in a rotational manner relative the body about a retainer rotational axis.

In one embodiment, the coupler body is able to be secured or is attached to the earth working machine.

In one embodiment, the driver is coupled to a driver actuator to cause the driver to move in a manner able to move the retainer.

In one embodiment, the driver actuator when actuated, is able to cause the driver to move in an actuation direction to, when the driver is coupled to the retainer, move the retainer to or towards its second position.

In one embodiment, the driver actuator, when de-actuated, will allow the driver to move in a de-actuation direction opposite the actuation direction, when coupled to the retainer, to allow the retainer to move to or towards its first position.

In one embodiment, the trigger is mounted relative the body to translate in a trigger direction relative the body and orthogonal to the retainer rotational axis.

In one embodiment, the trigger direction is orthogonal to the de-actuation direction.

In one embodiment, driver is mounted on the trigger to slidably translate in the actuation/de-actuation direction relative the trigger for moving the retainer between the retainer first position and retainer second position.

In one embodiment, the driver is configured to only move in the actuation/de-actuation direction with respect to the trigger.

In one embodiment, the driver is carried by the trigger.

In one embodiment, the driver has an abutting and/or sliding engagement with the driver actuator.

In one embodiment, the driver is biased in the de-actuation direction.

In one embodiment, the driver is configured to move laterally between a driver first position where the driver is coupled with the retainer when the retainer is in the retainer first position; a driver second position where the driver is coupled with the retainer when the retainer is in the retainer second position; and a driver third position where the driver is decoupled from the retainer.

In one embodiment, the driver is kept in contact with the driver actuator via a bias.

In one embodiment, the bias is a spring bias.

In one embodiment, the driver is kept in contact with the driver actuator via a spring.

In one embodiment, the driver is configured to lose contact, or decouple, from the driver actuator.

In one embodiment, in the driver third position the driver is decoupled from the driver actuator.

In one embodiment, when the driver decouples from the retainer, the driver will also decouple from the driver actuator.

In one embodiment, when the driver decouples from the driver actuator the driver will be biased back in the de-actuation direction.

In one embodiment, a second receptacle is provided by the coupler body at a location away from said first mentioned receptacle, said second receptacle provided to receive and retain a second pin of the attachment.

In one embodiment, said second receptacle is provided and can retain the second pin of the attachment when said first receptacle is retaining said first pin, and/or said second receptacle can retain the second pin of the attachment when said first receptacle has no said first pin thereat.

In one embodiment, a second retainer is provided, the second retainer located by the coupler body in a manner to move between a second retainer first position where it prevents the second pin located in the second receptacle from moving out of the second receptacle, and a second retainer second position where the retained second pin can be released from the second receptacle.

In one embodiment, the second retainer is actuated for movement by a second retainer actuator between the first position and second position.

In one embodiment, the second retainer actuator is a hydraulic actuator.

In one embodiment, the driver actuator is actuated directly or indirectly by the second retainer actuator.

In one embodiment, the driver actuator is not self-powered.

In one embodiment, the driver actuator is mechanically driven by the second retainer actuator.

In one embodiment, the driver actuator is configured for lost motion with the second retainer actuator.

In one embodiment, the driver actuator comprises a lost motion arrangement, configured for lost motion between the driver actuator and the second retainer actuator.

In one embodiment, the lost motion arrangement causes lost motion between full extension of the second retainer actuator, and an engaging position between extension of the second retainer and full retraction of the second retainer actuator.

In one embodiment, the between the engaging position and the full retraction of the second retainer actuator the second retainer actuator and the driver actuator are paired or coupled.

In one embodiment, the driver actuator and second retainer actuator act in paired motion between the engaging point and full retraction of the second retainer actuator.

In one embodiment, the paired motion distance travelled is equal to the distance required to drive the driver to lift the retainer to its retracted position.

In one embodiment, the driver actuator is pivotably connected with the driver.

In one embodiment, the driver is slidably mounted to the coupler body.

In one embodiment, the driver actuator slidably mounted to the coupler body.

In one embodiment, the driver actuator is biased to slide in de-actuation direction towards the second retainer, and/or the driver actuator is biased to slide in the de-actuation direction.

In one embodiment, the driver actuator is biased to move in a direction that when coupled with the retainer will move the retainer to the retainer first position.

In one embodiment, the driver actuator is spring biased.

In one embodiment, the driver actuator is a push-rod.

In one embodiment, the driver actuator is configured to be engaged by the second retainer actuator or second retainer when they are retracted to an engaging position, once at or past the engaging position the push-rod moves with the second retainer actuator or second retainer to simultaneously move the driver.

In one embodiment, the driver actuator is configured to be abutted by the second retainer actuator or second retainer when they are moved or moving to the second retainer second position.

In one embodiment, the driver actuator is configured to be engaged by the second retainer actuator or second retainer via an abutting engagement.

In one embodiment, the driver actuator is configured to be engaged by the second retainer actuator or second retainer via a sliding abutting engagement. In one embodiment, the driver actuator is a combination of a first hydraulic actuator and a second hydraulic actuator connected hydraulically together.

In one embodiment, the driver actuator comprises an arm driven by the second retainer or second retainer actuator, and the arm hydraulically drives the first hydraulic actuator and thus the second hydraulic actuator which drives the driver.

In one embodiment, the first hydraulic actuator and second hydraulic actuator don't share hydraulic fluid with the second retainer actuator.

In one embodiment, the first hydraulic actuator and second hydraulic actuator are an isolated hydraulic system.

In one embodiment, the first hydraulic actuator and second hydraulic actuator don't comprise a hydraulic pump, and/or are passively driven.

In one embodiment, the driver actuator comprises a lost motion arrangement, configured for lost motion between the arm and one selected from the second retainer actuator and second retainer.

In one embodiment, the driver actuator is an actively driven hydraulic ram and associated cylinder configured to engage and drive the driver to move the retainer to its second position.

In one embodiment, the driver actuator is a hydraulic actuator.

In one embodiment, the driver actuator is separate from the second retainer actuator.

In one embodiment, the driver actuator is hydraulically dependent from the second retainer actuator, and/or shares the same hydraulic fluid.

In one embodiment, the driver actuator comprises a cam that is configured to follow the second retainer actuator, the cam in turn directly or indirectly drives the driver.

In one embodiment, the driver actuator comprises a push rod configured to follow and to be driven by the cam as the cam rotates, the push rod configured to in turn drive the driver.

In one embodiment, the cam is spring biased.

In one embodiment, the cam has a rotational axis orthogonal the direction of the movement of the second retainer actuator.

In one embodiment, the cam comprises a periphery with a portion configured to create lost motion between the second retainer actuator and push rod.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification [and claims] means "consisting at least in part of". When interpreting statements in this specification [and claims] which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.)

BRIEF DESCRIPTION OF FIGURES

The invention will now be described by way of example only and with reference to the drawings in which:

FIGS. 7-10: show a side schematic view of a coupler of the prior art engaging with pins of an attachment.

FIG. 94: shows a side schematic view of the fifth trigger version with an alternative drive actuator.

DETAILED DESCRIPTION

With reference to the above drawings, in which similar features are generally indicated by similar numerals, a retaining system 1 according to a first aspect of the invention is shown.

Figure 1A:
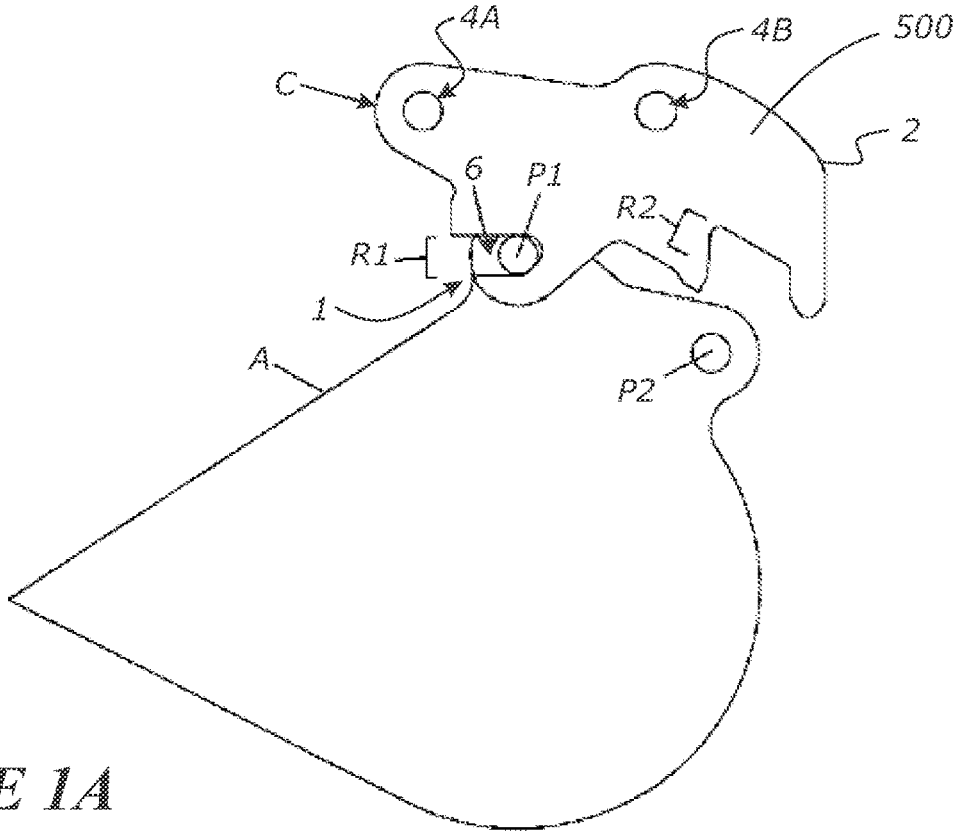
FIG. 1A: shows a side view of an attachment, such as a bucket, partially engaged with a coupler.
Figure 1B:
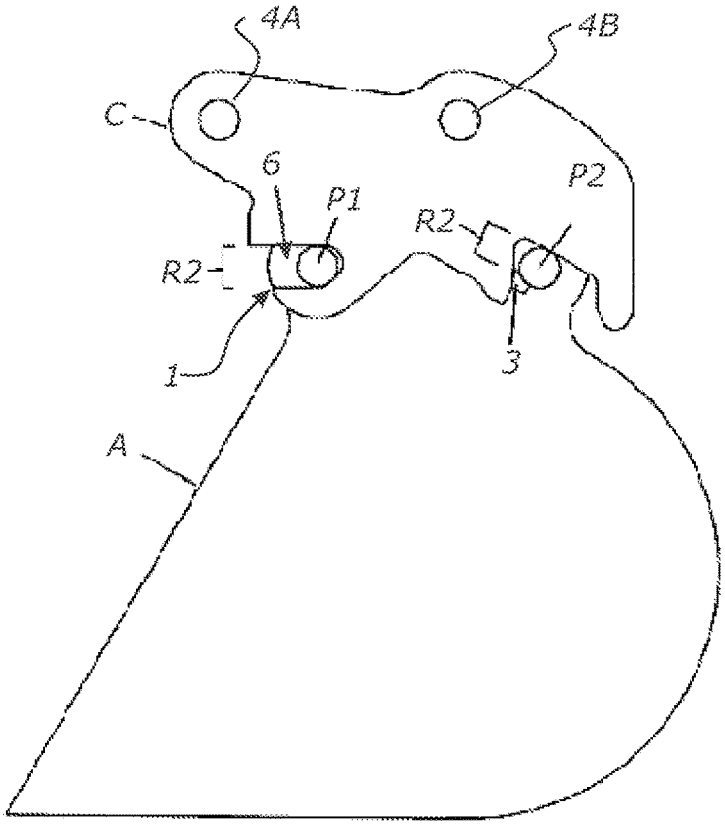
FIG. 1B: shows a side view of a bucket fully coupled to a coupler.
Figure 2:
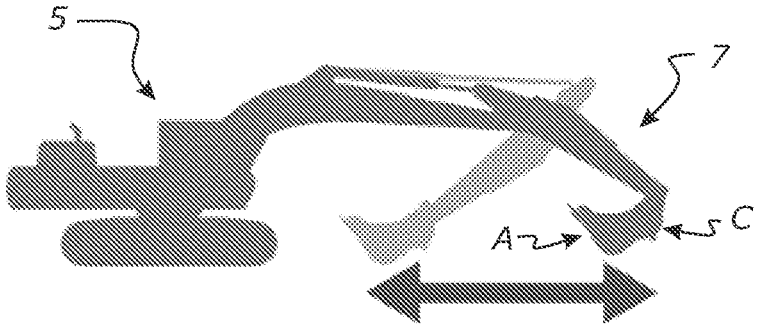
FIG. 2-6: show a side schematic view of a coupler of the prior art disengaging with the pins of an attachment.
Figure 3:
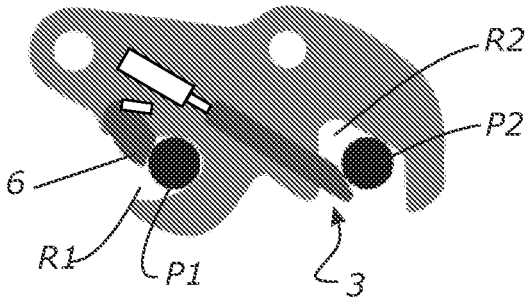
FIGURE 3 (Prior Art)
Figure 4:
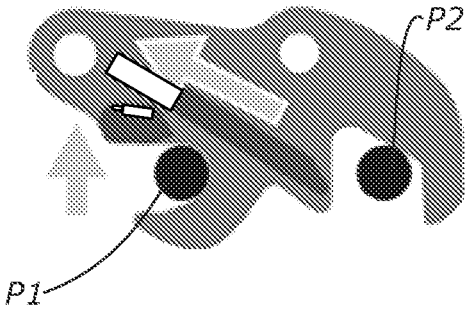
FIGURE 4 (Prior Art)
Figure 5:
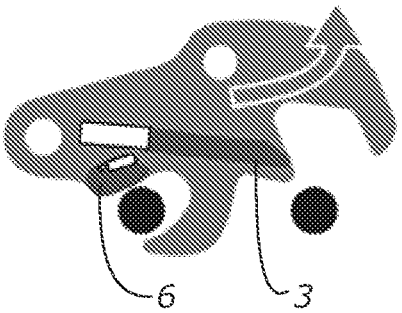
FIGURE 5 (Prior Art)
Figure 6:
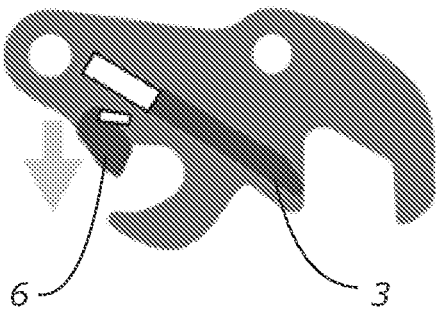
FIGURE 6 (Prior Art)
Figure 52:
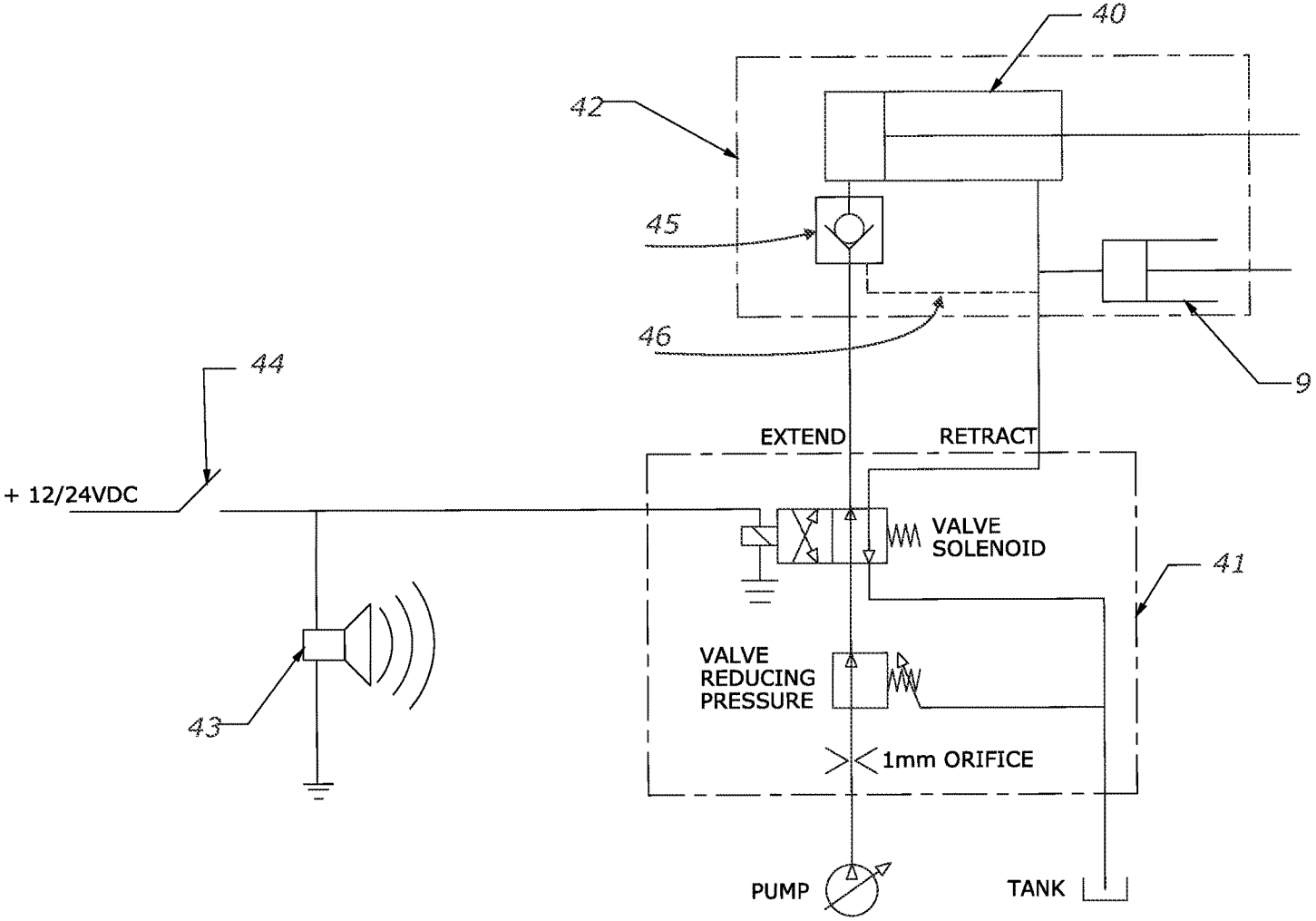
FIG. 52: shows a schematic of a hydraulic system.

With reference to FIGS. 1A and 1B there is shown a quick coupler C. The quick coupler may comprise of a body 2 that may include a plurality of mounting points 4A and 4B for securing the quick coupler to the end of an arm 7 of for example an excavator 5 (as shown in FIG. 2). The quick coupler is able to be attached and detached to an attachment A. In the example shown in FIGS. 1A and 1B, the attachment may be an excavator bucket. The attachment A presents two parallel spaced apart pins PI and P2 which are able to be securely received at spaced apart receptacles R1 and R.2 of the coupler C, respectively. For retaining the pin P2 at receptacle R.2, a second retainer 3 is used. The second retainer 3 may for example be retainer that is able to be moved between a retracted and an extended condition by way of a hydraulic ram 40 as shown in FIG. 52. The second retainer may be, or includes, a wedge shape and may be a bar or plate or rod or similar. At the first receptacle R1 there is provided a retaining system 1. The location of the retaining system 1 and the second retainer could be swapped around to the locations as shown in the Figures.

The body 2 of the quick coupler C may comprise of two primary plates. In FIG. 1A a primary plate 500 is shown. The second primary plate is spaced apart from the first primary plate and connected to the first primary plate preferably in a parallel condition. The primary plates and/or other parts of the body preferably define the receptacle RI. The plates may include suitably shaped edge profiles for such purposes. At receptacle RI the pin PI (the front pin for example of the attachment A) is able to be received. The pin PI and also the pin P2 when engaged to the body extend through and project from the lateral sides of the primary plates. For ease of illustration, the depth of the coupler is not shown in most of the Figures and instead a side view looking onto a primary plate is shown in most Figures.

Figure 11:
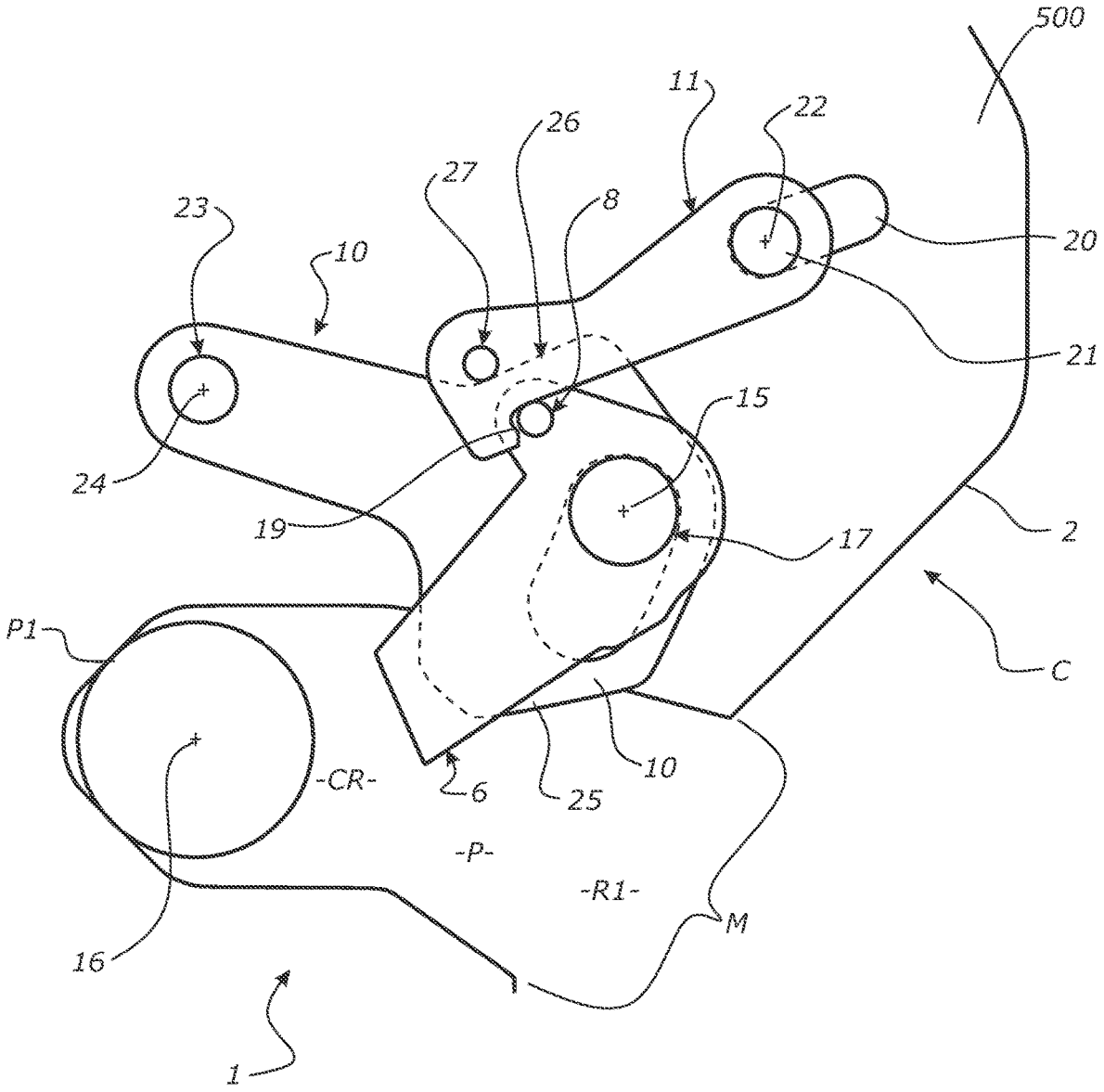
FIG. 11: shows an enlarged side schematic view of a retaining system.
Figure 23:
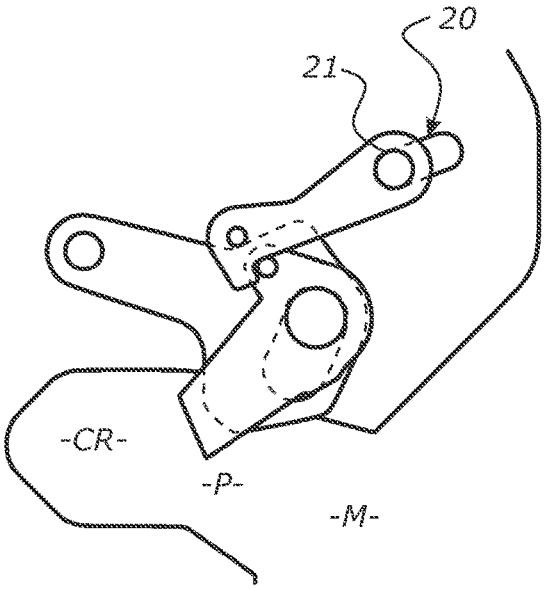
FIG. 23: shows a detailed side schematic view of the retaining system having been reset to 'lift mode' after pin egress.

In its fully retained condition as shown in FIGS. 1A and 1B, the retaining system is able to retain the pin PI, securely in the captive region CR of receptacle RI without the pin PI being able to be removed from the receptacle RI through the mouth of the receptacle. With reference to FIG. 11 there is shown part of the body 2 of the coupler C at the receptacle RI. The receptacle RI has a mouth opening M that is sufficiently large to allow for the pin PI to pass therethrough and into the receptacle RI. The receptacle RI may comprise a captive region CR where a pin PI is able to be seat and be held captive at by the retainer 6. The seating at the captive region may be loose or slack. Intermediate the captive region CR and the mouth M, is a passage P—as shown in FIG. 23. A pin can pass to move through said passage P of receptacle RI to the captive region CR of the receptacle RI. The passage P of the receptacle RI is able to be occluded to prevent the pin from moving out of the captive region CR by a retainer 6 that is biased to a position that occludes passage of a pin at the captive region through the passage P. In one embodiment, as seen in side view in FIG. 11, able to project from one side of the passage, at least partially across the receptacle RI, is the retainer 6. The retainer is preferably made of steel. The retainer 6 in its retaining condition also herein referred to as its first position, as shown in FIG. 11, projects sufficiently far across the receptacle RI to prevent the pin PI from being removed from the captive region. The retainer 6, in the preferred embodiment, is rotationally mounted relative to the body 2 (e.g. relative to and preferably mounted by the primary plates) about a retainer axis 15. The retainer axis 15 is preferably parallel to the elongate pin axis 16 of the front pin PI when engaged.

Figure 49:
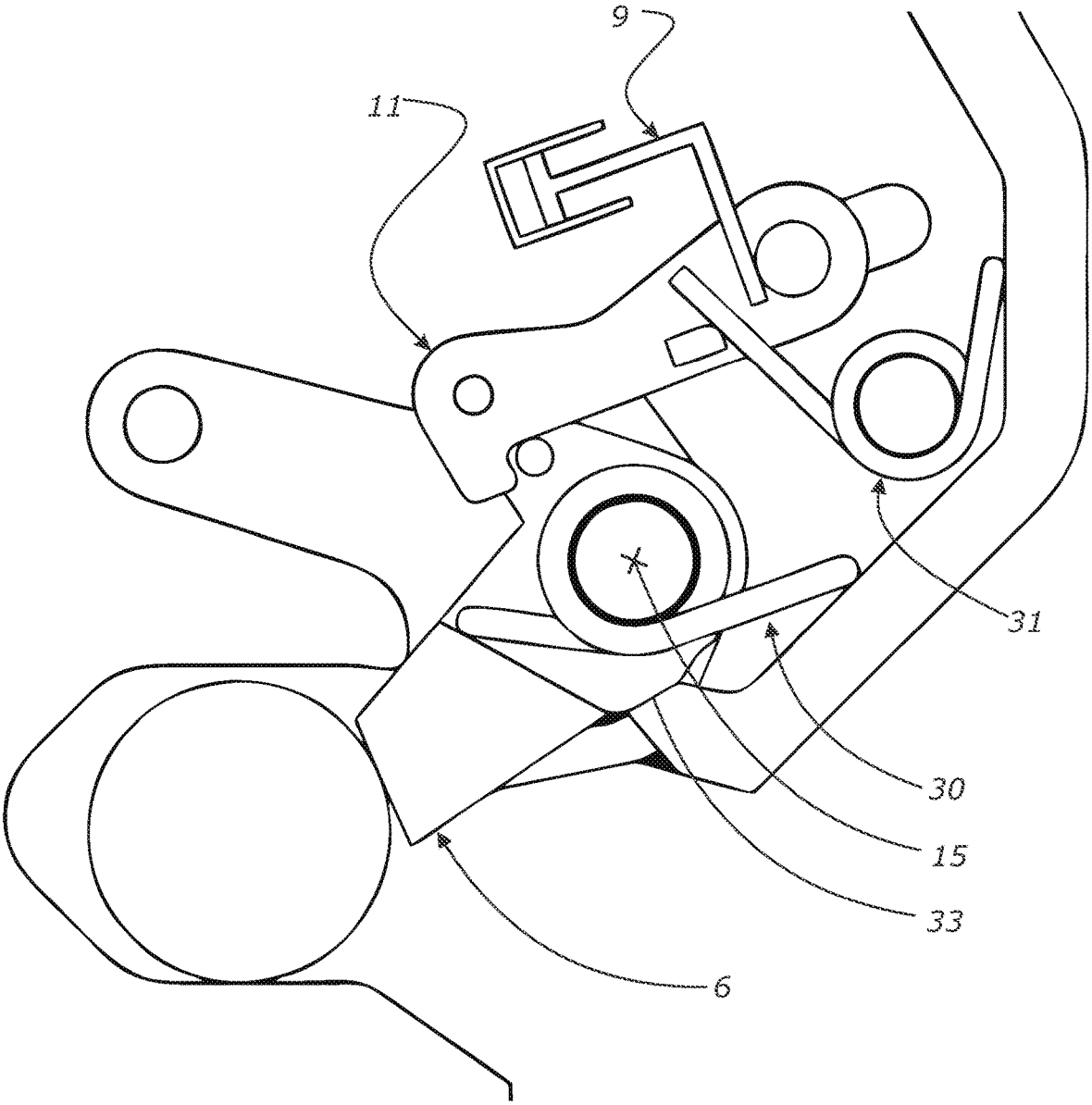
FIG. 49: shows a side detail view of a retaining system of the present invention with the spring bias's and rotation stops detailed

The retainer 6 is preferably mounted to the body 2 on a retainer shaft 17 to allow for the retainer 6 to rotate on its retainer axis 15. The retainer shaft may be secured at its ends to the primary plates of the body. The retainer 6 is able to pivot on its retainer axis 15 from its retaining first position, as shown in FIG. 11, in a clockwise direction. This may occur when the pin PI is being inserted into the receptacle RI by the pin pushing the retainer towards its second position away from its first position, or by a driver as will herein after be described. A rotation stop 33 may be provided to prevent the retainer 6 from rotating in an anti-clockwise direction from its retaining position as shown in FIG. 11. For clarity the rotation stop 33 has not been shown in FIG. 11 but is shown in FIG. 49. It will be appreciated that many alternative forms of rotation stops may be provided to prevent over rotation of the retainer 6.

Figure 16:
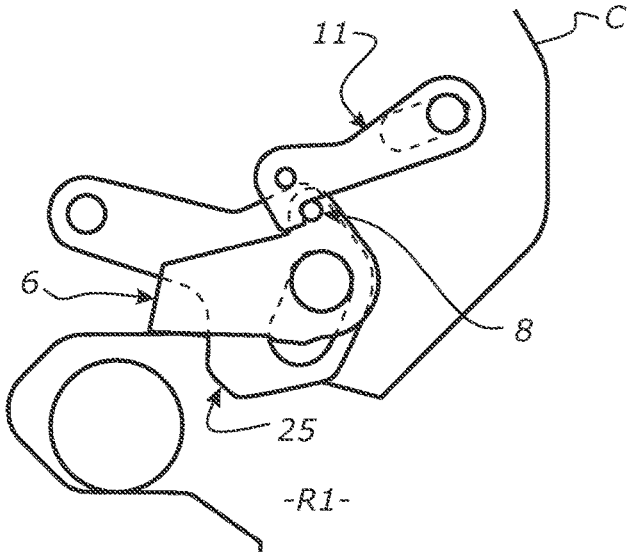
Figure 17:
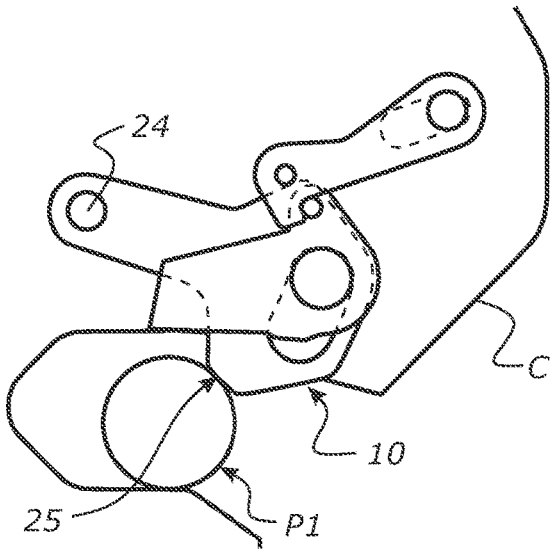

The retainer 6 is able to be moved from its pin retaining position, as shown in FIG. 11, to a pin release position as shown in FIG. 16. This may be achieved by the use of a driver 11. The driver 11 is able to be coupled to the retainer 6. This may be achieved via the retainer lug 8 of the retainer 6. The retainer lug 8 may be a; pin, or a surface of the retainer 6 that is configured and adapted to allow the driver 11 to couple therewith. The driver 11 is able to be moved from a first position as shown in FIG. 11 to a second position as shown in FIG. 16. The driver 11 may be moved by a driver actuator 9, for example a mechanical or hydraulic ram 9. The movement of the driver 11 to its second position can cause the retainer 6 to rotate from its pin retaining position to its pin releasing position when the driver 11 and retainer 6 are coupled. The retainer lug 8 is positioned at a distance from the retainer axis 15 of the retainer 6 to allow for a rotational force/torque to be applied to the retainer 6 by the driver 11 as it moves to the second position. The driver 11 may comprise a coupling region 19 that is able to hook and/or otherwise releasably couple with the retainer lug 8.

In order to allow for the pin PI to be released from the receptacle RI, the driver 11 when coupled with the retainer 6 is able to be moved from its first position as shown in FIG. 11 to its second position as shown in FIG. 16 to at least partially, if not completely, remove the retainer 6 from extending across the receptacle RI.

A noteworthy feature in some modes and/or embodiments is that the retainer 6 is able to completely egress the receptacle RI such that there is not able to be any interference of the pin with the retainer 6 when the retainer is in its second position as shown in FIGS. 16, 33, 46 and 73. If the retainer 6 was susceptible to interference with the pin PI, then the pin PI may push the retainer past a point to where the retainer lug 8 may de-couple with the coupling region 19. This full rotation of the retainer 6 so that it is held outside the receptacle in its second position, or at least helps prevents accidental de-coupling.

Figure 22:
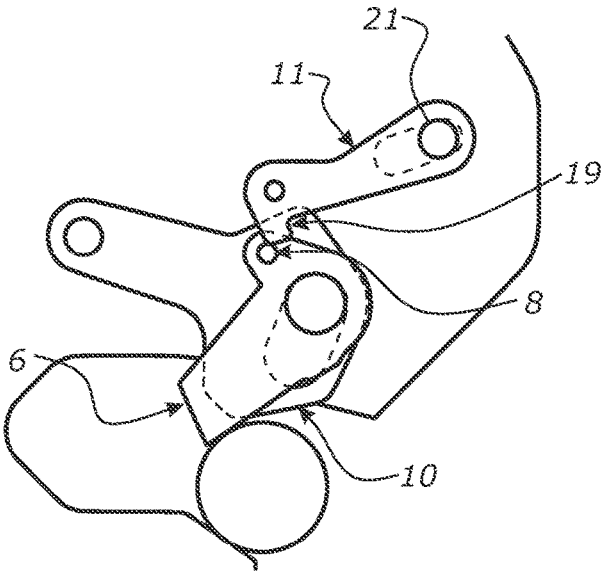

In the position as shown in FIG. 16 the pin PI is able to egress from the receptacle RI without interference from the retainer 6. Where reference is made to extending into or egressing from the receptacle, it will be appreciated that this the reference frame looking onto the primary plate 500 of the body/housing and seen in FIG. 11 for example. The retainer is located adjacent the first primary plate 500 and likewise a corresponding retainer may be provided adjacent the second primary plate (not shown) and other related retention system components may likewise be provided at the other side of the body of the quick coupler. The driver 11 may be guided for movement (the movement preferably caused by the driver actuator 9) along a path by a track or slot 20 of the housing along which an axle 21 of the driver 11 is mounted. The axle 21 is able to slide within the slot 20 for translational movement there along. The driver 11 is preferably mounted to rotate on a driver axis 22. Such rotation allows for the driver 11 to move between a coupled condition as shown in FIG. 11 coupling the driver 11 with the retainer 6 at the retainer lug 8 and coupling region 19 and a decoupled condition as shown in FIG. 22 where the coupling region 19 and the retainer lug 8 are decoupled from each other. The slot 20 and axle 21 allows for such rotation to occur in the example shown in FIGS. 11 and 22.

Version 1 Trigger

In addition, the retaining system 1 comprises a trigger 10. The trigger 10 is preferably rotationally mounted to the body 2 by a trigger axle 23 to allow for the trigger 10 to rotate on a trigger axis 24. The trigger 10 is presented so that a trigger region 25 of the trigger projects or is able to project at least partially across the receptacle RI. Preferably the trigger 10, and as such the trigger region 25, projects at least partially across the passage P to be presented for contact with a pin moving through the passage. As such the trigger region 25 is contacted by the pin PI as the pin PI passes the trigger 10 and is thereby able to be moved in a rotational manner on its trigger axis 24. The trigger may be mounted for linear movement instead relative the body 2 (as shown in alternative embodiment FIGS. 32-41). Preferably the trigger is shaped and the receptacle is shaped so that a pin moving through the passage cannot avoid contact with the trigger.

In addition in some forms, the trigger 10 may have a tripping region 26 that is able to interact with the driver 11 in an appropriate manner to control the rotation of the driver 11 about its driver axis 22. The driver 11 may comprise a trip pin 27 that is able to bear against the tripping region 26 of the trigger 10.

In a preferred embodiment the driver axis 22, retainer axis 15 and trigger axis 24 are all parallel to each other and when retained or entering, also parallel to the pin axis 16.

In order to explain how the retainer system 1 of the present invention works reference will now be made to the sequence of drawings of FIGS. 12-23 where the process of disengaging a pin PI is described and in FIGS. 24-31 where the process of engaging a pin PI is described.

Figure 12:
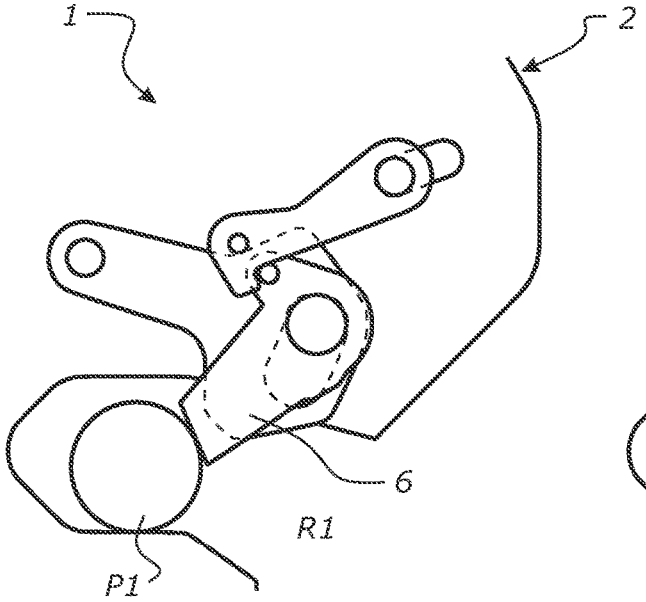
FIGS. 12-22: show detailed side schematic views of a pin of an attachment egressing for retention by the retaining system.
Figure 13:
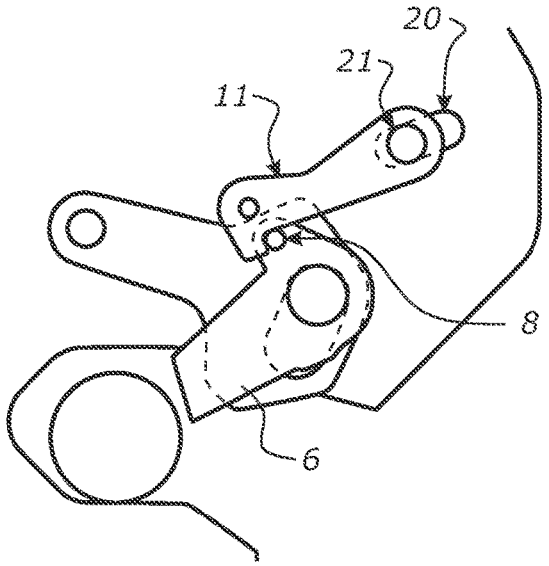
Figure 14:
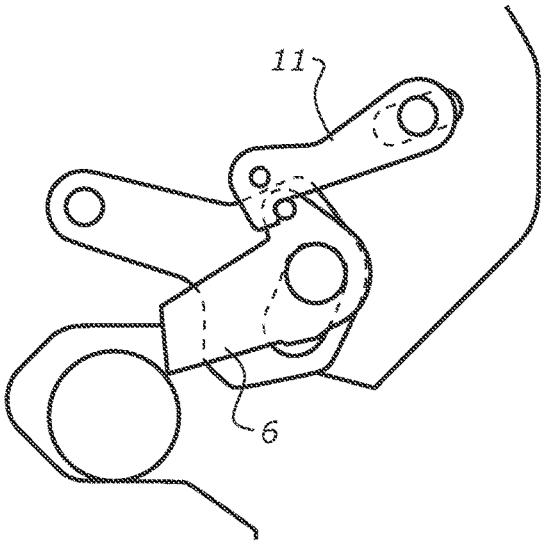

In FIG. 12 there is shown a pin PI safely and securely retained at receptacle R. 1 by the retainer 6. To allow for the pin PI to be removed from the receptacle R1 the driver 11 is caused to be displaced when it is coupled with the retainer lug 8. A hydraulic ram 9 for example may be actuated by an operator to cause the driver 11 to displace in a direction to cause clockwise rotation of the retainer 6 as shown between FIGS. 12 and 16.

Version 1 Driver Actuator

In an optional embodiment, a hydraulic ram 9 (driver actuator 9) and hydraulic ram 40 actuate the driver 11 and retainer 3 respectively. Both the hydraulic ram 9 and hydraulic ram 40 are preferably fed from the same hydraulic circuit, as shown in FIG. 52. For release of attachment, pressure is supplied to the hydraulic ram 40 and the retainer 3 is retracted to release pin P2, simultaneously in a preferred embodiment, the retainer 6 is retracted by the hydraulic ram 9, via the driver 11, to allow release of pin PI. The retainer 6 however is reset to its retaining position without any hydraulic pressure being required due to the mechanical trigger 10 of the retaining system 1 being triggered by egress of the front pin PI. For attachment of an attachment A from the previously described state, the pins PI and P2 are entered into the respective receptacles R.1 and R2. Via reversal or release of hydraulic pressure, the hydraulic ram 40 extends the retainer 3 to retain the rear pin P2. The retainer 6 is independent of this retainer 3 extending, due to the operation of the trigger 10 as described. However, the driver 11, is engaged with the hydraulic ram 9, and upon reversal or release of hydraulic pressure of the driver actuator, the driver 11 can return such as under bias (e.g. from a spring) to its first position.

Figure 15:
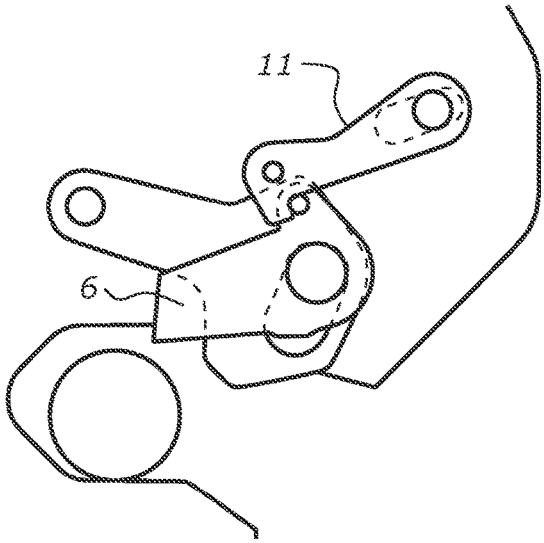

Continued displacement of the driver 11 to its second position will cause the retainer 6 to rotate sufficiently in a clockwise direction to no longer interfere with the removal of the pin PI from the receptacle RI. Such displacement may be to completely remove the retainer 6 from projecting into the receptacle RI as shown in FIG. 16 or still have it partially projecting into the receptacle RI as shown in FIG. 15. In the preferred form the retainer 6 is completely clear of the receptacle RI. Preferably a pin PI cannot push the retainer 6 to this position (as shown in FIGS. 16-19), as this may allow the retainer 6 to re-latch with the driver 11.

When the retainer 6 is in the retracted position, as for example shown in FIG. 16, the operator is able to move the excavator arm and hence the quick coupler C in order to manoeuvre the pin out of the receptacle RI. Whilst the retainer 6 is clear of the receptacle RI, the trigger 10 is presented with its triggering region 25 projecting into the receptacle RI. The triggering region projects sufficiently far into the receptacle RI so that it will contact the pin PI as the pin PI leaves the receptacle RI.

It will be appreciated that different sized pins of different attachments may come to register at the receptacle RI. Therefore it is important that the trigger region 25 is sufficiently large so as to be able to present itself for contact with different sized pins as such leave the receptacle, without the pins being able to pass the trigger region 25 without actuating the trigger 10. As such, for illustrative reasons, a small pin PI is shown egressing the receptacle RI—to show the extreme case and how the small pin can still activate the trigger 10. Likewise, on pin entry, a large pin PI is shown entering the receptacle RI—the large pin PI is shown to show the extreme case and how the large pin will not cause the retainer 6 to engage with the coupling region 25—as described later.

Trigger actuation occurs when the force of the pin PI upon its removal or entry to the captive region acts on the trigger 10 and causes the trigger 10 to move such as by rotation on its trigger axis 24. In the orientation shown in the drawings such rotation is in an anti-clockwise direction. As the pin progresses out of the receptacle RI as seen in the sequence of drawings of FIGS. 18 and 19, the rotation of the trigger 10 in an anti-clockwise direction about the trigger axis 24 causes the tripping region 26 to apply a force to the trip pin 27 of the driver 11. This causes a decoupling between the retainer lug 8 of the retainer 6 and of the coupling region 19 of the driver 11.

Figure 18:
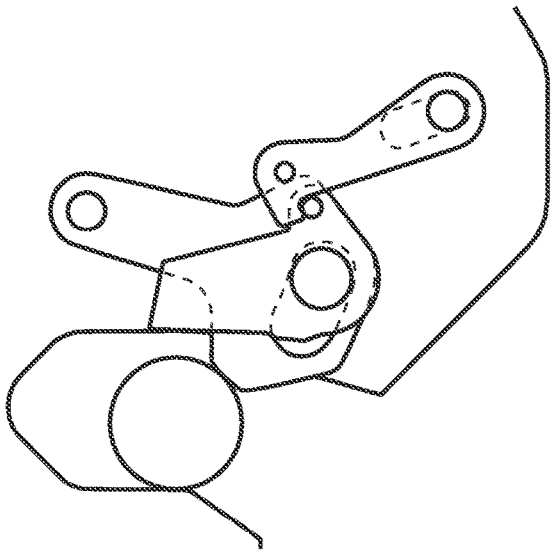
Figure 50:
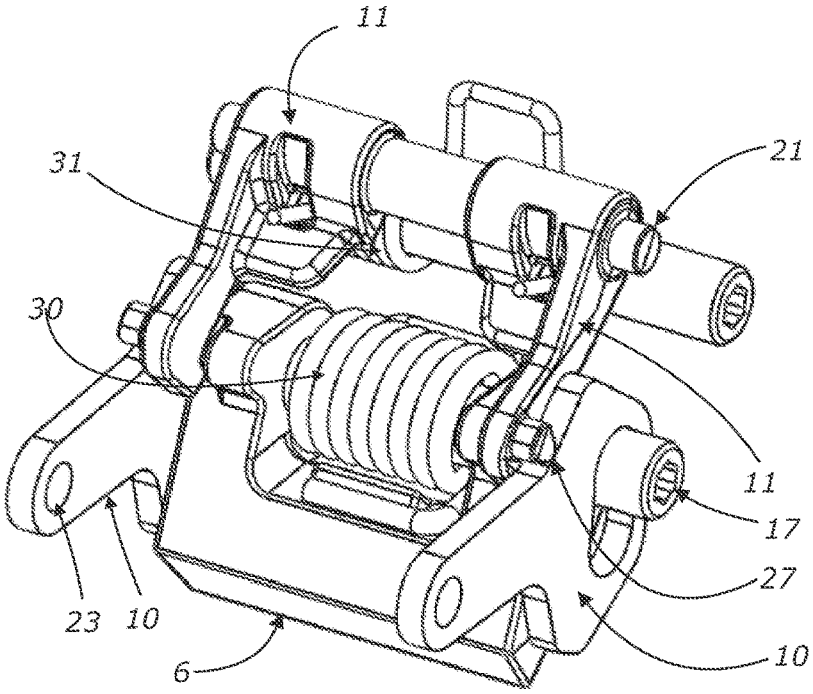
FIG. 50: shows a top perspective view of a retaining system of the present invention.
Figure 51:
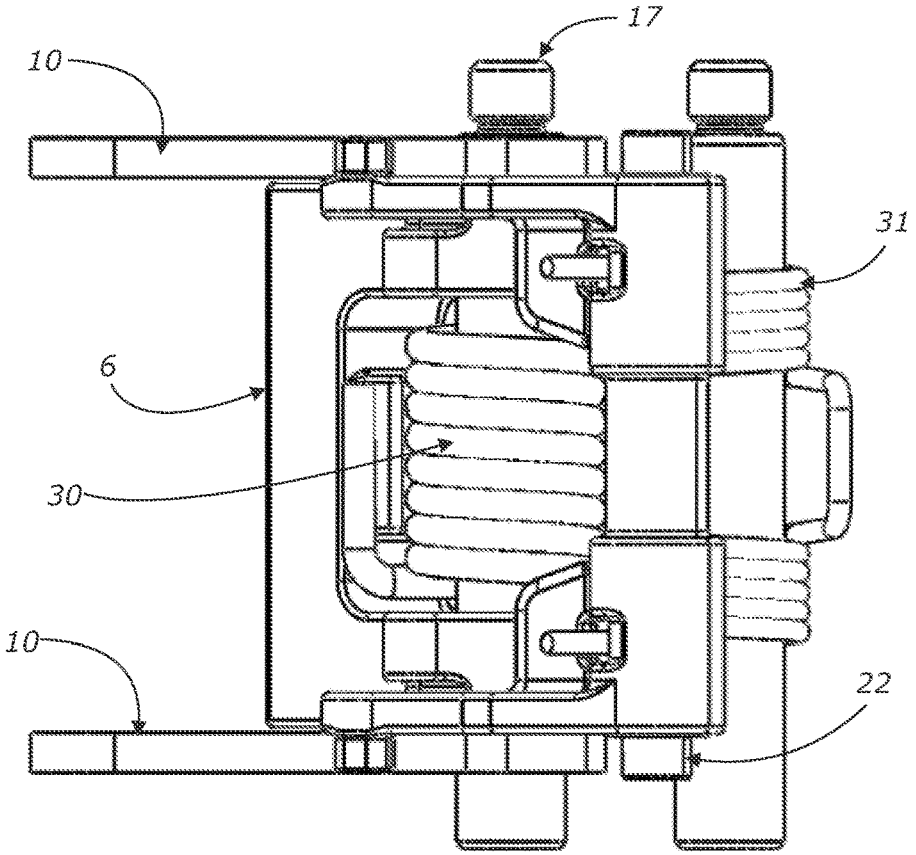
FIG. 51: shows a top view of a retaining system of the present invention

Upon decoupling of the driver 11 with the retainer 6, the retainer 6 is able to rotate back towards its retaining position. It is no longer being held by the driver 11 in its release position as shown in FIG. 18 but is able to rotate back in an anti-clockwise direction towards its retaining position. The retainer 6 is preferably biased to its retaining position by way of a spring such as a torsional spring 31 acting about the retainer axis 15. An example of the spring biases is shown in FIGS. 49 to 51. This helps snap the retainer to its retaining position when the driver decouples.

The progression of the pin PI out of the receptacle RI after the decoupling of the driver 11 and the retainer 6, may allow for the retainer 6 to rotate to its retaining position as shown in FIG. 22. The pin PI and the retainer 6 may be in contact during this progression but the pin PI is no longer being retained in the receptacle R1 by the retainer 6.

Figure 20:
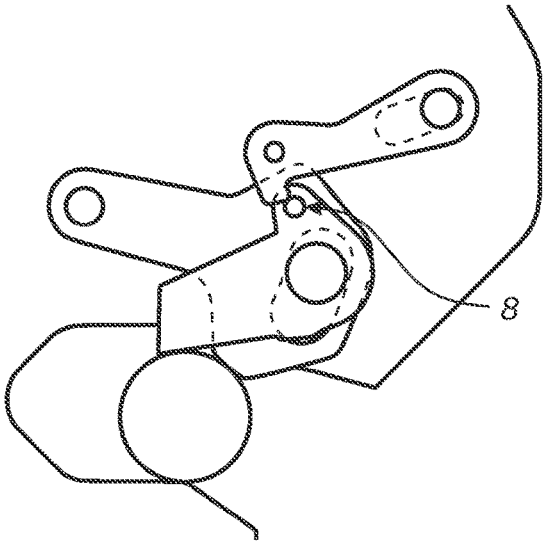
Figure 21:
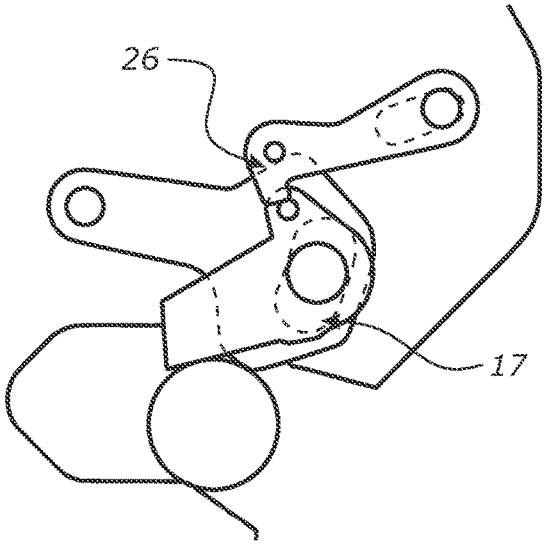

As can be seen in FIG. 20-22, the preferred geometry of the retainer 6 is such that its return to its retaining position is interfered with by the pin PI at the time the PI engages with the trigger region 25 of the trigger. This means that the trigger 10 may only be able to cause a tripping of the coupling between the driver and retainers (e.g. between the retainer lug 8 and the coupling region 19) once the pin PI is sufficiently removed from the receptacle R1 to then not be prevented from further movement out of the receptacle R1 by the retainer 6 once the retainer 6 has been caused to trip. As can be seen in FIGS. 20-22, the retainer 6 comes to bear against the pin PI once the tripping of the mechanism has occurred. However if the pin PI is removed faster, or the bias of the retainer 6 is weak or slower to cause movement of the retainer 6 (such as by use of a hydraulic accumulator) then the retainer 6 will not bear against the pin PI upon its exit.

FIG. 23 shows the retaining system reset to its first condition as shown in FIG. 11. The step between the retainer 6 rotating to its lower most point (FIG. 22) and the driver 11 recoupling with the retainer 6 (FIG. 23) is that the driver actuator 9 has allowed or caused the driver 11 to return to its first condition. The driver 11 may travel back due to the rotational and lateral spring bias (via spring 31) to its coupling condition, to recouple with the retainer 6.

Should the operator cause the release of actuation of the driver 11 e.g. via releasing the driver actuator 9 (e.g. by releasing hydraulic pressure from the driver actuator 9), either a) before the retainer 6 has fully raised (i.e. the retainer 6 is still coupled with the driver 11), then the retainer 6 will return back to its retaining position, or b) before the pin has egressed (i.e. the pin PI has not actuated the trigger 10), then the retainer 6 will return back to its retaining position.

Figure 19:
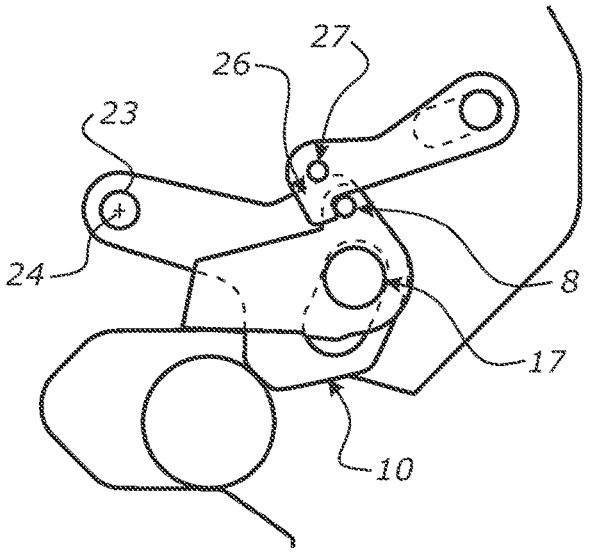

The Figures represent the operator causing release of the driver 11 at the stage of FIG. 23, when the pin PI has egressed the receptacle RI. However, the operator may release the driver 11 from the stage of FIG. 20—where the trigger 10 has been actuated to trip the driver 11 from coupling the retainer 6 at the retainer lug 8. FIG. 19 shows the tipping point where the retainer lug 8 is going to trip off the coupling region 19.

In a preferred form as previously mentioned the retainer 6 is preferably biased to its retaining position by for example a torsional spring 30 as shown in FIG. 49-51. In addition, biasing of the driver 11 may occur. Such biasing may be by way of a spring 31 to push the driver 11 to its coupling condition as shown in FIG. 49. In FIG. 49 the same spring 31 is shown acting between the body 2 and the driver 11 in a direction to bias the driver 11 in an anti-clockwise rotational direction. This encourages the driver 11 to move via its rotational and translational coupling to its first condition. In other embodiments, not shown, the function of the spring 31 may be achieved by more than one spring.

Figure 55:
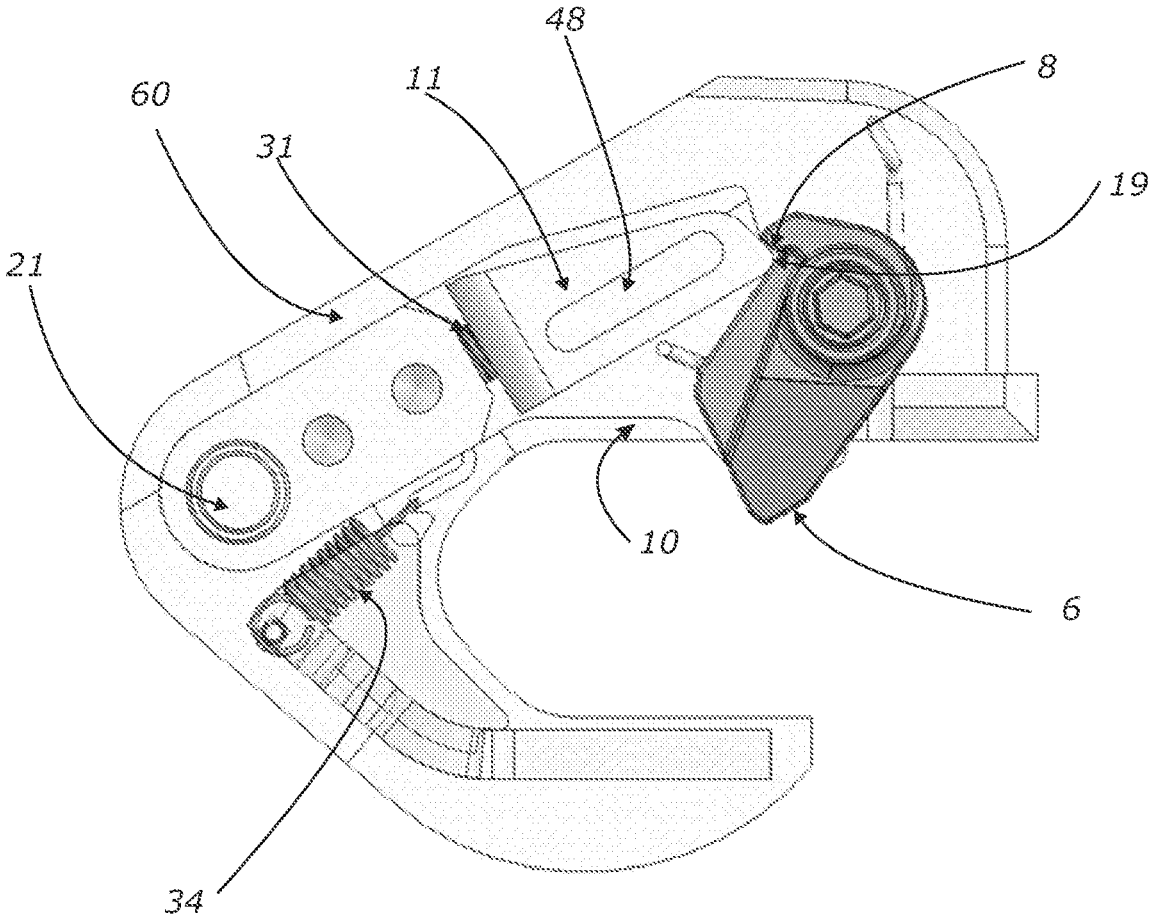
FIG. 55: shows a side view of a third version retaining system, with further features removed to clarify the driver and trigger.

The trigger 10 may be free to float, apart from, in a preferred embodiment, the biased driver 11 is pushing against the trigger 10—to in turn bias the trigger 10. Alternatively a separate bias may also be applied to the trigger 10. This bias may be provided by a spring (not shown in this embodiment, but shown as spring 34 in an alternative embodiment in FIG. 55) acting between the body 2 and the trigger 10 in a clockwise direction as seen in the Figures. The direct or indirect bias of the trigger 10 will help reset the trigger 10 to a condition where the trigger region 25 projects into the receptacle RI.

Preferably the trigger is able to come into contact with the driver as the pin engages the trigger and out of contact with the driver when the pin is not in contact with the trigger. Alternatively the trigger is always in operative contact with the driver. In alternative forms as described herein after, the trigger and driver may move in concert relative the coupler body between the coupled and decoupled conditions of the driver. Preferably the trigger is able to cause the driver to decouple from the retainer so that the retainer is not constrained by the driver from moving to its first position.

An operator may enter a lift mode by proceeding from a coupler condition as seen in FIG. 22 to a condition as seen in FIG. 23. A lifting mode is where both retainers 6 & 3 are in the retaining position, but no pins are present in the respective receptacles. The operator, in a preferred embodiment, can case the coupler to move from the stage of FIG. 22 to the stage of FIG. 23 (i.e. to lifting mode) by causing a release or reversal of the hydraulic pressure so the retainer 3 extends to its retaining position (shown in Figure IB), and because the hydraulic pressure is released to the driver actuator 9 also, the driver 11 is allowed to be biased back to couple with the retainer 6.

Figure 24:
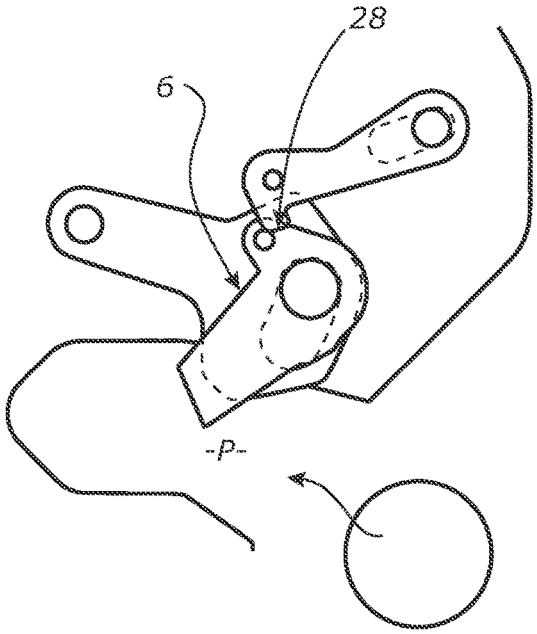
FIGS. 24-31: show detailed side schematic views of a pin of an attachment entering a retaining system after a pin has egressed, such as following on from FIG. 22 (first engagement mode).

Reference will now be made to FIGS. 24-31 to show how a pin PI is able to be engaged with a coupler C, for retention therewith, in a first engagement mode. In a first engagement mode for example, an old pin has been removed from the receptacle RI and it is desired to be swapped for a new pin PI of another attachment. The operator has triggered the application of hydraulic pressure (or similar means for actuation such as mechanical screw or the like) to cause the retainer 3 to retract, and the retainer 6 to raise up. The old pin is removed, which trips the trigger 10 and the retainer 6 moves to its retaining position. Note that the driver 11, is still located away from its biased condition (i.e. it is in its second position) because it is held there by the hydraulic ram 9. The operator can then enter a new pin, as shown in FIG. 24 into the receptacle R1 and this is secured at the receptacle R1 by the retainer 6. Even though the driver has not returned to a position to couple with the retainer that is in its first position. The operator enters pin P2 into receptacle R2—and the retainer 3 is extended to move to a position to retain pin P2. Retaining of pin P2 is able to be achieved independent of the retaining of pin PI.

The first engagement mode is the most typical mode when an operator is swapping attachments.

Figure 25:
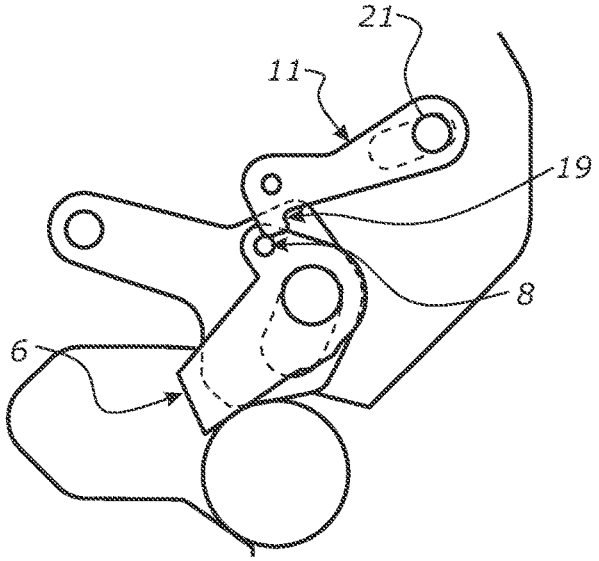

In FIG. 24 the retainer system 1 is shown in its retaining condition. The retainer 6 is in its retaining position (without a pin in the receptacle RI) and extends partially into the receptacle RI after being tripped and reset by the old pin egressing the receptacle RI. The driver 11 is still in its actuated position. The quick coupler C is then manoeuvred by an operator to introduce the new pin PI into the receptacle RI through the mouth M. This movement of the pin PI into the receptacle RI causes the retainer 6 to rotate clockwise as seen in FIG. 25. The lug 8 may act against the driver 11, and but does not re-latch.

A preferred feature that prevents re-coupling of the driver 11 and lug 8 (i.e. at the coupling region) is a guiding surface 28 as shown in FIG. 24. The guiding surface abuts with the lug 8, or another part of the driver 11, to prevent coupling of the driver 11 and retainer 6. As a pin PI enters into the receptacle, the pin PI engages the retainer 6. The lug 8 of the retainer 6 abuts the guiding surface of the driver 11 and so prevents coupling between the driver and retainer until the driver has returned to a position where it can couple with the retainer when the retainer is in its first position. The driver is preferably slower to return to its first position than the retainer. The trigger 10 in this embodiment is free to float with respect to movement caused by the pin PI.

Figure 28:
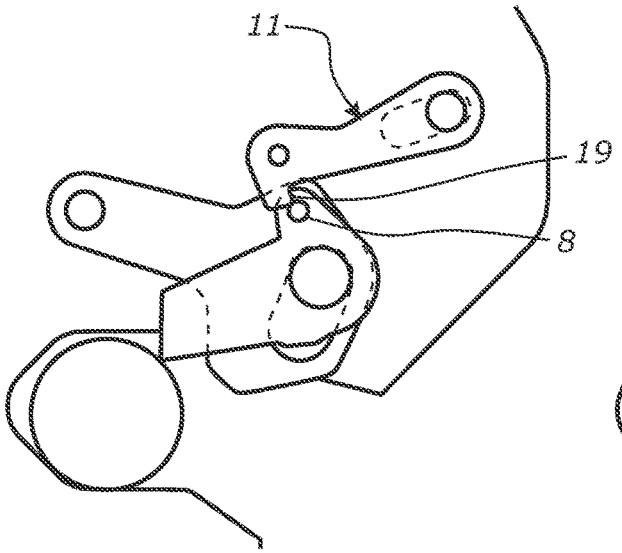

The pin PI is able to move to fully seat in the receptacle RI as a result of the retainer 6 able to rotate in idle and let the pin PI pass. Once the pin PI is sufficiently passed the retainer 6 as shown in FIGS. 28 and 29, the retainer 6 is, under bias as previously described, able to rotate anti-clockwise to its retaining position.

Figure 26:
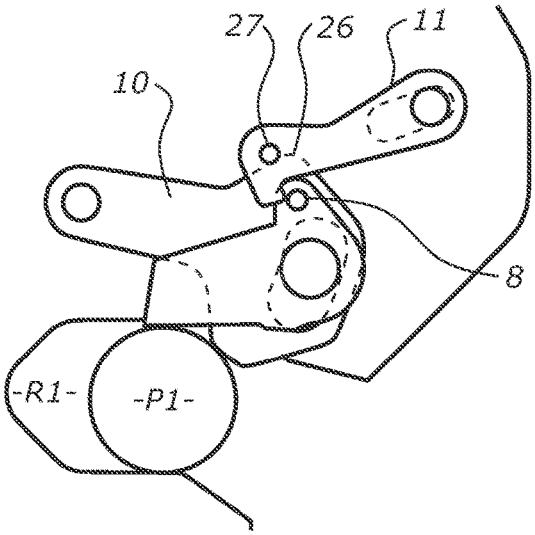
Figure 27:
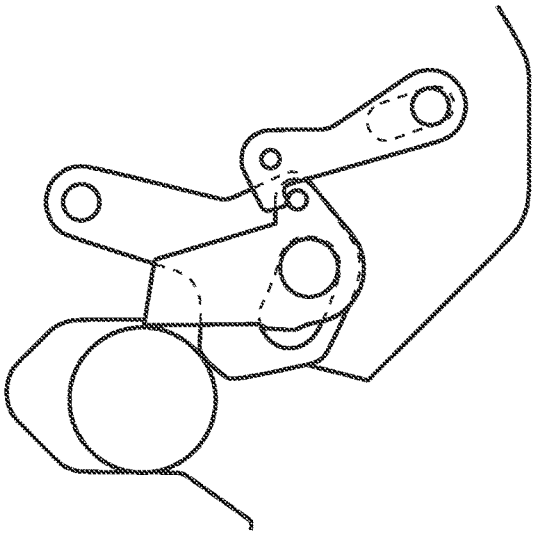

During the movement of the pin PI into the receptacle RI, the trigger 10 may also be displaced from its active position as shown in FIG. 24 to its tripping position as shown in FIGS. 25-26. However in doing so, the trigger 10 is not active in resetting the retainer 6 back to its retaining position nor active in establishing or disconnecting the coupling between the retainer lug 8 and the coupling region 19—this is because the retainer 8 is not coupled to the driver 11. In this instance the trigger 10 is merely idle and is able to move out of the way of the pin PI as the pin PI enters the receptacle RI.

Figure 29:
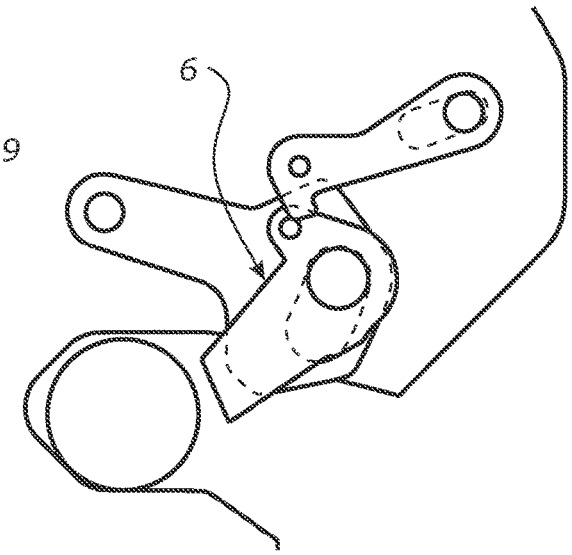
Figure 30:
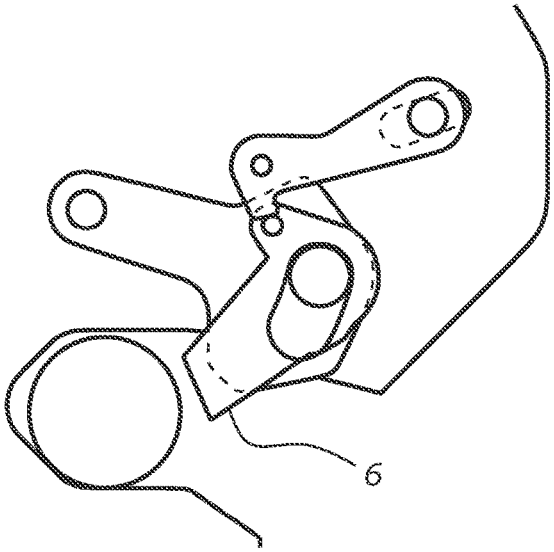

Once the pin PI is fully seated in its receptacle RI, or the retainer 6 is able to get past the pin PI, the retainer 6 is moved, or moves, to its retaining position as shown in FIG. 29, via its rotational bias. At this point the operator (once the front pin PI is retained), in a preferred embodiment, releases or reverses hydraulic pressure to the hydraulic cylinder 40 so the rear pin P2 can be retained by the retainer 3—simultaneously the driver 11 can return to its biased position—shown in FIGS. 30 to 31.

Figure 31:
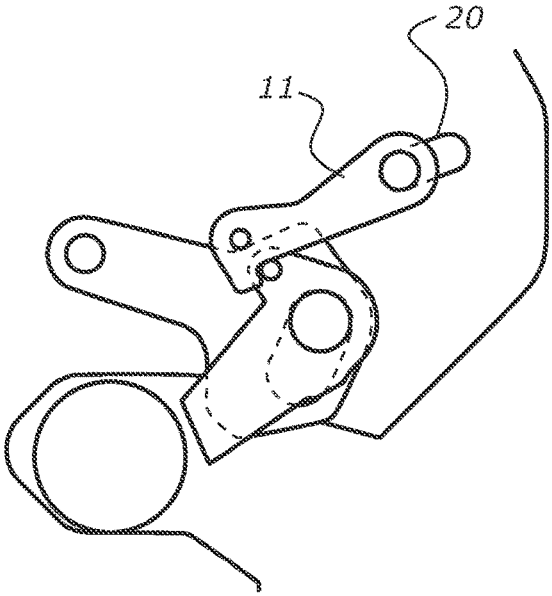

The driver 11 is able to be reset or is reset, to its first position, for coupling with the retainer lug 8, upon actuation or hydraulic reversal or release of the driver actuator 9, associated with the driver 11—as shown in FIG. 31.

The driver 11 is then coupled to the retainer 6 to again be able to rotate the retainer 6 to its release position to allow for release of the pin PI from the receptacle RI as indicated in FIGS. 12-23.

The trigger region 25 of the trigger 10 is shaped to act as a camming surface allowing for the movement of the pin PI past the trigger 10. The trigger region 25 preferably has rounded surfaces that do not inhibit the motion of the pin PI in and out of the receptacle RI. This allows for the trigger 10 to be rotated about its trigger pivot 24 yet not interfere with the motion of the pin PI during its movement in and out of the receptacle RI.

The shape of the retainer 6 is such that when the pin is in the receptacle RI and the retainer 6 is in its retaining position, it will retain the pin PI in the receptacle RI until such time as the retainer 6 is actively moved to its release position. A stop 33 as has herein been described helps prevents rotation of the retainer 6 beyond a certain limit thereby ensuring the pin PI remains secure in its receptacle RI when the retainer 6 is in its retaining position.

The geometry of the retainer 6 is preferably configured so the retainer 6 does not engage with the actuated driver 11 when a pin PI is received into the receptacle RI (and the retainer 6 is rotated to its release position as seen in FIG. 26). As can be seen in FIGS. 25 to 30, the driver 11 is not preventing (i.e. does not couple with the retainer 6) the biasing back of the retainer 6 to its retaining position under the influence of its torsional spring 30 (shown in FIG. 49). In alternative embodiment, it is solely the shape of the trigger 10 that causes the movement of the driver 11 to prevent coupling of the lug 8 with the driver 11, when a pin PI enters the receptacle RI.

The geometry around the lug 8 region is important to ensure that the driver 11 does not restrict the movement back of the retainer 6 to its retaining position once the pin PI is sufficiently received in its receptacle RI. The shape of the retainer 6 and the tripping region 26 relative to the trip pin 27 is important to ensure that the retainer lug 8 is not inhibited, from movement between the retainers first and second positions, by the driver 11 once the pin PI is sufficiently inside of the receptacle RI.

Subsequent rotational displacement of the driver 11 back towards its coupling position can then occur.

An operator, in one embodiment, can cause engagement of the pin PI by way of a second and third coupler engagement mode.

1) In a second engagement mode—the coupler was previously in a lifting (first) mode. I.e. at least the retainer 6 is in a retaining position and latched with the driver 11. An operator manoeuvres the coupler C so the pin is moved into the receptacle RI—as shown in FIGS. 42-45, without retracting the retainer 6. The difference between the second engagement mode and the first engagement mode is that the driver 11 is not actuated to its second position in the second mode.

Figure 47:
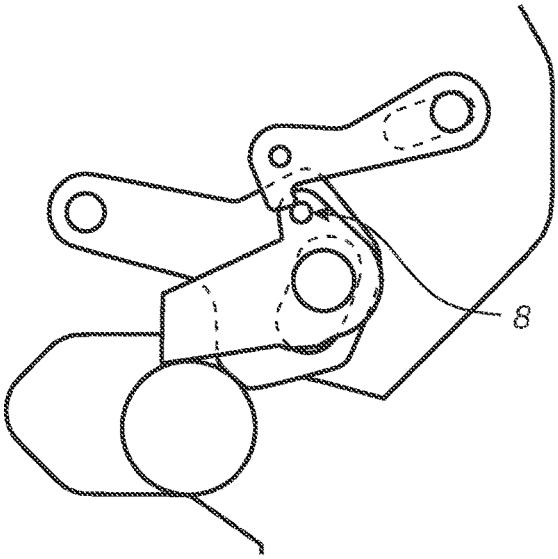
Figure 48:
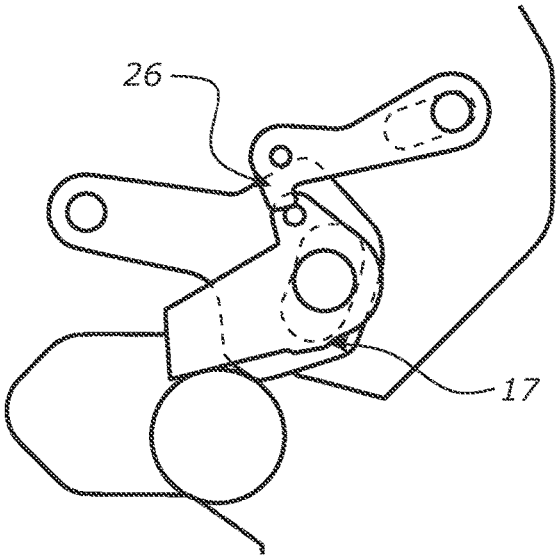

In a third engagement mode—the coupler was previously in a lifting (first) mode. I.e. at least the retainer 6 is in a retaining position and latched with the driver 11. An operator causes retraction of the retainer 6 by actuating the driver 11. The operator manoeuvres the coupler C so the pin is moved into the receptacle RI, the trigger 10 is tripped to reset the retainer 6 to its retaining position—this process is partially shown in FIGS. 46-48. The operator then enters pin P2 into receptacle R2—then releases actuation pressure so the retainer 3 can move back to its retaining position to retain the pin P2. Retaining of pin PI, is independent of the retaining of pin P2.

In one example the driver is preferably mounted relative the body to move in a rotational manner only for moving between a coupled and decoupled condition. Preferably trigger is mounted relative the body to move in a rotational manner only. Preferably the rotational mounting of the trigger and retainer and driver relative to the body is about respective rotational axes that are parallel each other. Preferably the trigger can cause the driver to move relative the body and relative the retainer to decouple the driver from the retainer. Preferably the trigger is presented for contact by the pin on both egress and ingress of the pin from and to the capture region. Preferably the retainer, when in said first position, prevents the egress of said pin when said pin is retained in the receptacle, and can be moved against the bias acting on the retainer to allow the ingress of said pin into the receptacle and past the retainer. Preferably the retainer in the second position does presents itself to not be contacted by the pin when in the receptacle.

So far, reference has been made generally to one embodiment of a trigger mechanism, called the version 1 trigger mechanism. However other variations of trigger mechanism are herein described that utilise the same concept as the version 1 trigger mechanism. Herein described are five trigger mechanisms. A combination of the features of these versions are envisaged to be within the scope of the invention.

The figures listed below relate to the following trigger mechanisms:

Version 1: Shown in FIGS. 11-31, 42-51
Version 2: Shown in FIGS. 32-41
Version 3: Shown in FIGS. 54-84
Version 4: Shown in FIGS. 85-88
Version 5: Shown in FIGS. 89-94

Version 2 Trigger

Figure 32:
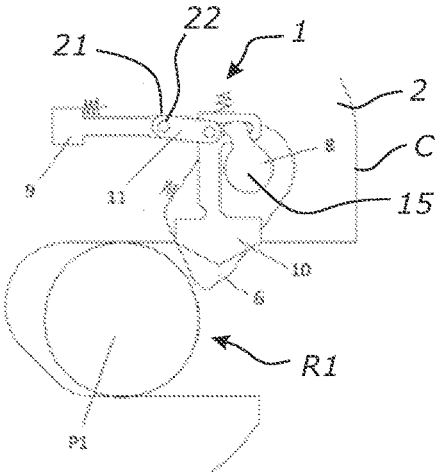
FIGS. 32-41: show detailed side schematic views of a pin of an attachment leaving an alternative (second version) embodiment retaining system.
Figure 33:
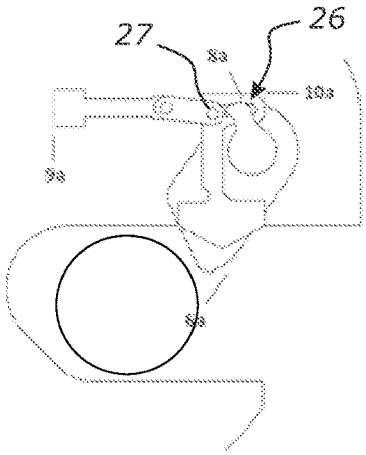
Figure 34:
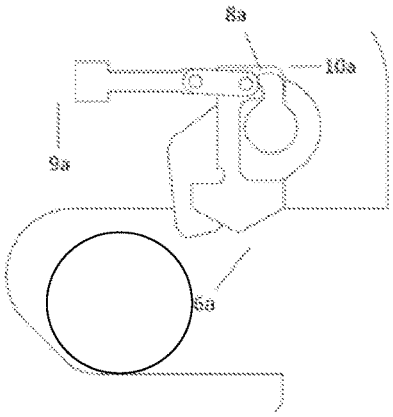

A variation of the mechanism shown in FIGS. 11-31 & 42-51 (herein also referred to as Version 1) is now described with reference to FIGS. 32-41 (herein also referred to as Version 2). In the version 2 trigger mechanism, rather than a driver 11 pulling the retainer 6 from its retaining position 6*a* to its fully retracted position 6*b*, the driver 11 is configured to push the retainer 6 from its retaining position to the retracted position. In FIG. 32 there is shown a coupler C that has a front receptacle R1 within which a front pin PI is registered. The FIGS. 32-41 show a pin PI being allowed to be removed from a coupler, via the retainer being actuated to a release positions, subsequent tripping of the trigger via the pin PI causes the retainer to move back to its occluding position. Figures of this embodiment, with ingress of the pin are not shown.

Provided as part of the retaining system 1 there is a retainer 6 pivotally mounted to the body 2 of the coupler C for rotation about its rotational axis 15. Forming part of, or engaged therewith, is a retainer lug 8 that also rotates with the retainer 6. The retainer lug 8 is able to be engaged and coupled by a driver 11 that is able to be driven by a driver actuator 9.

In this embodiment, coupling and decoupling does not necessarily mean connecting and disconnecting respectively. The driver 11 may or may not be still connected to the retainer 6 when decoupled, but the driver 11 has no drive on or cannot impart force to the retainer 6 until it is coupled. I.e. the drive to the driver can be decoupled, instead of the driver 11 being decoupled with the retainer/lug 8. In the embodiment shown, the driver 11 is decoupled mechanically via coming out of contact with the lug 8.

Figure 35:
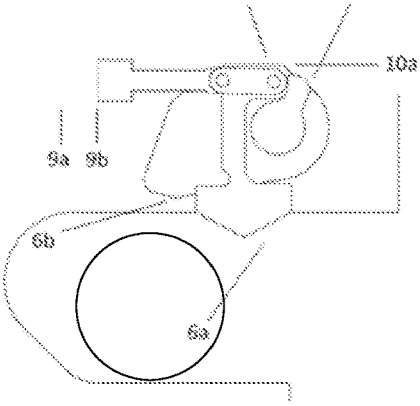
Figure 36:
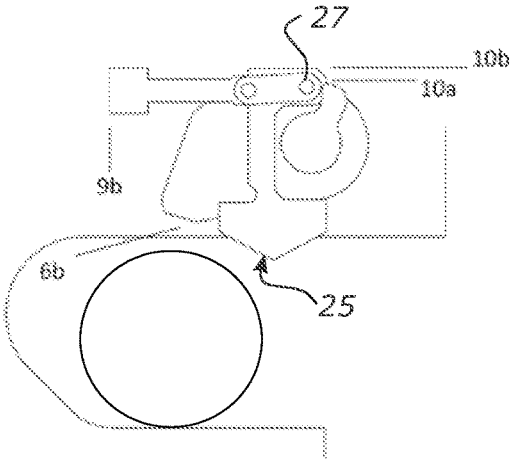
Figure 37:
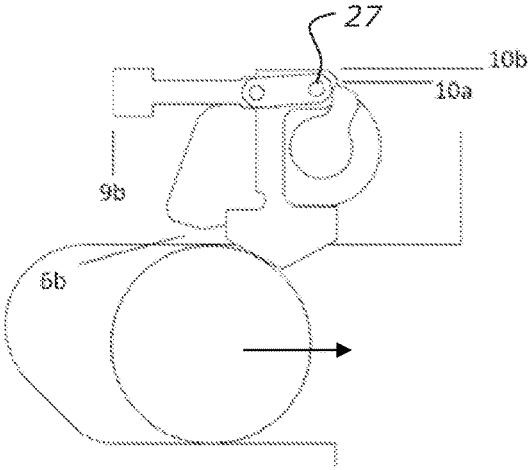
Figure 38:
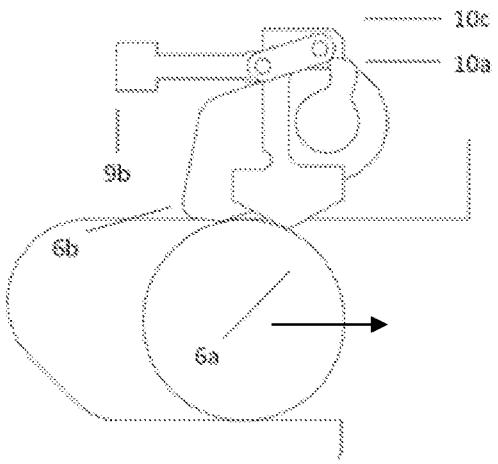

The driver actuator 9 can be caused to displace (between position 9*a* and 9B) the driver 11 to, when coupled, push against the lug 8 and cause the retainer 6 to move from its retaining position as shown in FIG. 32 to a released position as shown in FIG. 35. The driver 11 itself is able to both displace and rotate. The driver 11 may for example be mounted in a pivotal manner to the driver actuator 9 at a driver axle 21 to define a driver axis 22 for the driver 11.

Figure 39:
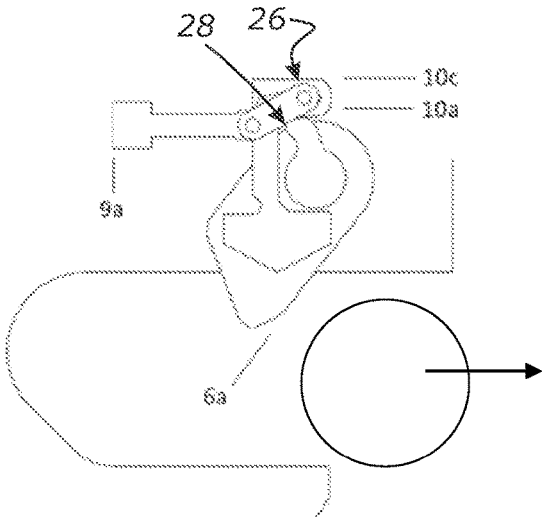
Figure 40:
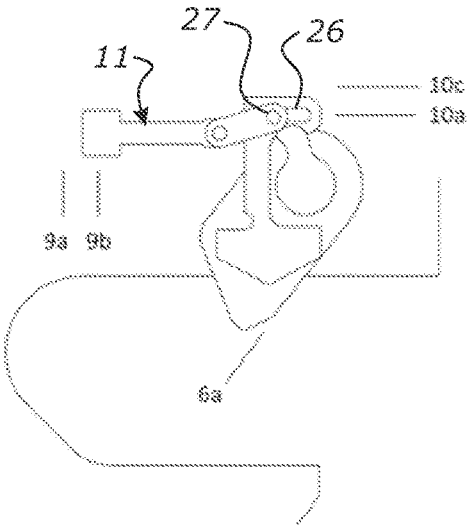
Figure 41:
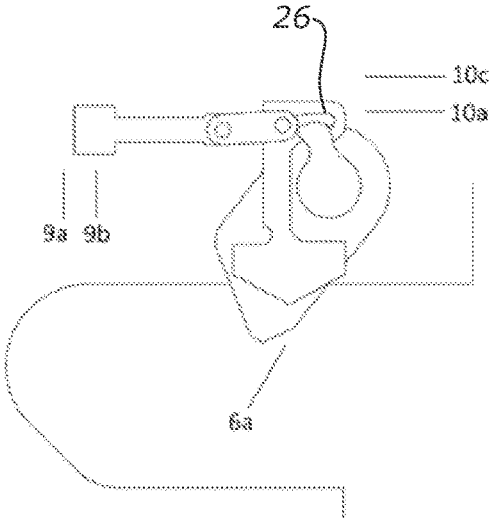
Figure 42:
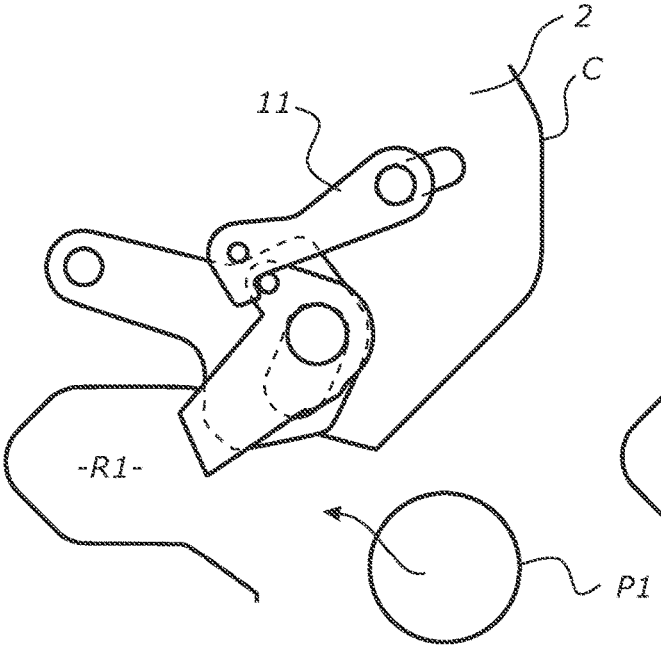
FIGS. 42-45: show detailed side schematic views of a pin of an attachment entering a retaining system after the retaining system was in 'lift mode' (second engagement mode).
Figure 43:
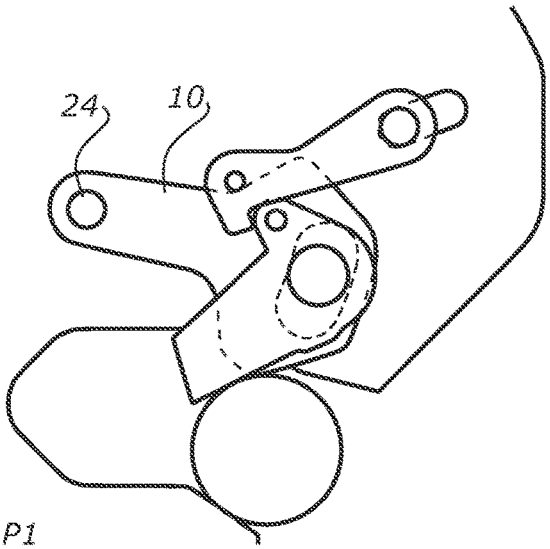
Figure 44:
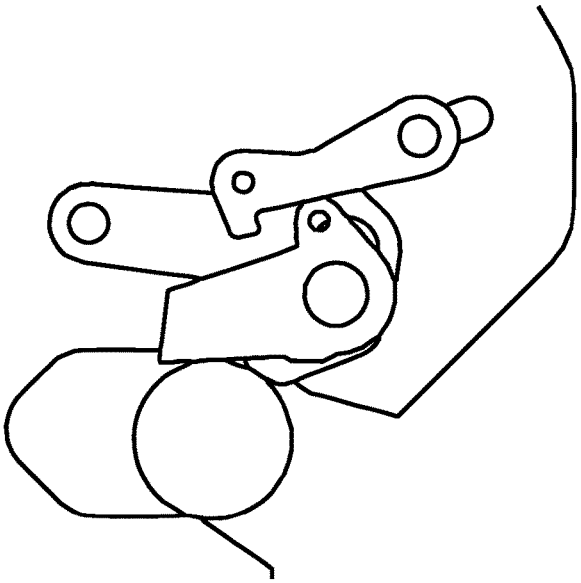
Figure 45:
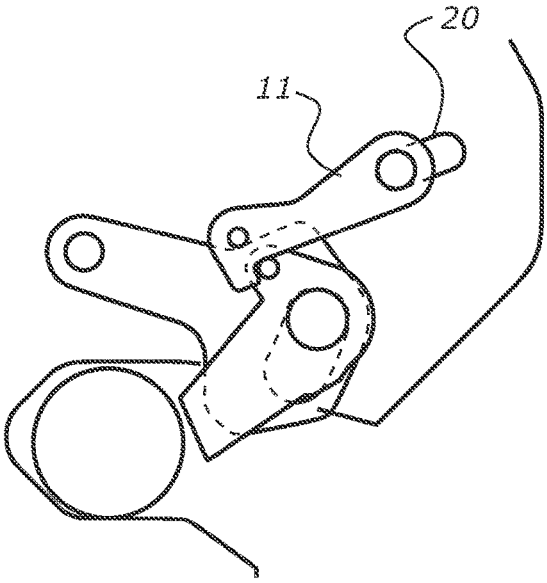
Figure 46:
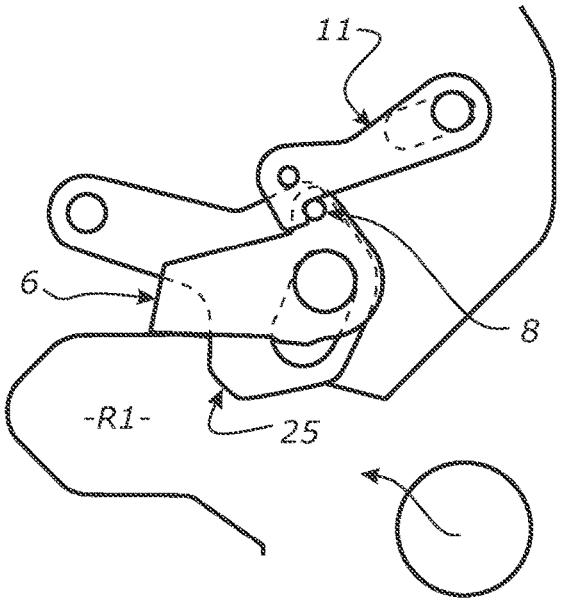
FIGS. 46-48: show detailed side schematic views of a pin of an attachment entering a retaining system after the retaining system was in 'lift mode' and the operator actuates the retaining system for engagement (third engagement mode).

A preferred feature that prevents re-latching of the driver 11 and lug 8 (i.e. at the coupling region) is a guiding surface 28 as shown in FIG. 39. The guiding surface abuts with the lug 8, or another part of the driver 11, to prevent coupling of the driver 11 and retainer 6. As a pin PI enters into the receptacle, the pin PI contacts and rotates the retainer 6. The lug 8 of the retainer 6 abuts the guiding surface of the driver 11 and so helps prevent coupling between the two. The trigger 10 in this embodiment may move due to the driver 11 being engaged with the trigger 10.

Like the retaining system 1 as described with reference to FIGS. 11-31, a trigger 10 is provided that is able to be displaced by the pin PI entering and exiting the receptacle RI. When the retainer 6 is in its retracted position as shown in FIG. 35, removal of the pin PI from the receptacle RI as shown in FIGS. 36-39 can cause the trigger 10 to move and decouple the driver 11 from the retainer lug 8. Similar to the retaining system 1 as described in FIGS. 11-31, the trigger 10 comprise a slot to carry or guide the driver 11. The slot 26 is formed by the trigger 10, as shown in FIG. 32, and retains the pin 27 of the driver 11. The slot also comprises/or is the tripping region 26 that engages the pin 27 of the driver 11. The tripping region 26 allows actuation of a trip pin 27 (between positions 10*a* and 10*c*) of the driver 11 to move along a defined tripping surface or slot 26 formed by the trigger 10.

Decoupling of the driver 11 with the lug 8 can cause the decoupling to occur (when the trigger is at position 10*c*) and for the retainer 6 to snap back to its retaining position once it is decoupled from the driver 11. Decoupling may not occur between positions 10*a* and 10*b*, but will occur past 10*b* towards position 10*c*.

In this embodiment, it is clear that movement of the trigger 10 can be linear with respect to the body 2. Other embodiments show a purely rotational movement of the trigger when triggered. It is envisaged it could also be a combination of rotational and linear movement.

The first embodiment as shown in at least FIG. 11, when in a decoupled condition, the driver 11 and retainer 6 are preferably disconnected. In other embodiments the driver 11 and retainer 6 are connected, but are in a decoupled condition, so the driver 11 cannot control the position of the retainer 6. Thus the driver 11 is ineffective to drive but is still able to follow and be connected to the retainer 6, much like the variation as shown in at least FIG. 32. And likewise for the coupled condition of the driver 11 and retainer 6, the driver 11 and retainer 6 may be connected to each other or not connected to each other, but in both embodiments, in the coupled condition the driver 11 is able to affect the retainer 6.

The actuation of the driver 11 may occur manually such as through a screw thread mechanism. Alternatively the actuation of the driver 11 may be by way of a hydraulic ram. In a preferred form there are two hydraulic rams provided for the coupler C for actuation of both the driver 11 (actuator 9) as well as the second retainer 3 (actuator 40)—this is shown in FIG. 52.

Preferably one of the trigger and retainer (e.g. the retainer lug) is able to engage with a region of the driver to hold the driver in a position to prevent the driver from coupling with the retainer. Preferably the trigger is able to house and locate one or more of the driver actuator, the driver and the driver spring. Preferably the retainer lug engages with a region of the driver, to hold the driver and associated trigger when the retainer is not coupled with the driver in a condition to not allow said coupling.

Version 3 Trigger

A variation (herein referred to as version 3) of the mechanism described above is now described with reference to FIGS. 54-83. Version 3 continues with the same reference numerals as used above in the previous two variations. In this variation the driver 11 is part of, and located and carried by a, driver assembly 60. The driver assembly 60, comprises the driver 11, the driver actuator 9, the return spring 31, an extension that protrudes into the recess R1 to act as a trigger 10, as well as other parts. The trigger 10 can actuate the driver assembly to rotate about an axle 21, when it is moved by an external force, such as a pin entering or egressing the receptacle RI.

Having the driver assembly 60 carry the trigger 10 means that there are less connections of the coupling system to the body 2. For example in the variation shown in FIG. 55, the driver assembly 60/driver 11 uses the same connection point as the trigger 10 to the body 2, which is the driver/trigger or driver assembly axle 21. In this embodiment the driver assembly axle 21 acts as the axle that the driver 11, and the trigger 10, can rotate about relative the body.

The reduction of connection points to the body 2 allows the coupling system to be easily manufactured and/or modular between different sizes of body 2. The modularity allows it to be used on different sized bodies for different sized machinery. The reduction of connection points may increase manufacturing efficiencies and may also aid in repair and/or maintenance of the coupling system.

In this embodiment the driver 11 moves with a purely translational movement, with respect to the trigger 10, to drive the retainer 6. However the driver 11 also moves on a rotational path due to driver assembly 60 being able to rotate about the axle 21. The driver assembly 60 rotates when the trigger region 25 is caused to move by a pin PI.

The driver assembly 60 comprises a hydraulic ram 9 to drive the driver 11. The driver assembly comprises a return spring 31 to bias back/return the driver 11, much like in the previous variations. However in this variation the return spring 31 is a tension spring, instead of a torsional spring.

Figure 56:
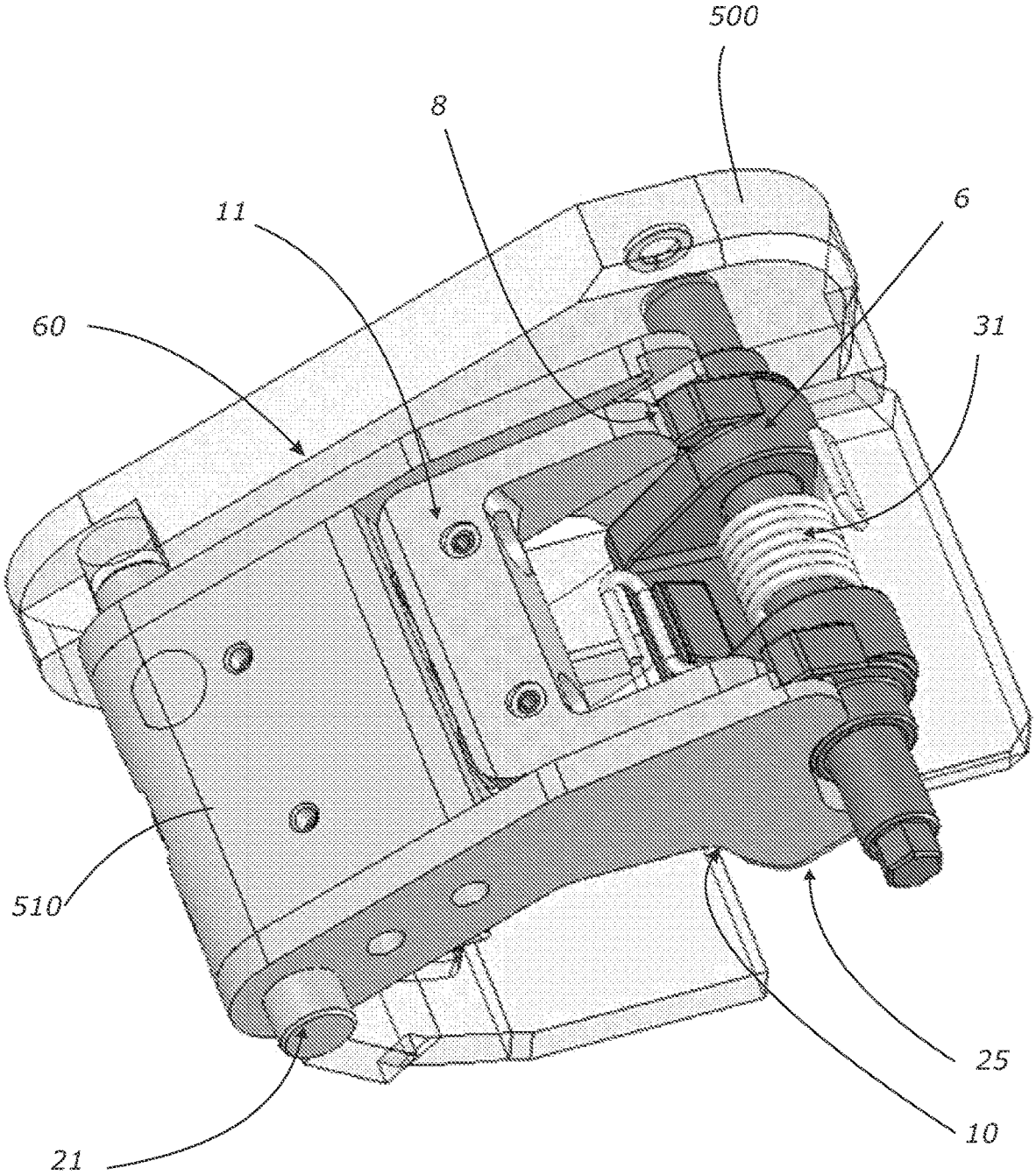
FIG. 56: shows a top rear perspective view of FIG. 55.
Figure 57:
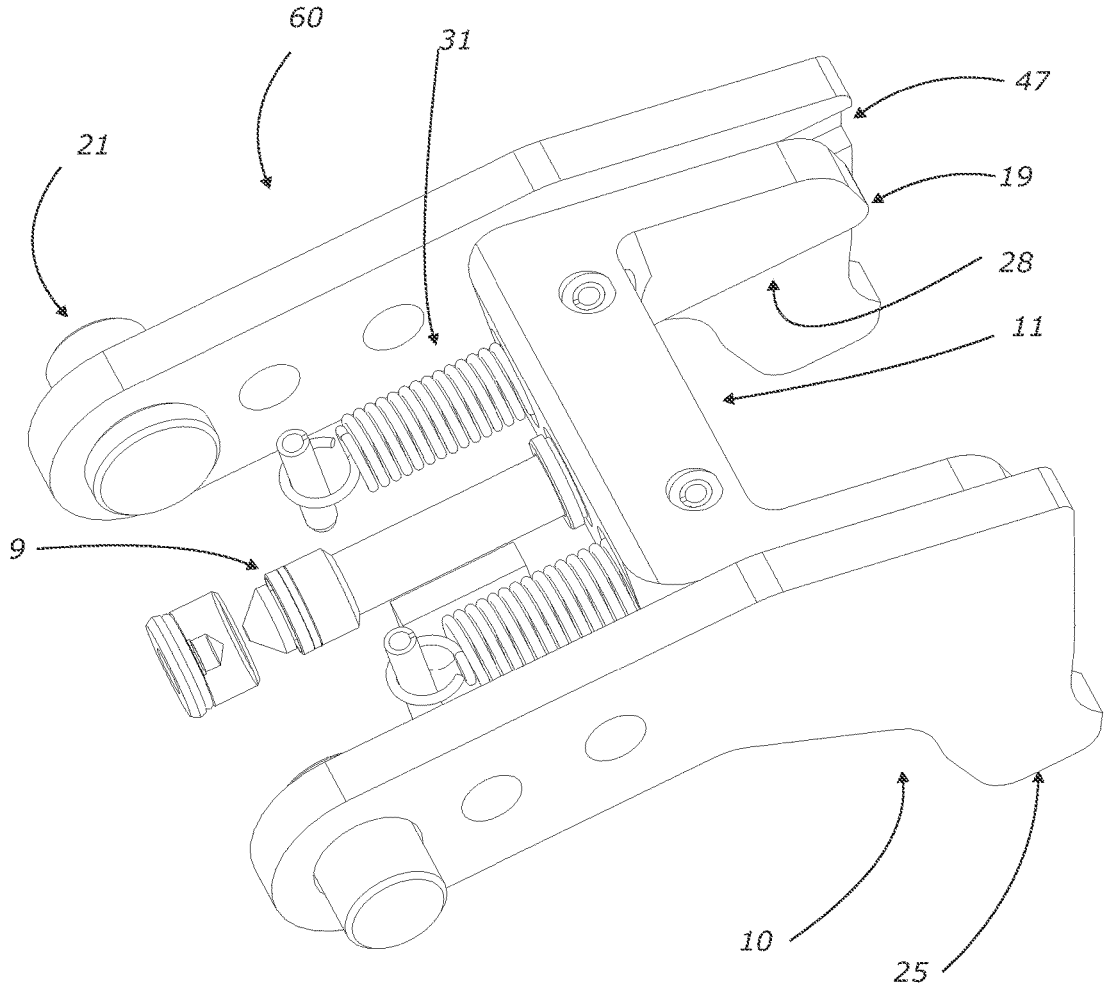
FIG. 57: shows a top rear perspective view of FIG. 55, with the trigger housing removed to highlight the driver ram and return springs.

Like the previous embodiment, the trigger 10 preferably has two trigger regions 25 that extend into to the receptacle RI one for pin entry contact and one for pin exit contact. As seen in FIG. 56, the driver assembly 60 has an intermediate housing portion 510 that is integral with or engages with the trigger 10. The housing portion 510 is able to house the hydraulic ram 9 and the return springs 31 that drive and retract the driver 11 respectively. FIG. 57 shows the trigger 10, the hydraulic ram 9 and the return springs 31, but hides the intermediate housing portion for clarity. The return springs 31 are fixed at one end to the trigger 10, and at the other end to the driver 11.

The driver 11 is able to translate with respect to the trigger 10. In the embodiment shown in the Figures, the driver 10 translates with respect to the trigger 10 along a linear translational path that may extend radial to the rotational axis of trigger axle 21. The driver 11 is able to be guided in operation along this linear translational path via guide means. In the embodiment shown, the guide means are a protrusion 48 and a complimentary guide channel 47. The protrusion 48 is located on the driver 11, and the complementary guide channel 47 is part of the drive assembly 60. The protrusion 48 can be seen in FIG. 55, and the guide channel 47 can be seen and FIG. 57. There may be numerous mechanisms and configurations to allow the driver 11 to be mounted with the drive assembly in a translational manner with respect to the trigger 10.

The driver 11 operates in a similar function to the previous embodiment described. The driver 11 comprises a coupling region 19 that can couple with a lug 8 on the retainer 6. As the driver 11 is driven forward by the hydraulic actuator 9, the retainer 6 is rotatably forced about its rotational axis so that the region of the retainer 6 that extends into the receptacle R1 is removed from the opening of the receptacle to allow a pin PI to pass therethrough. As a pin PI passes there through, it will interfere with the region 25 of the trigger 10, to therefore trip the trigger 10 to raise the driver assembly 40, and trigger 10 about the axle 21. In doing so, de-coupling the coupling region 19 so that the driver 11 no longer engages with the retainer 6. As such, the retainer 6 is then biased back into the opening of the receptacle R1 via a torsional return spring 31.

Figure 58:
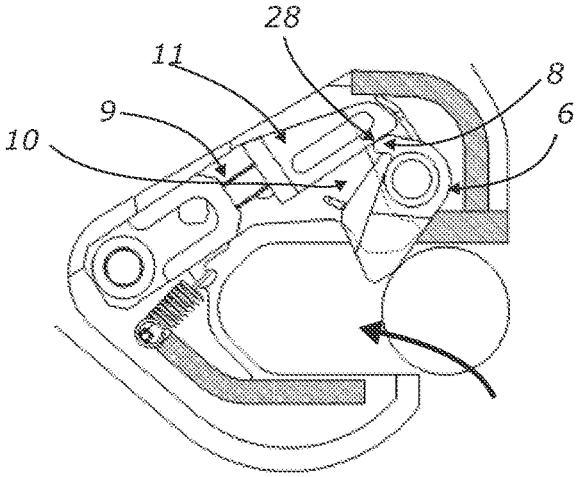
FIGS. 58-66: show detailed side schematic views of a pin of an attachment entering a third version retaining system in first engagement mode.
Figure 59:
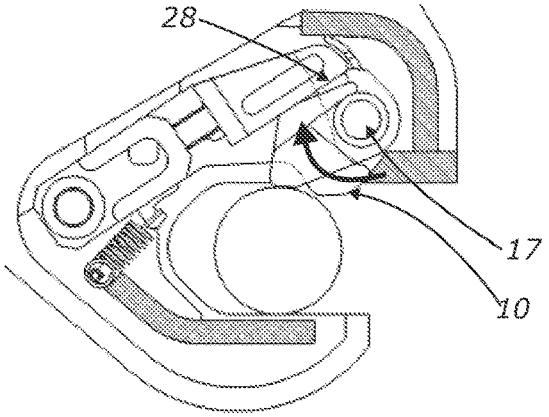

A feature that prevents re-latching of the driver 11 and lug 8 (i.e. with the coupling region) is a guiding surface 28 as shown in FIGS. 57-59. The guiding surface 28 abuts with the lug 8, or another part of the driver 11, to help prevent coupling of the driver 11 and retainer 6. As a pin PI enters into the receptacle RI, the pin PI contacts and rotates the retainer 6. The lug 8 of the retainer 6 abuts the guiding surface 28 of the driver 11 and so prevents coupling between the two. The trigger 10 in this embodiment moves with the driver 11 as the driver 11 is carried directly by the trigger 10.

In this embodiment, there is no tripping region in FIG. 26, as the trigger 10 now carries the driver 11. As such, movement of the trigger 10, when triggered, directly moves the carried driver 11.

The driver 11 and the trigger 10 in combination may be called a trigger/driver assembly. The tripping region 25 may be located on the driver 11 or driver actuator of a trigger/driver assembly. This alternative is not shown.

In order to explain the retainer system 1 shown in FIGS. 54-57, reference will now be made to the sequence of drawings of FIGS. 58-66 where the process of engaging a pin PI is shown and in FIGS. 67-83 where the process of disengaging a pin PI is shown.

FIGS. 58-66 show a pin entering into the retaining system 1, when the retaining system is the first engagement mode, which is the most typical mode when an operator is swapping attachments. In the first engagement mode the driver 11 is already extended from the previous disengagement process.

FIG. 58 shows the driver 11, and in this embodiment, the associated trigger 10, held up via the retainer lug 8 engaging with tripping region 26 (partially hidden in theses Figure for clarity to see the driver 11, but can be seen in FIG. 57). As the lug 8 is engaged with the tripping region 26, the trigger 10 does not extend substantially into the passage P to occlude the passage P. The pin PI can enter into the passage P of receptacle RI, with or without contact to the trigger region 25.

Figure 64:
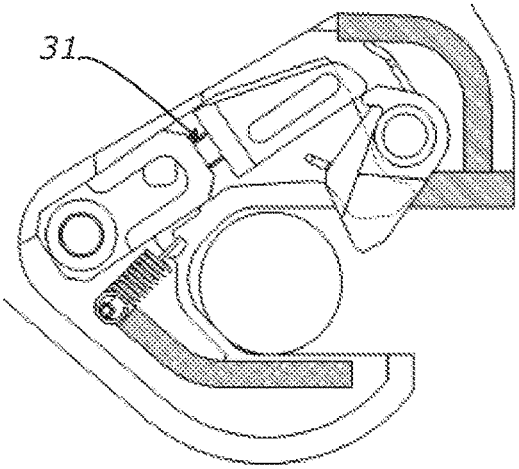
Figure 65:
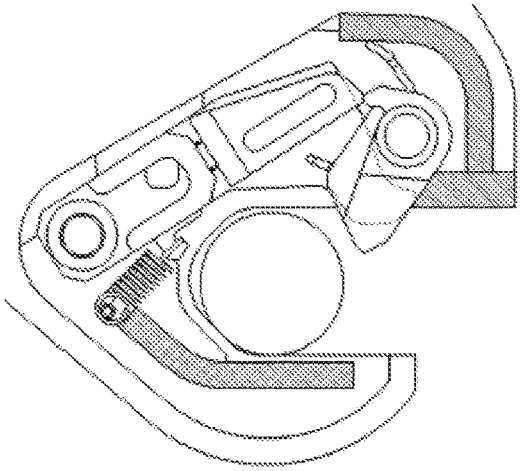
Figure 66:
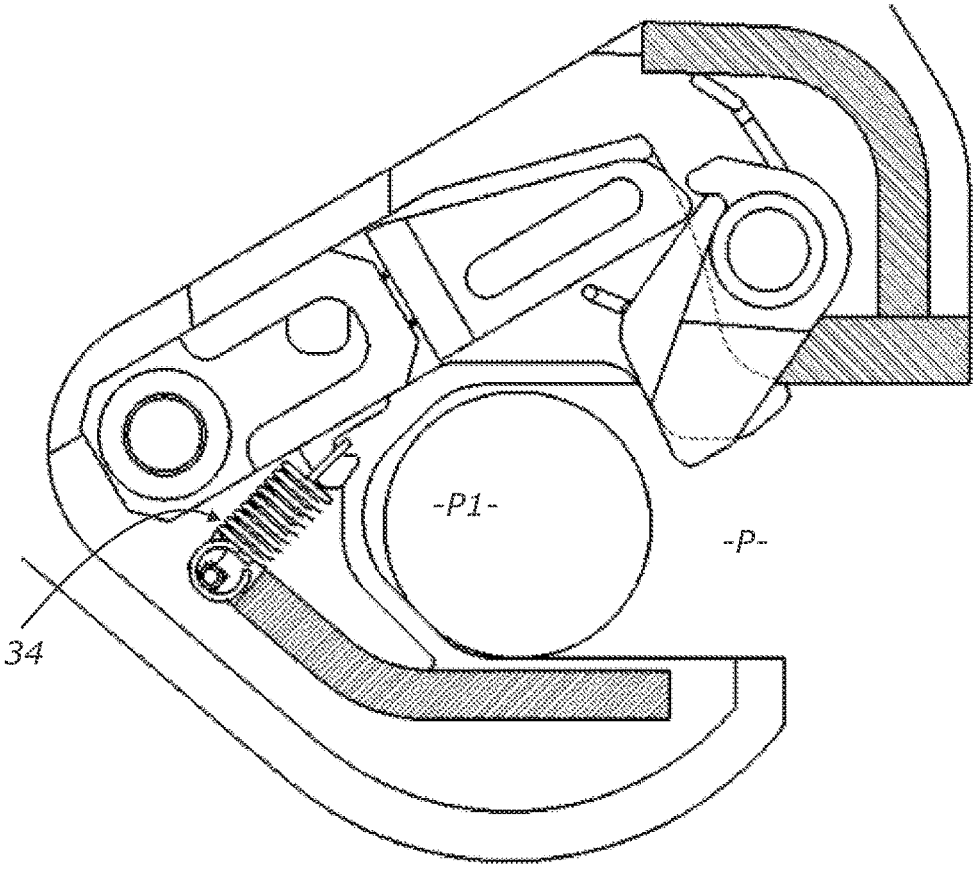

As the pin PI passes through the passage P to enter the receptacle, the pin PI contacts the retainer 6, therefore rotating the retainer 6 about the retainer shaft 17. The retainer 6 biases back to its biased condition once the pin PI has sufficiently passed. The trigger 10 does not bias back to its biased condition, until the user causes release of hydraulic pressure from the driver ram 9, to allow the driver return spring 31 to pull back the driver 11 to its retracted position—as shown in FIGS. 64-66. When the driver 11 returns to its retracted position, the trigger 10 is able to rotate about its trigger axle 21, to its biased position, as the tripping region 26 is no longer hindered by the retainer lug 8 (FIGS. 65 to 66). The trigger may be biased by the trigger return spring 34. This may act on the trigger and/or on the driver to help cause the trigger/driver to rotate clockwise in the orientation shown in the Figures. Whilst the driver 11 is extended, the tripping region 26 of the trigger 10, and the retainer lug 8 engage with each other.

Figure 60:
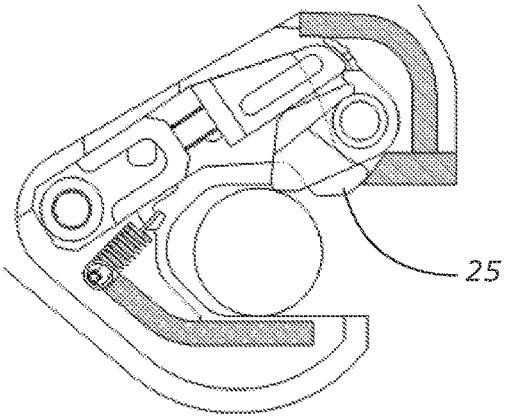
Figure 61:
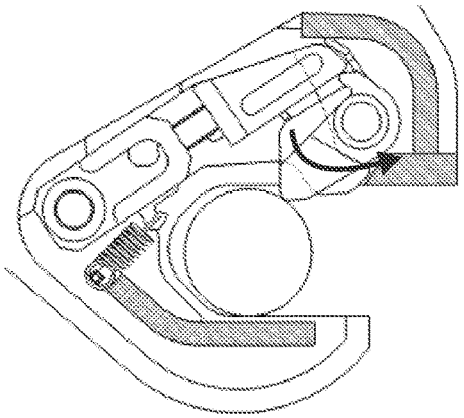
Figure 62:
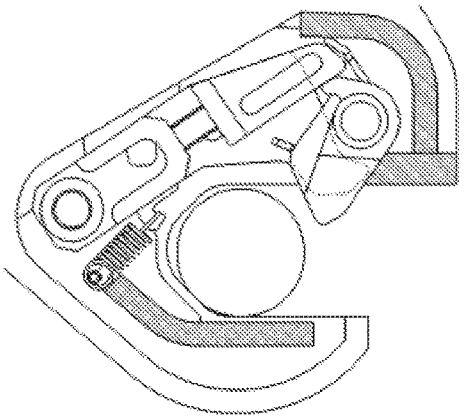
Figure 63:
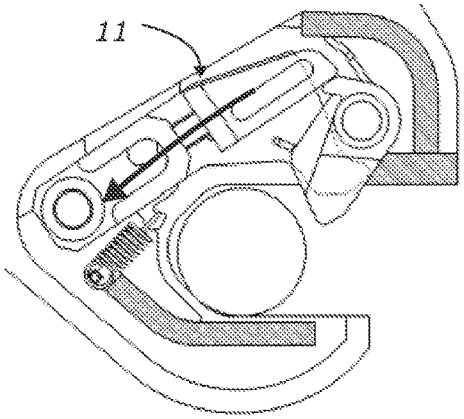

The retainer 6 is seen at one of its full rotational limits in FIG. 60 with a pin PI as large as possible. Smaller pins would not rotate the retainer 6 to this extent (but can still be used effectively), but illustrating the large pin PI shows that the lug 8 of the driver 11 is never leaves, or extends past, the guiding surface 28, and as such the driver 11 does not couple at the coupling region 19 with the lug 8 whilst the driver 11 is extended.

Figure 67:
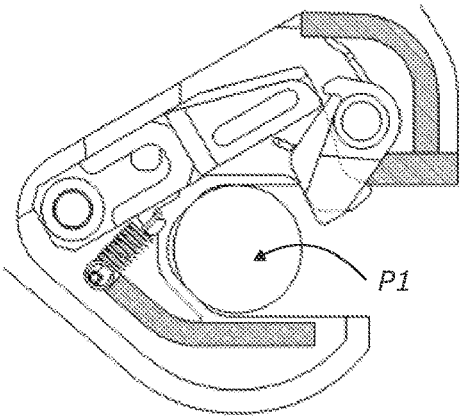
FIGS. 67-83: show detailed side schematic views of a pin of an attachment egressing a third version retaining system.
Figure 68:
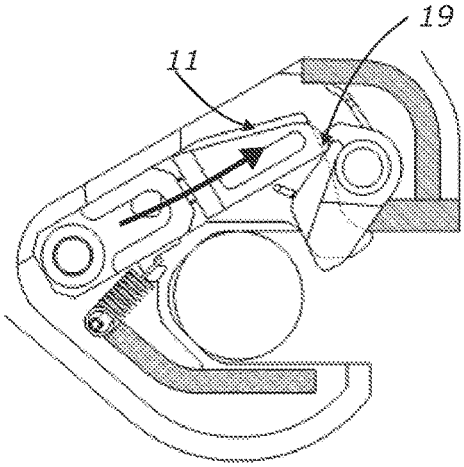
Figure 69:
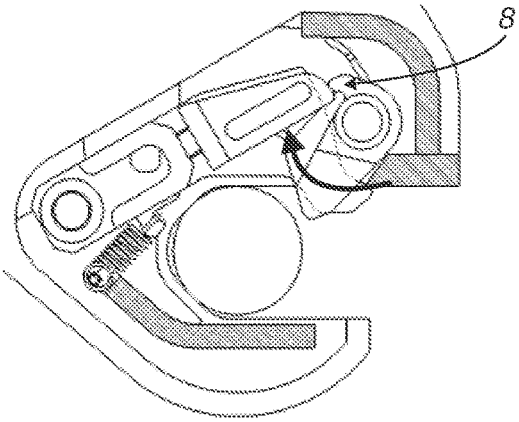
Figure 70:
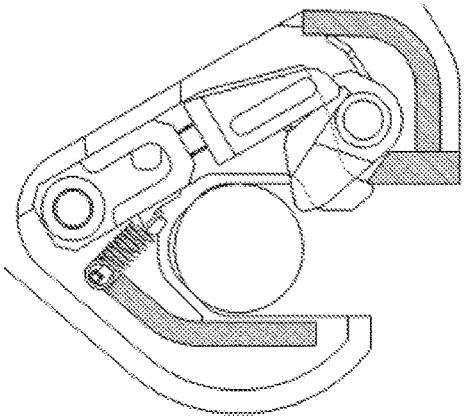
Figure 71:
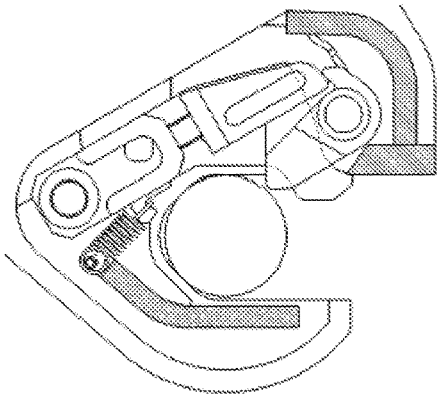
Figure 72:
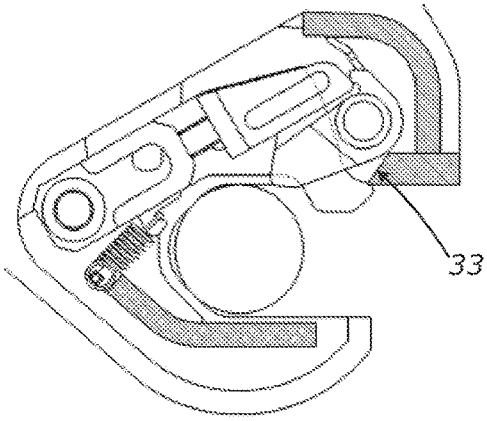
Figure 73:
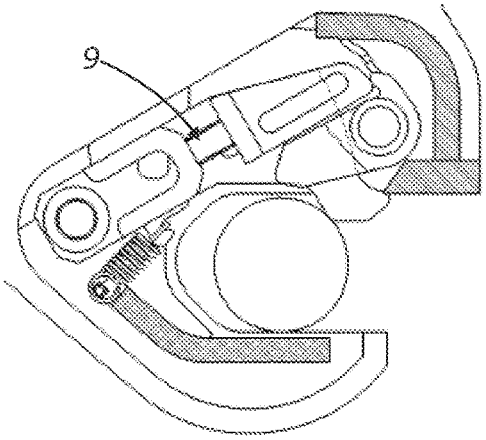

FIGS. 67-83 show a pin egressing the retaining system 1. FIG. 67 shows the pin PI in an operational working mode captured at the receptacle. The driver 11 is retracted, the trigger 10 is biased downwards, the retainer 6 is biased downwards to lock the pin PI in the receptacle RI, and the tripping region 25 extends into the passage P. FIG. 68 shows the driver 11 starting to extend via hydraulic pressure being applied to the driver ram 9. FIG. 68-69 shows the driver 11 coupling region 19 starting to engage the retainer 6. FIGS. 69-70 shows the retainer 6 being rotated about its retainer shaft 17 until the retainer 6 reaches its rotational limit in FIG. 73 and so it is not occluding the passage P to prevent pin removal. At this stage, the operator/user can cause to move the retaining system 1 so that the pin PI can egress from the receptacle RI via the passage P.

Figure 74:
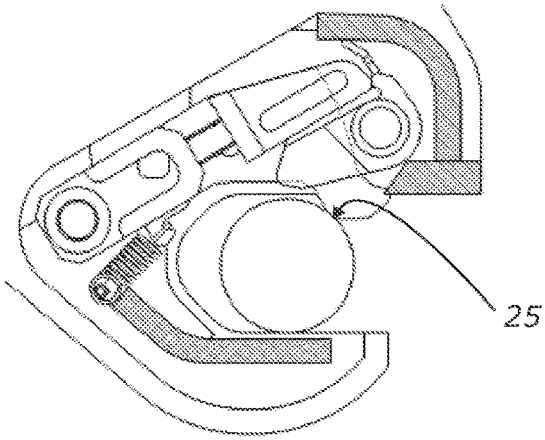
Figure 75:
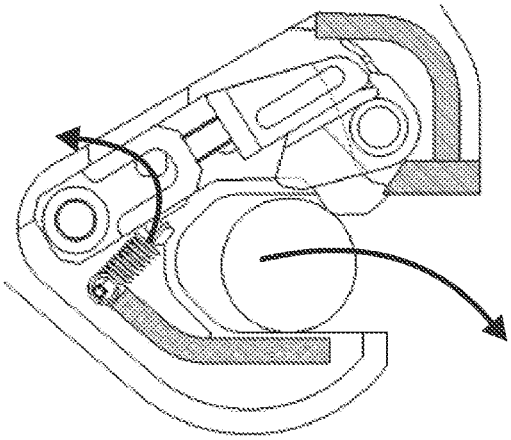
Figure 76:
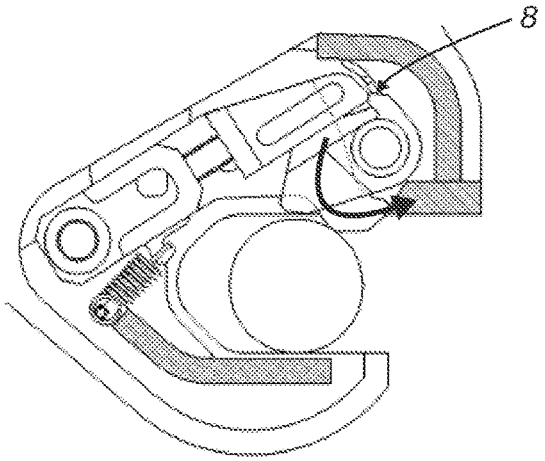
Figure 77:
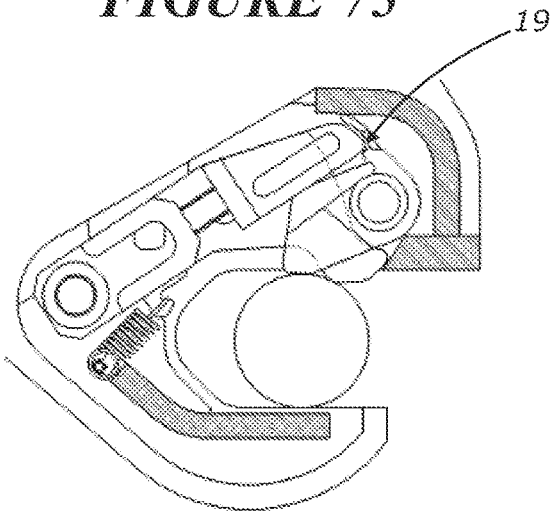
Figure 78:
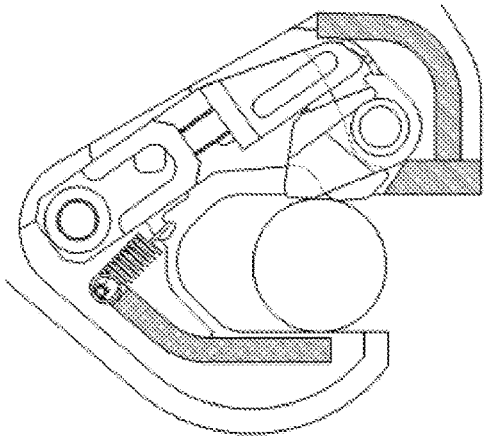

FIG. 74 shows the pin PI starting to interfere with the tripping region 25 of the trigger 10. This causes the driver to lift up and out of operative contact with the lug 8. FIG. 76 shows the lug 8 of the retainer 6 at the crux of losing contact with the coupling region 19 of the driver 10. FIG. 77 shows the lug 8 of the retainer 6 passing past the coupling region 19 to allow the retainer 6 to start rotating back to its retaining position—to be stopped by a rotational stop 33 (Shown in FIG. 72). At this stage the pin PI is still lifting the driver 11 and trigger 10 upwards to fully release the retainer 6 from the driver 10. FIG. 78 shows the retainer 6 and associated lug 8 fully clear of the driver 10 and associated coupling region 19.

Figure 79:
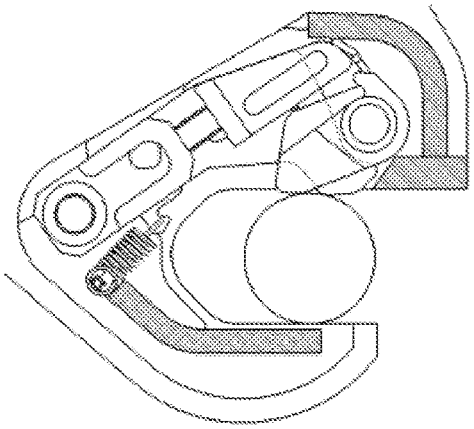
Figure 80:
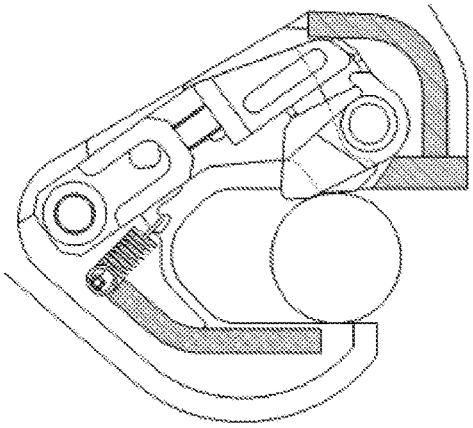
Figure 81:
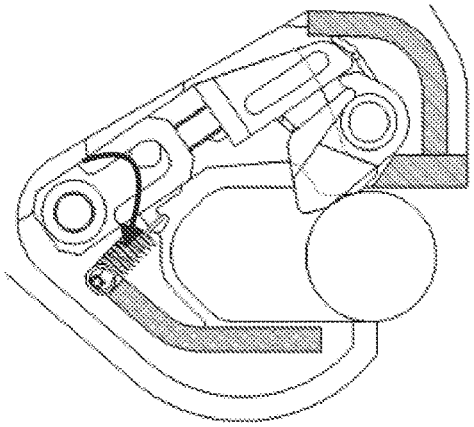
Figure 82:
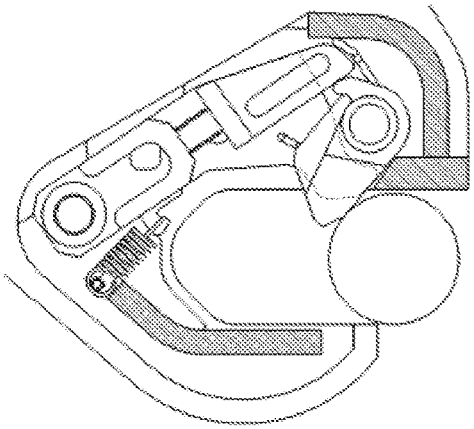
Figure 83:
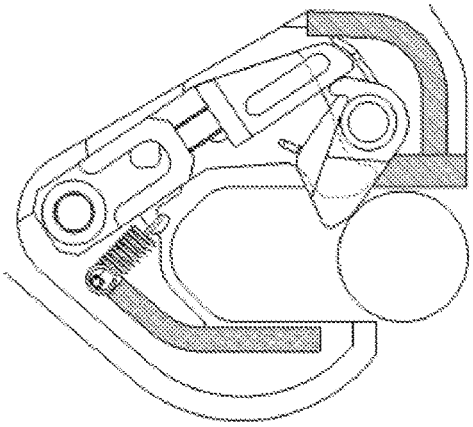

FIG. 79 shows the retainer 6 and the trigger 10 at their highest points, substantially fully or sufficiently retracted from the receptacle RI. From FIG. 80, the retainer 6 has started returning back to its biased position into the receptacle RI as the pin leaves the receptacle RI. The trigger 10 is at its highest point in FIG. 80. In FIG. 81, the trigger 10 starts to enter and return into the receptacle RI. FIG. 83 is now in the stage that is seen in FIG. 58.

The geometry of the lug 8 and the driver 11 at the coupling region 19 should be such as to allow the coupling region 19 to be able to slide off the lug 8 when the retainer 6 is at, or close to, its rotational extent corresponding to being substantially clear of the receptacle RI. If there is too much undercut shape to the lug 8 the upward movement of the trigger by a pin may be prevented by the lug 8.

In the numerous embodiments the lug 8 is shown as being integral or attached with the retainer 6. However it is envisaged that the lug 8 or other coupling feature is separate or remote from the retainer 6, such as being attached to the rotational shaft of the retainer 6. The lug 8 may still be integral with the retainer 6 as the retainer 6 may also be integrally formed with its rotational shaft.

The position and shape of the trigger region 25 of the trigger relative to the operative regions of the retainer 6 are also important. As the pin PI leaves the receptacle RI, as seen in FIG. 73-83, the pin PI should contact the trigger region 25 at an advancing direction facing surface of the pin PI and subsequently allow the retainer 6 to rotate back into the receptacle RI after the pin PI has advanced sufficiently in an out direction from the receptacle RI. The retainer 6 should be shaped and/or positioned to not contact an advancing direction facing surface of the pin PI in a manner to prevent further advancement of the pin PI out of the receptacle RI. Ideally the retainer 6 may contact with the pin PI, as the pin PI advances out of the receptacle RI, with a trailing direction facing surface of the pin PI.

Alternative Embodiments

In an alternative embodiment (not shown) the coupling region 19 of the driver 11 may be a geared rack type feature. A complementary geared rack, surface or gear—which acts to achieve a similar function to the lug 8—is located on or integral with the retainer 6. Linear action of the driver back and forth moves the geared rack coupling region to drive the rack, when engaged to the coupling region, on the retainer 6. A trigger may still act upon this geared linear driver to decouple and couple the geared driver with the retainer 6. Disadvantages of geared system is that the teeth of a geared system may wear faster than single surface engagements, or debris may inhibit functionality.

In an alternative embodiment (not shown) the coupling region of the driver may be a geared rack or gear, which acts to achieve a similar function to the lug, but it is driven by a rotationally driven driver. I.e. the driver does not have a linear action, it is instead a rotationally driven gear wheel that has teeth to act as a coupling region to engage with like teeth on a retainer 6. A trigger may still act upon this geared rotational driver to de-couple and couple the geared driver with the retainer 6. The coupling and the de-coupling may be in a form of a mechanical system de-coupling or a de-coupling of the hydraulic/electric drive. The geared driver may be located on the end of a lever that is pivoted, and when triggered, the lever is lifted up to de-couple the geared driver from the gears of the retainer 6. In alternative embodiments, the geared driver may have a hydraulic de-coupling so that the geared driver is able to free rotate when decoupled, to allow the retainer 6 to bias back to its passage occluding position. In a further alternative embodiment of this alternative embodiment, the driver may be torsionally biased to rotate backwards to rotate the retainer 6 back to its occluding position, instead of the retainer being torsionally biased. Alternatively, both the driver and the retainer may be torsionally biased so as they are biased to rotate back to their rotational starting positions. In this embodiment, the driver may not be a full geared wheel, it may be a section/periphery of teeth between a chord that rotate about a shared pivot axis.

In other embodiments however, some of which are shown in the figures and described herein, the coupling region 19 and lug 8 are not a geared interface. The coupling region 19 and lug 8 have a sliding, gliding, abutting and/or single surface engagement. Benefits of such may allow reduced wear, chance of catching debris and/or manufacturing tolerances compared with geared or more complex or other systems. This can also be stated for the engagement (where there is engagement) of the retainer 6 or lug 8 with the guiding surface 8.

In an alternative embodiment (not shown) the coupling region 19 is a shaft or axle that shares a rotational axis with the one or more retainers 6. The axle is driven directly or indirectly by a driver such as a hydraulic or electric motor. Rotation of the retainers 6 to move them from their occluding to the raised position is via drive of the motor to drive the axle to rotate and drive the retainers 6. To allow the coupling of the motor from the retainers 6, the trigger system would need to trigger either a) the drive of the motor, i.e. a hydraulic or electric de-coupling to allow the motor to free spin to release the retainers 6 from their raised positions, or b) a mechanical trigger that is able to de-couple the motor to the retainers to allow the retainers 6 to bias back to their occluding positions.

Figure 84:
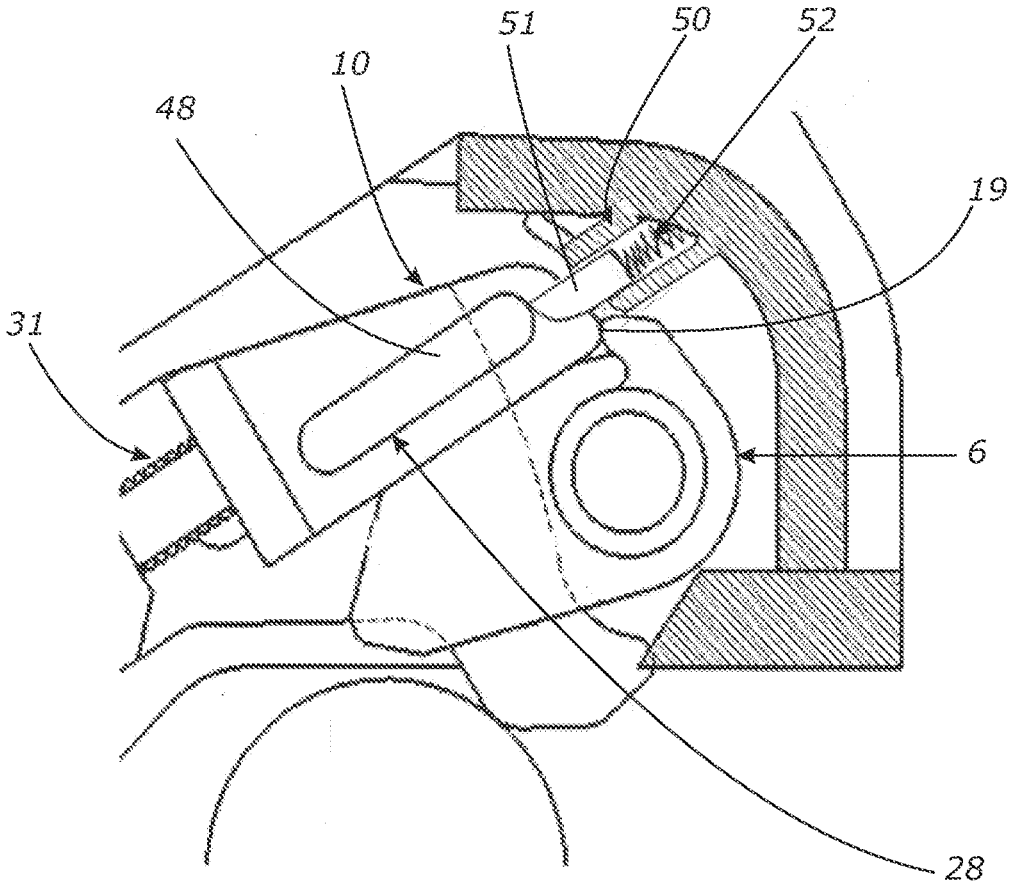
FIG. 84: shows a detailed side schematic view highlighting a latching system for a driver.

In an alternative embodiment, as shown in FIG. 84, the guiding surface 28 is now located below the protrusion 48. The guiding surface 20 does not have interaction with the retainer 6 or lug 8. Instead a spring latch system 50 is able to catch and prevent the driver 10 from engaging with the lug 8 of the retainer 6 after the driver 10 has been fully extended and triggered upwards to decouple. This allows the retainer 6 to move rotationally back to its occluding position in the passageway without engaging or contacting the driver 10 again until it moves back to its first position. The driver 10 when triggered by the trigger 11 is pushed above a latch 51 of the spring latch system 50. Once a portion of the driver 10, in this embodiment the protrusion 48, is above the latch 51, the driver 10 is prevented from biasing downwards to contact the retainer 6. When the driver 10 is retracted, the protrusion slides off the latch 51 to allow the driver 10 to rotationally bias back to its original position. The spring 52 of the spring latch system 50 allows the latch 51 to slide a distance under the guiding surface 28 as the driver 10 driven upwards by the trigger 11. Having the driver raised, and then held by the latch 51 allows the retainer to rotate freely without interaction with the driver.

In an alternative embodiment (not shown) to the embodiment shown in FIG. 84, the driver 10 may be guided by a path or slot. As the driver extends to drive the retainer 6 to its raised position, the driver follows a first extend path. As the driver is triggered upwards, the driver enters a return path, when the driver retracts, the driver follows the return path. The return path prevents interaction between the driver 10 and the retainer 6, as the retainer 6 returns to its occluding position. As such the guiding surface 28, does not have interaction with the retainer 6 or lug 8. Instead the guiding surface 28 is part of the slot, which is fixed relative the body of the coupler, and the engaging surface 28 engages with a part of the driver 10.

Version 4 Trigger

A trigger mechanism (also herein referred to as version 4) of a retaining system is now described with reference to FIGS. 85-90. Version 4 of the retaining system differentiates from some of the other versions by the trigger having a linear translatable movement with respect to the coupler body. Along with the trigger 10 translating with respect to the coupler, the trigger 10 may also carry the driver 11. The driver 11 may be carried by the trigger 10, and can move between the retaining position 6*a* and non-retaining or retracted position 6B.

Figure 85:
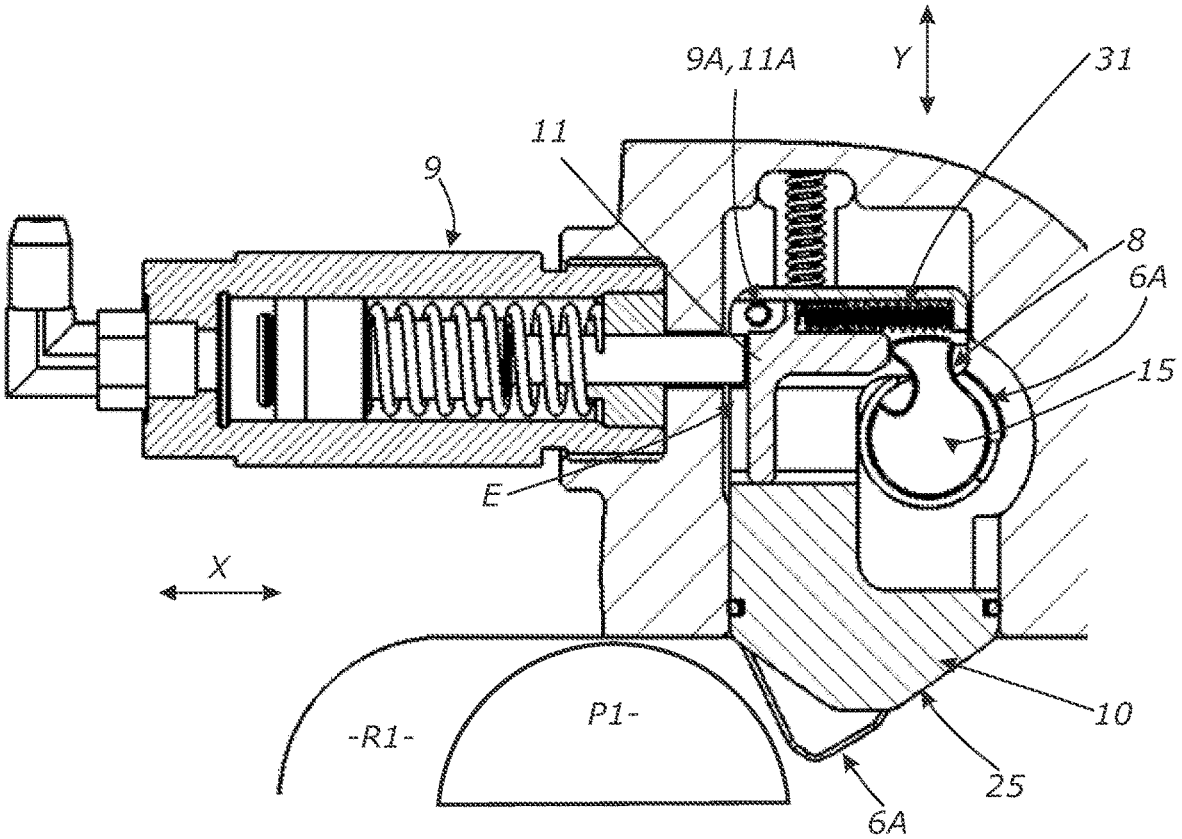
FIGS. 85-90: shows side schematic views of a pin of an attachment having an alternative (fourth version) embodiment retaining system.
Figure 86:
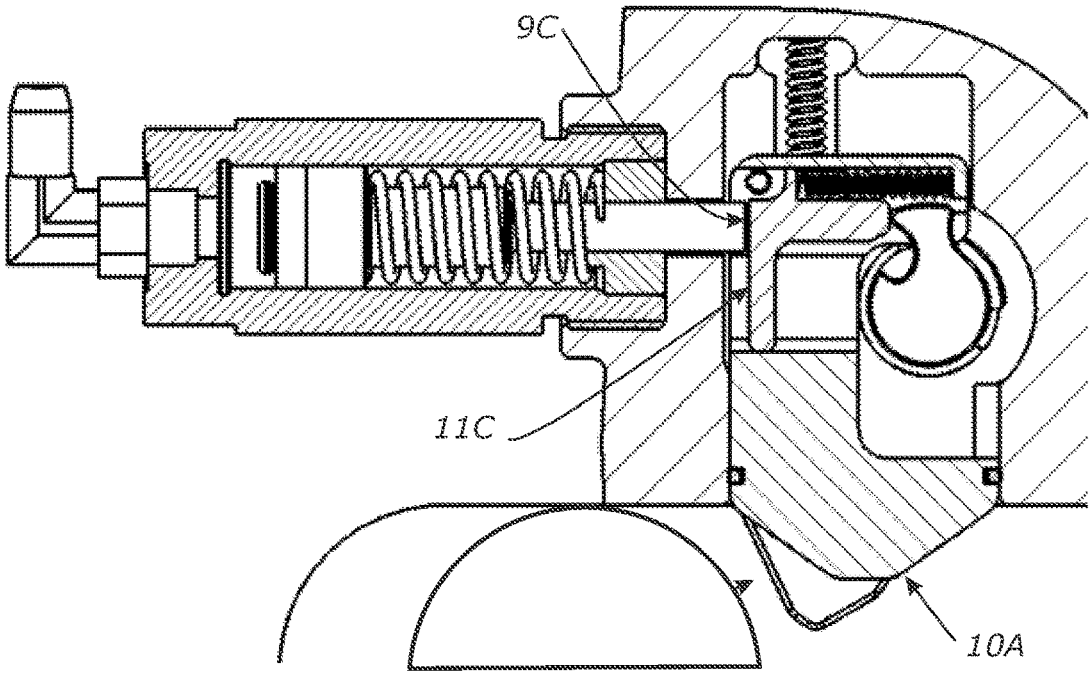
Figure 87:
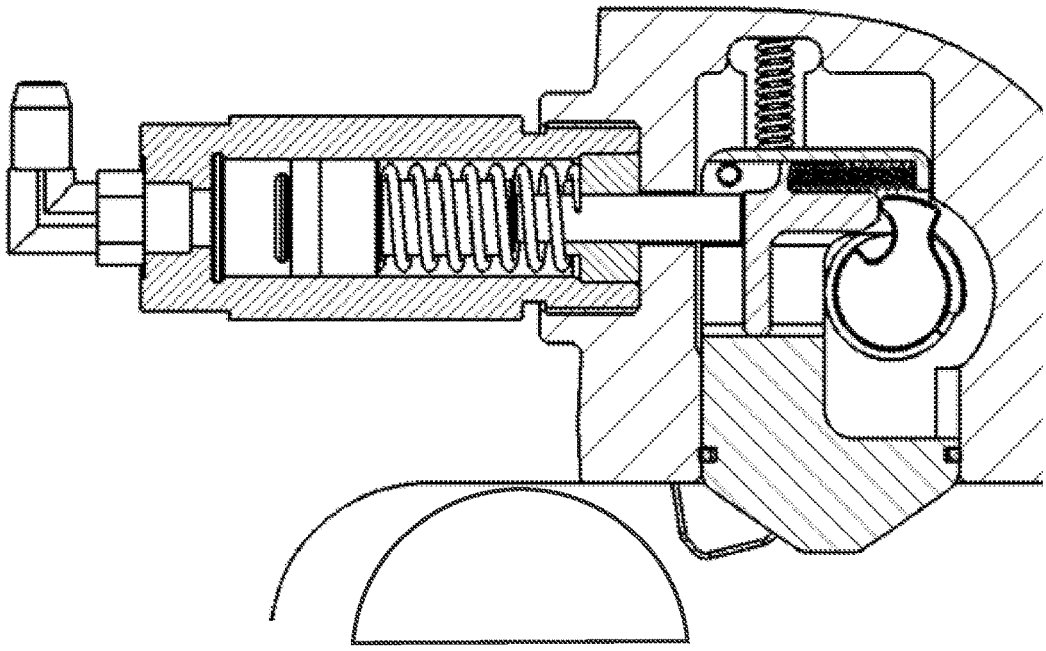
Figure 88:
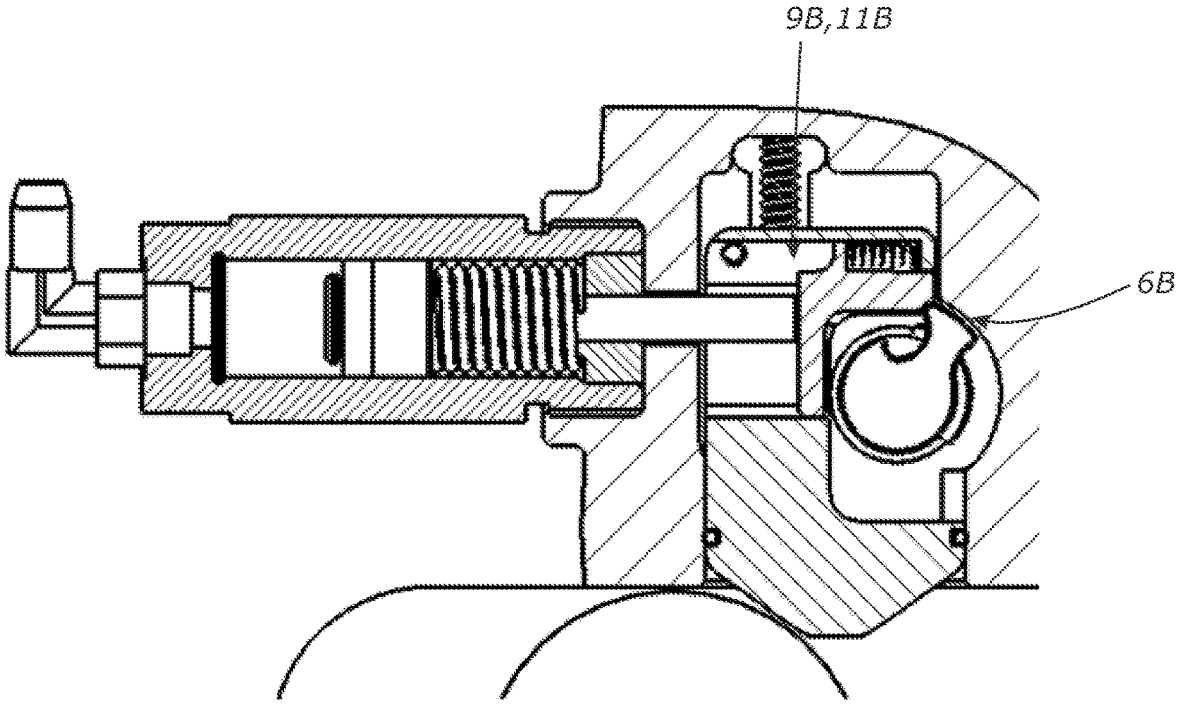
Figure 89:
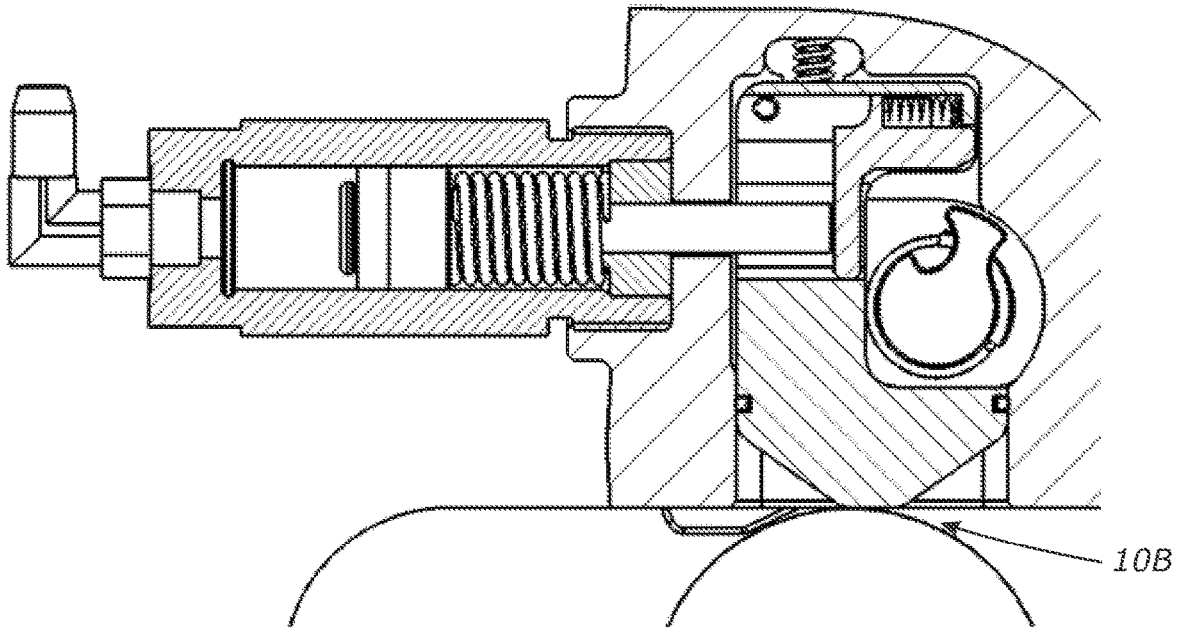
Figure 90:
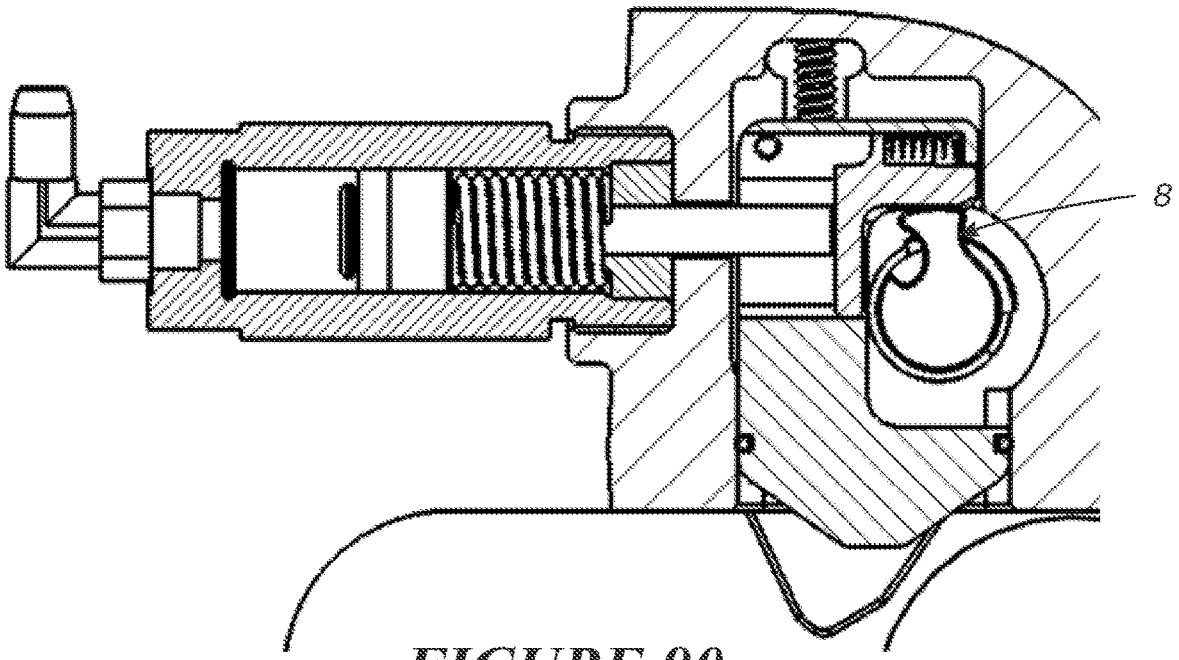
Figure 91:
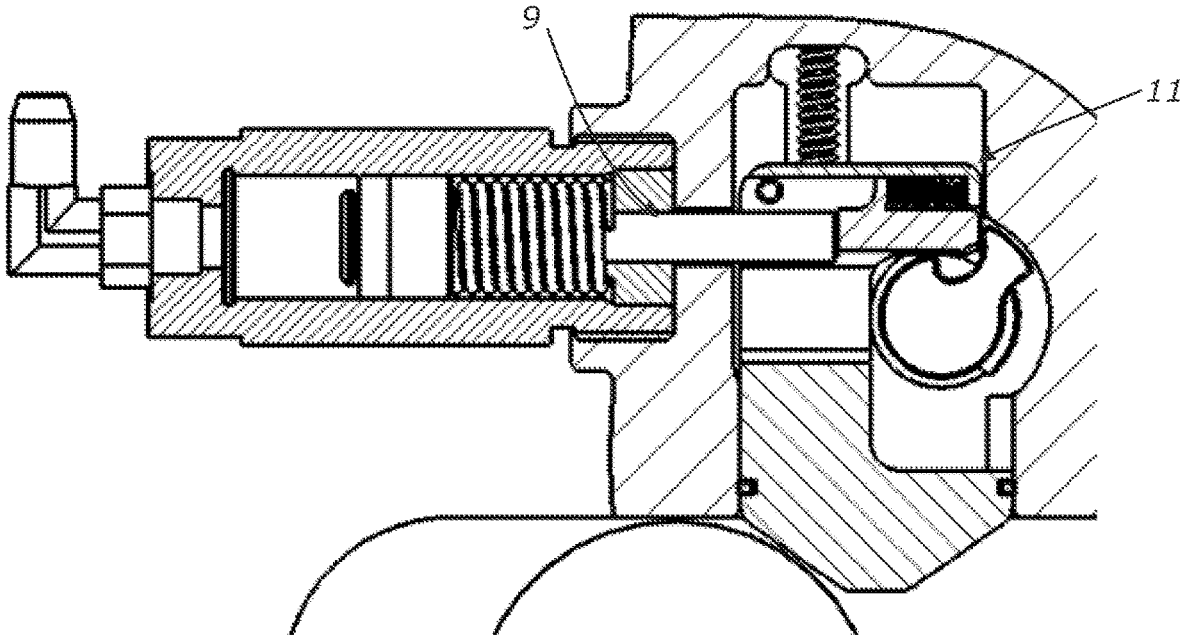
FIGS. 91-94: shows side schematic views of a pin of an attachment having an alternative (fifth version) embodiment retaining system.
Figure 92:
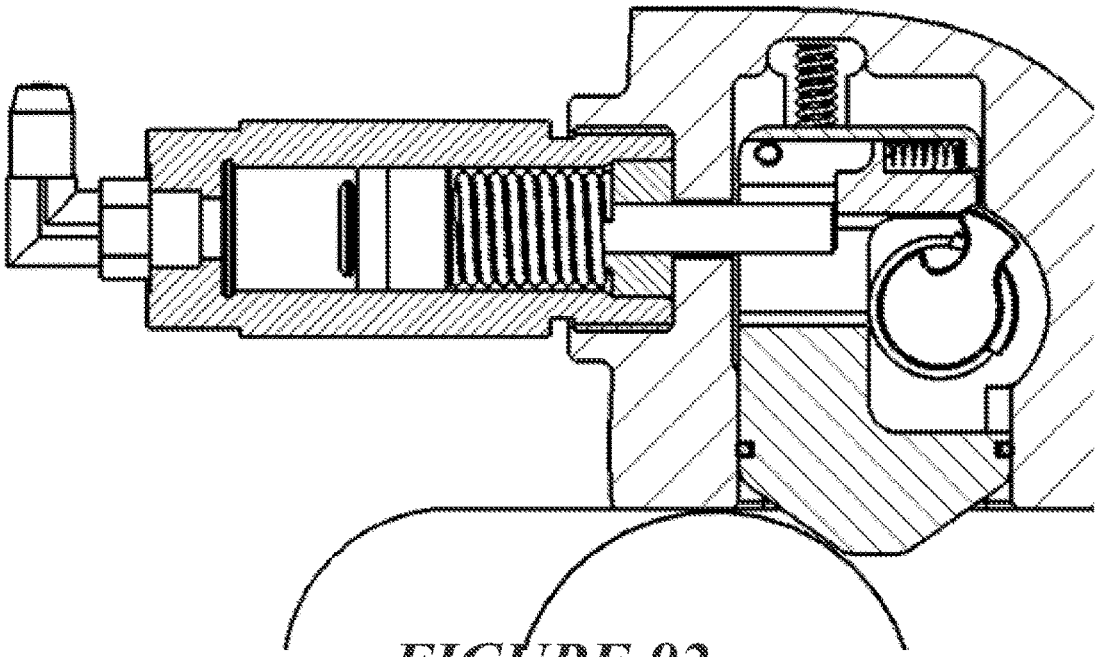

The driver 11 may be configured to translate to push/drive the retainer 6 from its retaining position 6*a* (FIG. 85) to the retracted position 6*b* (FIG. 88). In FIGS. 85-87 there is shown a coupler C that has a front receptacle R1 within which a front pin PI is registered. FIGS. 88-90 show the pin PI being allowed to be removed from the coupler via the retainer 6 being actuated to a release position 6*b*. Subsequent tripping of the trigger 10 via the pin PI as shown in FIGS. 88 and 89, causes the retainer 6 to move back to its retaining position 6*a* as shown in FIG. 90.

The driver actuator 9 and driver 11 may be configured to extend/actuate in an actuation direction X, as shown in FIG. 85 between positions 11A and 11B. Where the actuation direction X is generally orthogonal to both a linear trigger direction Y, and the rotational retainer axis 15. The driver actuator 9 in one embodiment is configured for releasable engagement with the driver 11. In one embodiment, the releasable engagement does not couple the driver 11 and ram 9 together, but may be an abutment of the end 9*c* of the ram 9 to a surface 11*c* of the driver 11. Preferably the engagement only allows the ram 9 to push the driver 11 towards the lug 8, and not allow the ram 9 to retract the driver 11. Preferably the abutment between the end 9*c* and the surface 11*c* allows the surface 11*c* to slide relative the end 9*c* in the trigger direction Y. The engagement may be called a sliding engagement, or be able to slidingly engage, or abuttingly engage.

The driver 11 may comprise a guiding formation (not shown) at the surface 11*c* where so the end 9*c* is able to be somewhat laterally retained with the driver 11. The guiding formation may be a channel or groove, and likewise the end 9*c* may have a complementary shaped formation.

As with the other trigger versions, the driver actuator 9 may be any one of those driver actuators 9 described in this specification.

Version 5 Trigger

Figure 93:
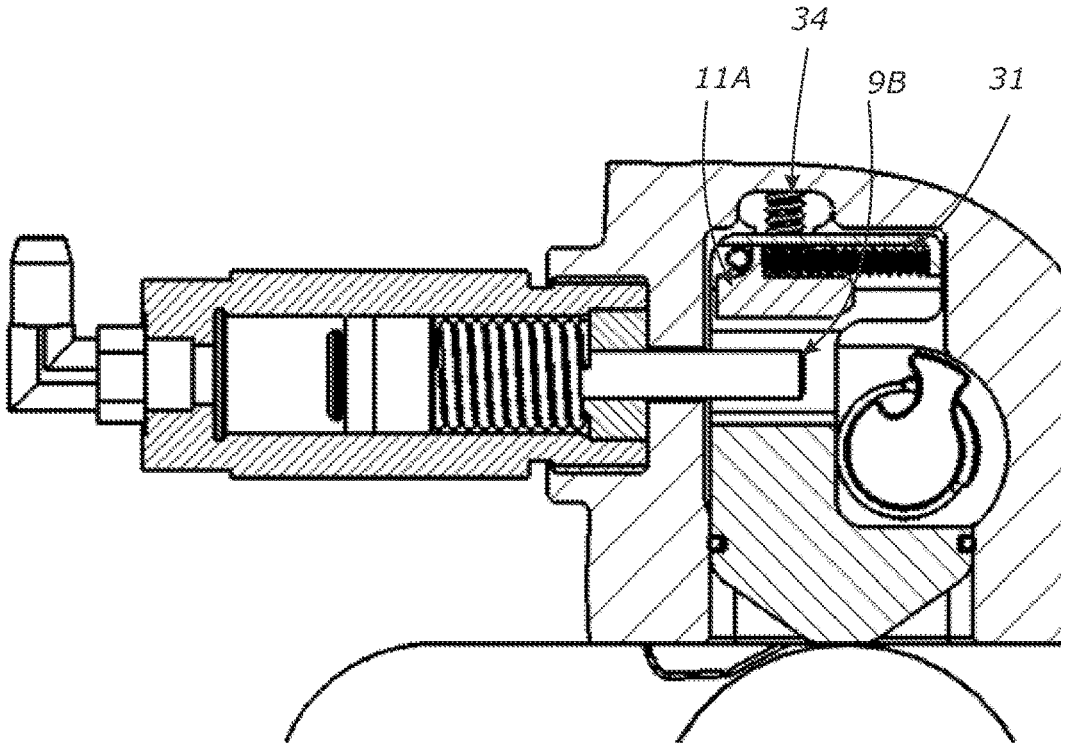
Figure 94:
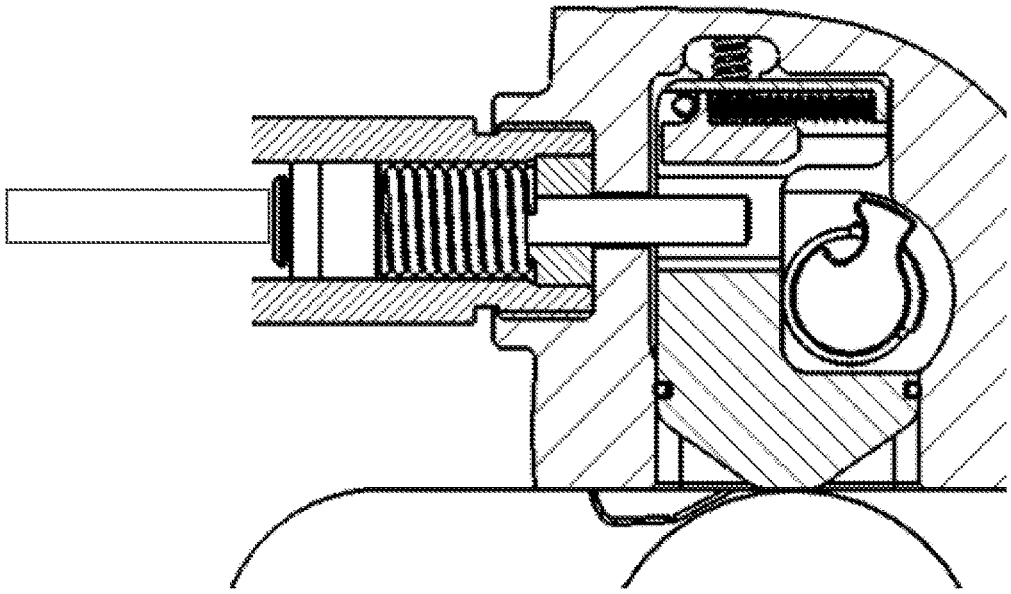

A further embodiment (also herein referred to as version 5) of a trigger mechanism is shown in FIGS. 91-94, where a similar retaining system to version 4 is shown except the difference is that the driver 11 can disengage from the driver actuator 9. This allows the driver 11 to move back to a position 11A (as shown in FIG. 93) without the need for the driver actuator 9 also moving back from position 9B to position 9A. As such the retainer 6 can disengage from the driver actuator 9 without the driver actuator 9 needing to move back in the de-actuation direction X to position 9A.

A benefit of the version 5 trigger mechanism over the version 4 trigger mechanism is that once the trigger 10 has been raised by a pin passing, and the retainer 6 is decoupled from driver 11, it is not possible for the trigger 10 to drop back into position 10A (i.e. to "re-latch") until the driver actuator 9 has moved back to the de-actuated position 9A.

With trigger mechanism version 4 it is preferred that the retainer 6 is over-rotated to a position that cannot be achieved by the pin PI pushing against the trigger 10, and this stops the system from "re-latching", i.e. the trigger dropping down into the receptacle RI. Version 5 would ideally remove the need to over rotate the retainer 6.

FIG. 9 shows a trigger version 5 with a generic driver actuator 9, that may not be a hydraulic actuator.

Hydraulic Circuits for Version 1 Driver Actuator

Further advantages with respect to the hydraulics provided as standard on an excavator are that the standard 4/2 valve that is supplied with most excavators can be utilised for the current system without any modification. The hydraulic system for driver actuator 9 version 1 is shown in FIG. 52, with a standard 4/2 valve 41 schematically shown. The coupler hydraulic system 42 that is supplied with the coupler C is shown with the retainer 3 hydraulic ram 40 and retainer 6 hydraulic ram 9. A RETRACT and EXTEND line are illustrated, corresponding to hydraulic line that when pressurised operates retraction of the ram 40 and a hydraulic line that when pressurised operates extension of the ram 40 respectively.

In modern machines the hydraulic system pressure may drop, sometimes quickly, to conserve fuel. This may cause issues with the retraction and extension of the hydraulic ram 9 that indirectly actuates the retainer 6. This is because if there is a lack of pressure during unlocking of the front pin PI, then the hydraulic ram 9 may retract, before it has been able to fully extend to completely unlock the receptacle R1 by rotating the retainer 6 from the opening of the receptacle RI.

Addition of a pilot check valve 44 improves the usability of the system with such modern machines. The addition of a pilot check valve 44 is not essential on all systems.

Figure 53:
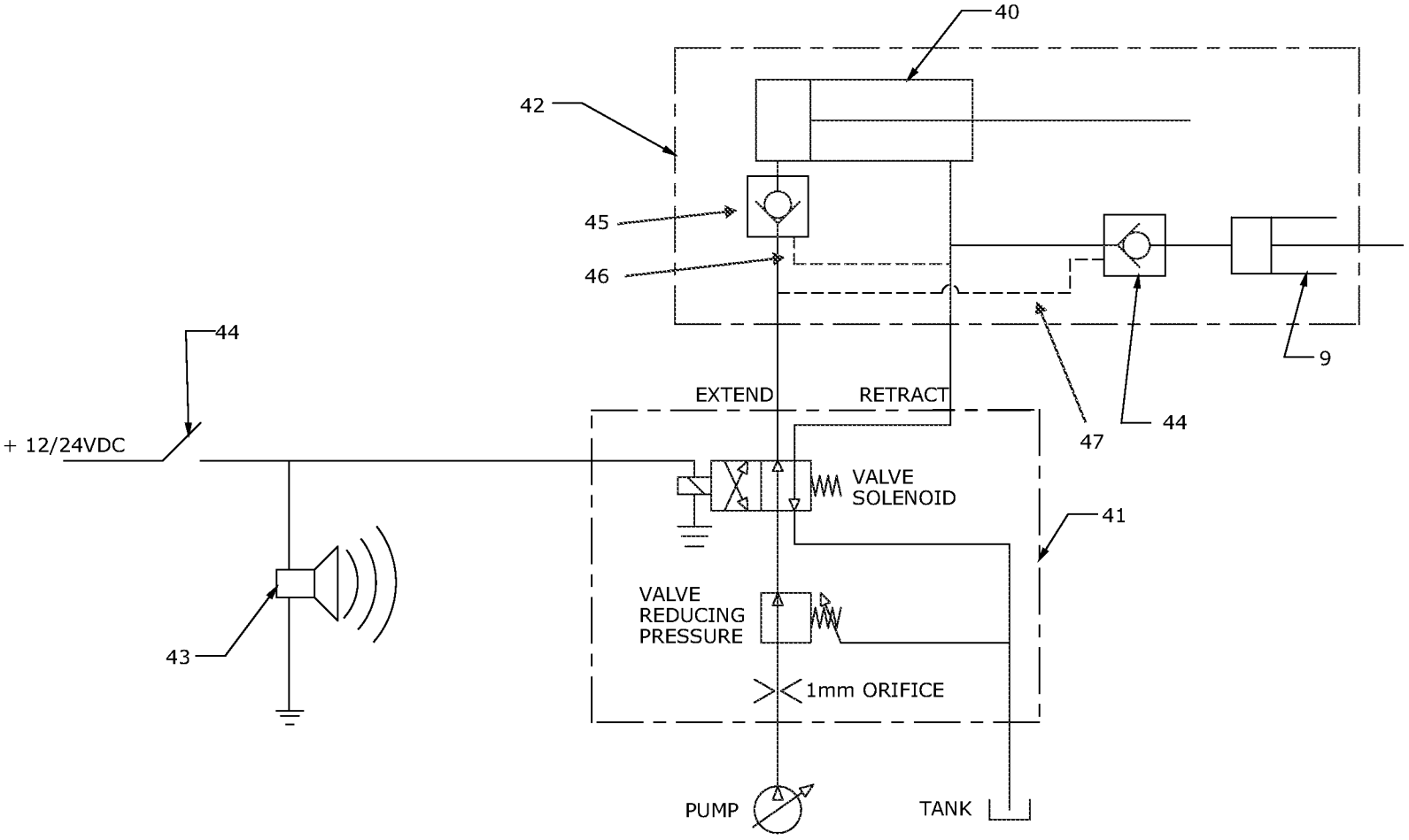
FIG. 53: shows a schematic of an alternative hydraulic system.
Figure 54:
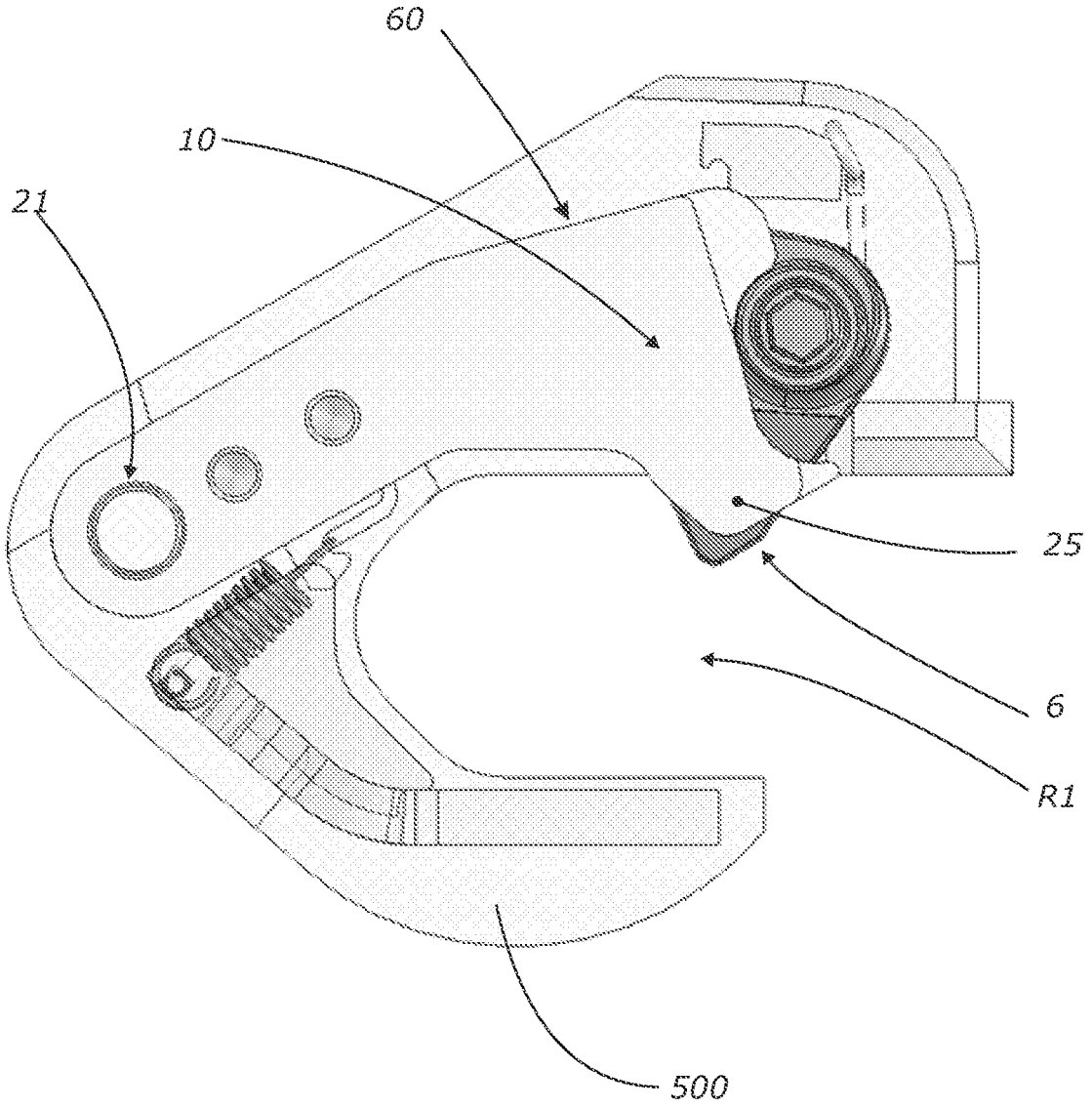
FIG. 54: shows a side view of a third version retaining system.

An example of a hydraulic circuit with a pilot check valve 44 for the hydraulic ram 9 is shown in FIG. 53. The pilot check valve 44 prevents the hydraulic ram 9 from retracting, or at least reduces the speed or rate of retraction, during the retraction (unlocking) procedure. This may be achieved by having the hydraulic ram 9 being feed from the RETRACT line, with an intermediary check valve 44 to prevent fluid from returning from the hydraulic ram 9 to the RETRACT line if the RETRACT line fluid pressure drops off.

A side effect of the check valve 44 is that then the hydraulic ram 9 cannot retract. This is overcome by having a pilot line 47, running from the 'high' pressure EXTEND line to the pilot check valve 44, to open the pilot check valve 44 during operation of the EXTEND circuit. When high pressure is fed through the EXTEND circuit, the pilot check valve 44 is opened to allow fluid to flow into the low pressure (RETRACT) line back to the TANK. The hydraulic ram 9 retracts due to its spring bias from spring 31. Alternatively the pilot line 47 may be fed from other regions of the EXTEND circuit, such as after the pilot valve 45, and before the ram 40, or off the ram 40.

The hydraulic ram 40 may also have a respective pilot check valve 46 to prevent the retainer 3 and hydraulic ram 40 from retracting whilst the coupler is in the locked position, and there is no high pressure coming from the EXTEND line. A side effect of the check valve 45, is that the hydraulic ram 40 can then not retract. To overcome this the pilot check valve 46 has a corresponding pilot line 46 to open the pilot check valve 46. The pilot line 46 is fed from the RETRACT line.

Whilst pressure is being driven through the EXTEND line, the hydraulic ram 40 extends. When pressure is released, or reduced, from the EXTEND line, the hydraulic ram 40 is prevented or restricted from retracting due to the pilot check valve 44. This is desirable as a safety feature, where the retainer 3 (attached to the hydraulic ram 40) won't retract (and open up the passage P) unless a user applies pressure to the RETRACT line.

It is envisaged that there are many ways to configure the hydraulic circuit so it can be used with a standard 4/2 valve, yet still comprise the benefits described above.

Other Versions of the Driver Actuator 9

As with the trigger mechanism, the driver actuator 9 can also be modified for different uses yet still allow to the retaining system to operate correctly. In this specification, there are four driver actuators 9 described.

Figure 105:
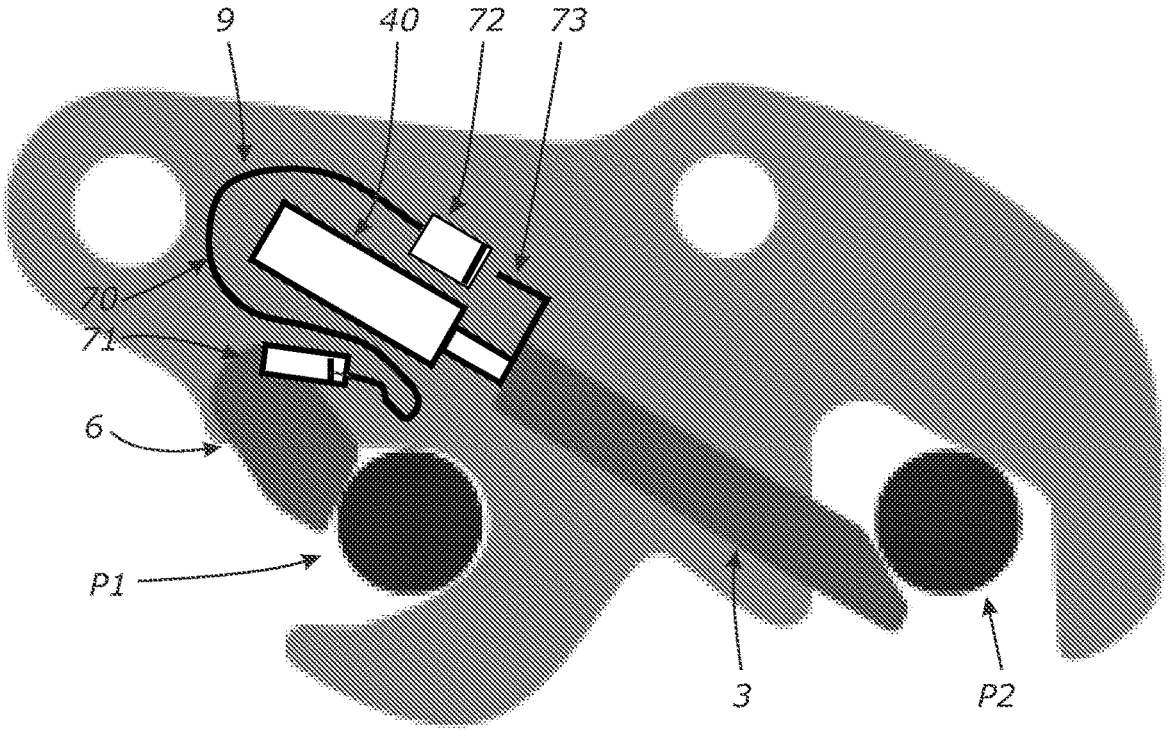
FIGS. 105-106: shows side schematic views of a retaining system with a fourth alternative driver actuator being actuated to allow a pin of an attachment to egress the coupler.
Figure 106:
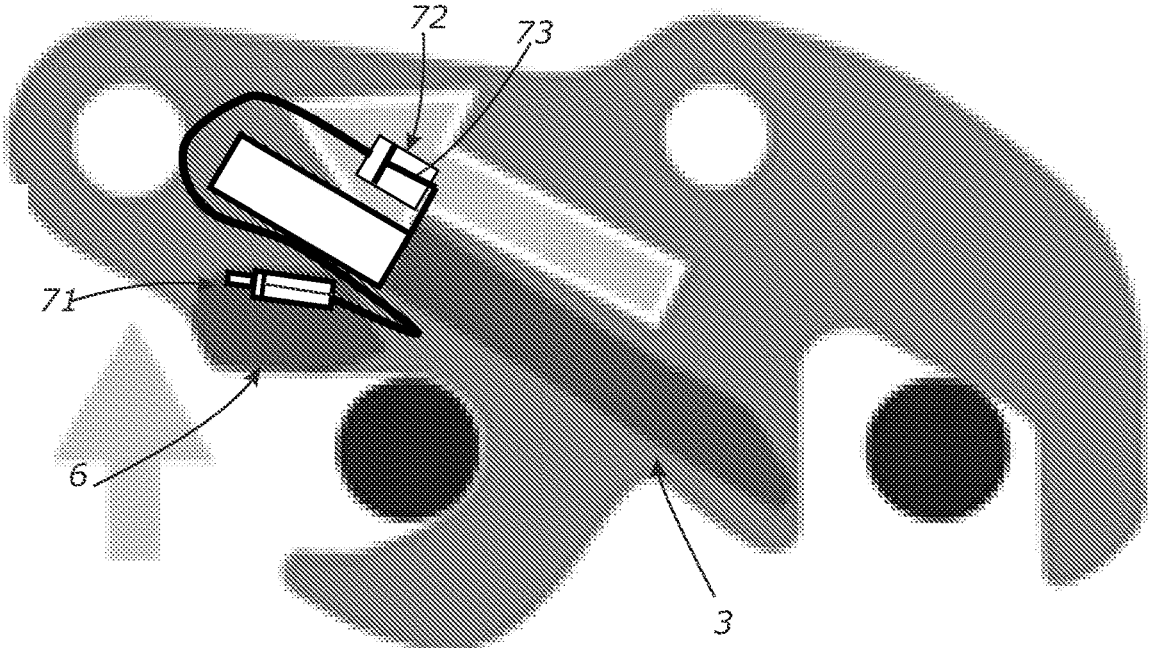
Figure 107:
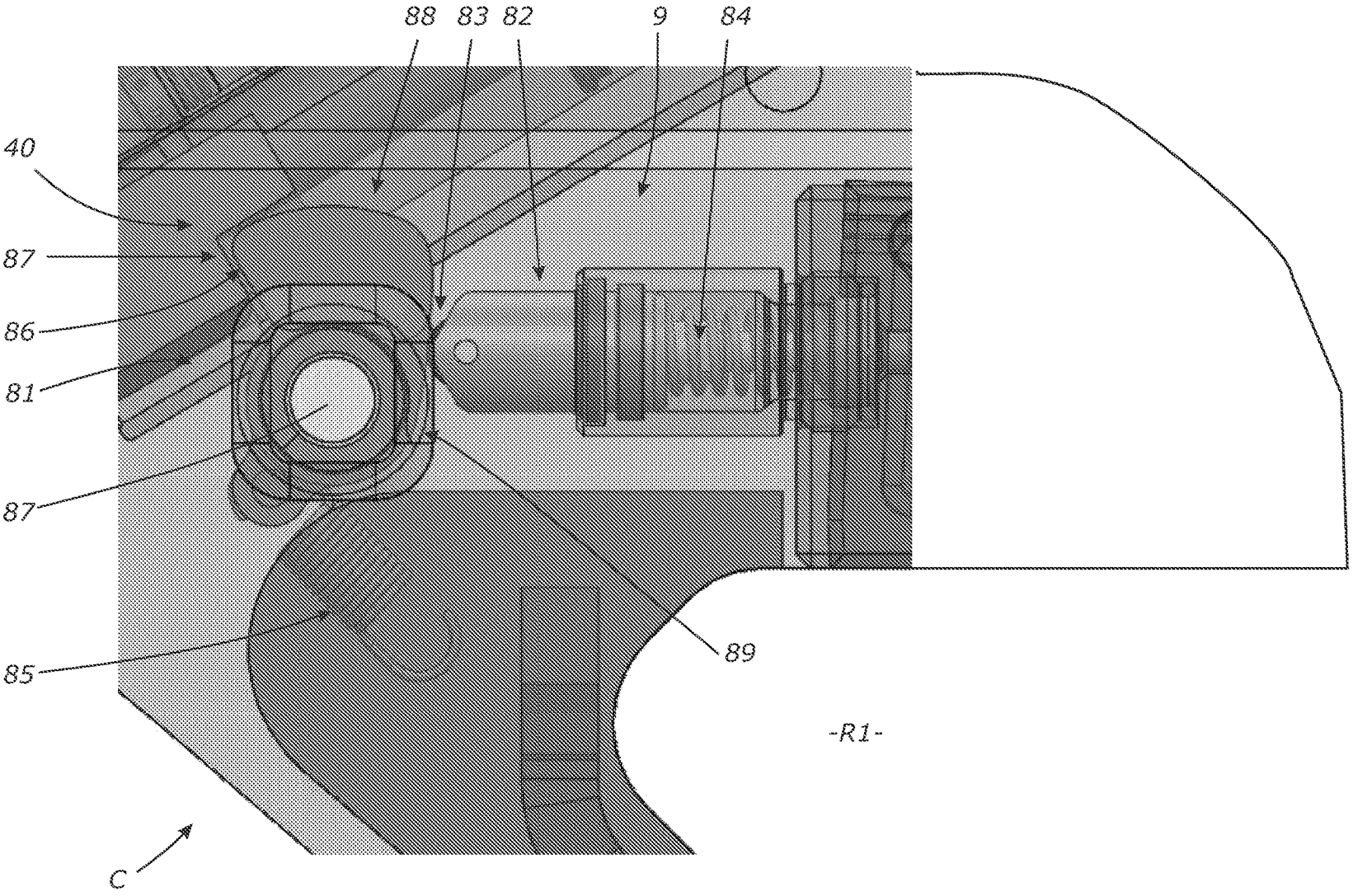
FIG. 107: shows a side schematic view of a driver actuator comprising a cam and push rod.

Driver Version 1: As shown in FIGS. 32-37, 49, 52-84
Driver Version 2: As shown in FIGS. 95-99
Driver Version 3: As shown in FIG. 100-104
Driver Version 4: As shown in FIGS. 105-106
Driver Version 5: As shown in FIG. 107

In other embodiments the driver 11 may not be actuated by a hydraulic ram driver actuator that is hydraulically connected to the hydraulic circuit that is also able to actuate the hydraulic ram 40 (as shown in FIGS. 52 and 53). Instead the driver 11 is actuated by another means, such as a mechanical or hydraulic means dependent from the hydraulic ram 40. This may have benefits such as; reducing the number of connected hydraulic rams; reducing parts; increasing reliability; and/or reducing complexity. Any of the previously retaining systems and triggers/trigger mechanisms may use any of the herein described driver actuators 9. A skilled person in the art will realise any of the herein described retaining systems may be modified to utilise the described driver actuators 9.

Driver Version 2 of the Driver Actuator

In one embodiment (driver version 2) as shown in FIGS. 95-99, the driver actuator 9 is actuated by a mechanical connection, such as a push-rod type system, with the hydraulic ram 40 that drives the second retainer 3. The driver actuator 9 can move between an actuated position 9A and a retracted position 9B when coupled with the hydraulic ram 40. However, the driver actuator 9 may be actuated by either of the hydraulic ram 40 or second retainer 3.

Figure 95:
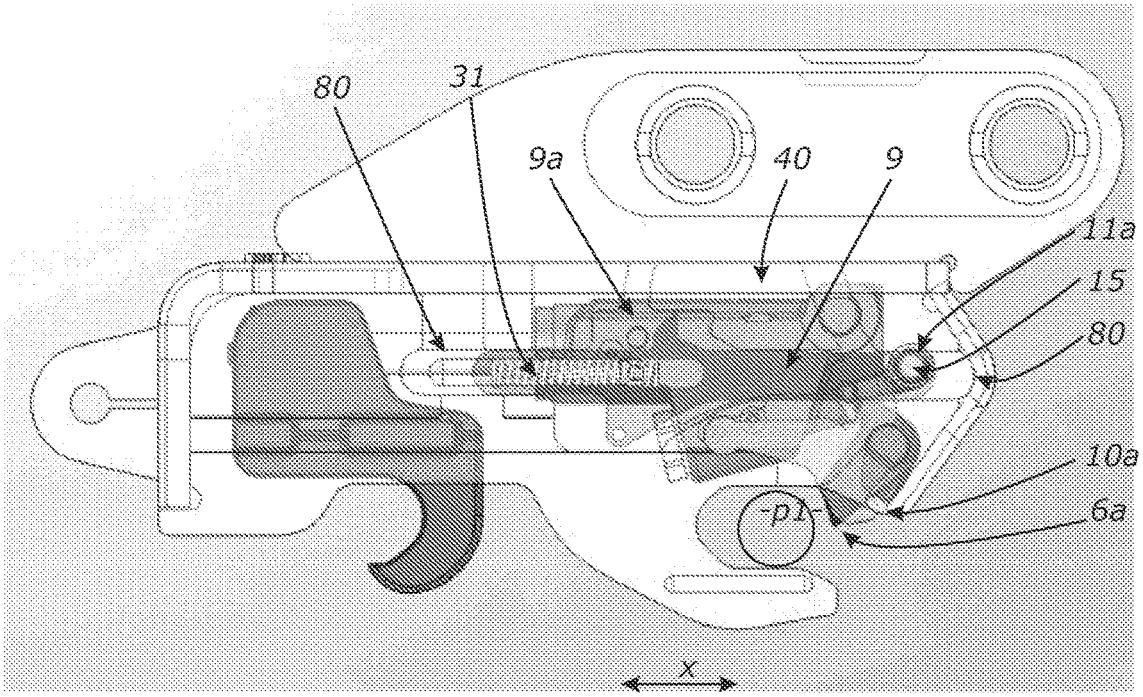
FIGS. 95-99: shows side schematic views of a retaining system with a second alternative driver actuator, and a version two retaining system being retracted to allow a pin of an attachment to egress the coupler.

As can be shown from the figures, there is preferably lost motion between the hydraulic ram 40 and the driver actuator 9. FIG. 95 shows where the hydraulic ram 40 is fully extended, yet the driver actuator 9 has stopped at position 9*a*—where it is not coupled with the hydraulic ram 40. FIG. 95 also shows where the driver actuator 9 comprises a stop that engages with a complementary stop on the coupler or hydraulic ram 40, shown by the arrow 9*a*.

Figure 96:
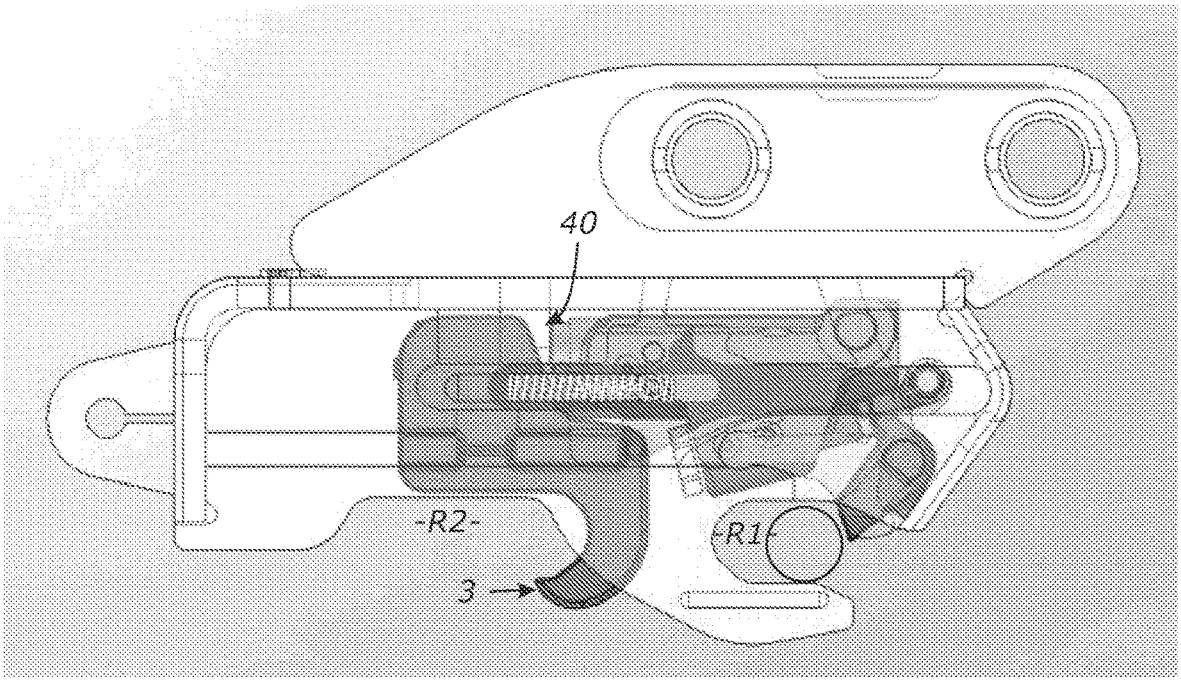

FIG. 96 shows the position at which the hydraulic ram 40 engages with the driver actuator 9 to start driving the driver actuator 9. The engagement in one embodiment is a simple abutting engagement between two complementary surfaces on each of the driver actuator 9 and the hydraulic ram 40.

Preferably the driver actuator 9 is carried by at least slots 80 in the coupler body C. The driver actuator 9 translates with respect to the coupler body along said slots 80. Preferably the driver actuator 9 moved in an actuation direction X, which is orthogonal to the retainer axis 15, and in this embodiment, also parallel with the actuation/de-actuation direction of the hydraulic ram 40. However in other embodiments it is envisages that the driver actuator may translate at an angle to the hydraulic ram 40.

Preferably in this embodiment the driver 11 can slidably translate between positions 11A and 11B with respect to the coupler body. As well as rotate with respect to the coupler body. This is almost identical in function to version 1 of the retaining system. Like other systems, the retainer 6 can be decoupled from the driver actuator 9 via a decoupling of the driver 11 with the retainer 6.

Preferably the coupler comprises stops that relate to the positions 9A and 9B of the driver actuator 9. The stop relating to position 9B is shown by the arrow 9B in FIG. 97. Preferably the translation of the driver actuator 9 is directly proportional to the translation of the hydraulic ram 40, apart from the stages of lost motion. Actuation of the hydraulic ram 40 as it extends to extend the retainer 3 to capture a pin P2 will also allow the driver actuator 9 to extend back to its 9A position via the spring bias 31. As such the driver actuator 9 is almost entirely dependent on the hydraulic ram 40 for movement, however there is no hydraulic connection between the two systems.

Figure 97:
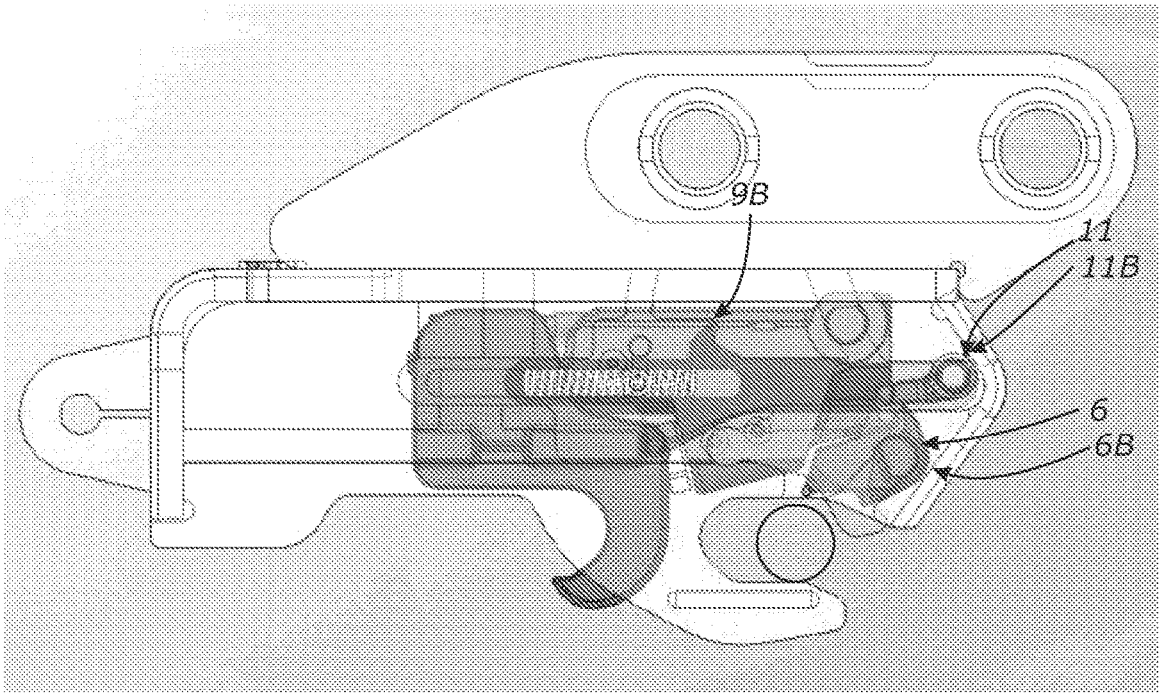
Figure 98:
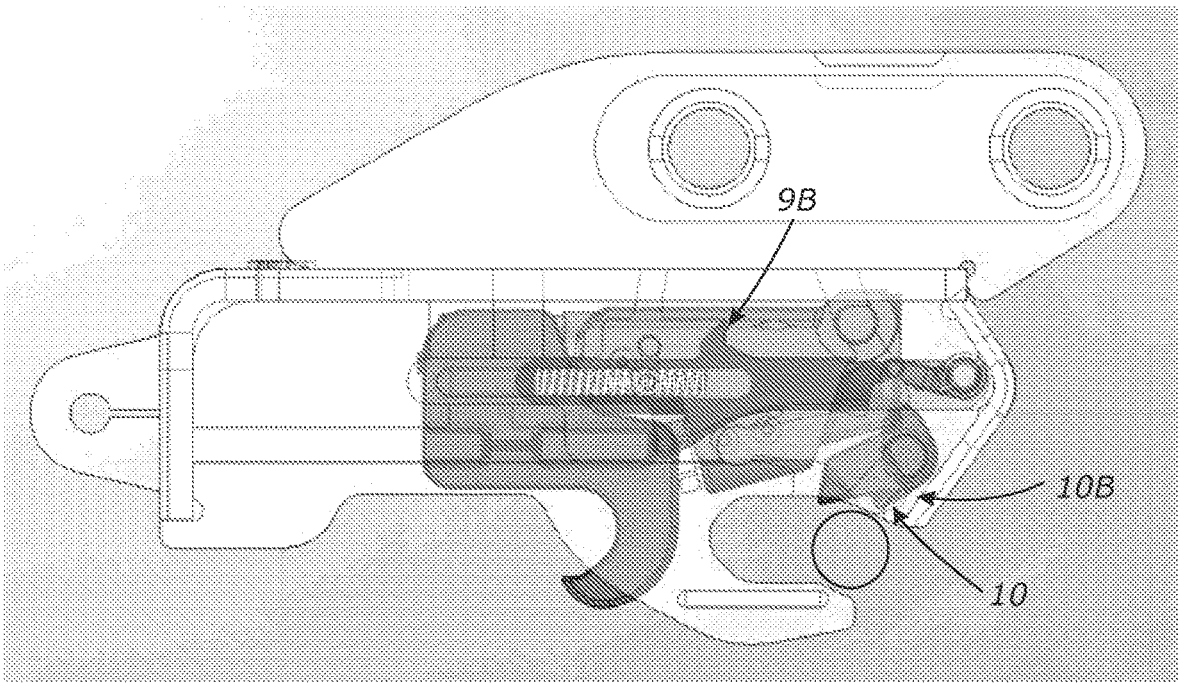
Figure 99:
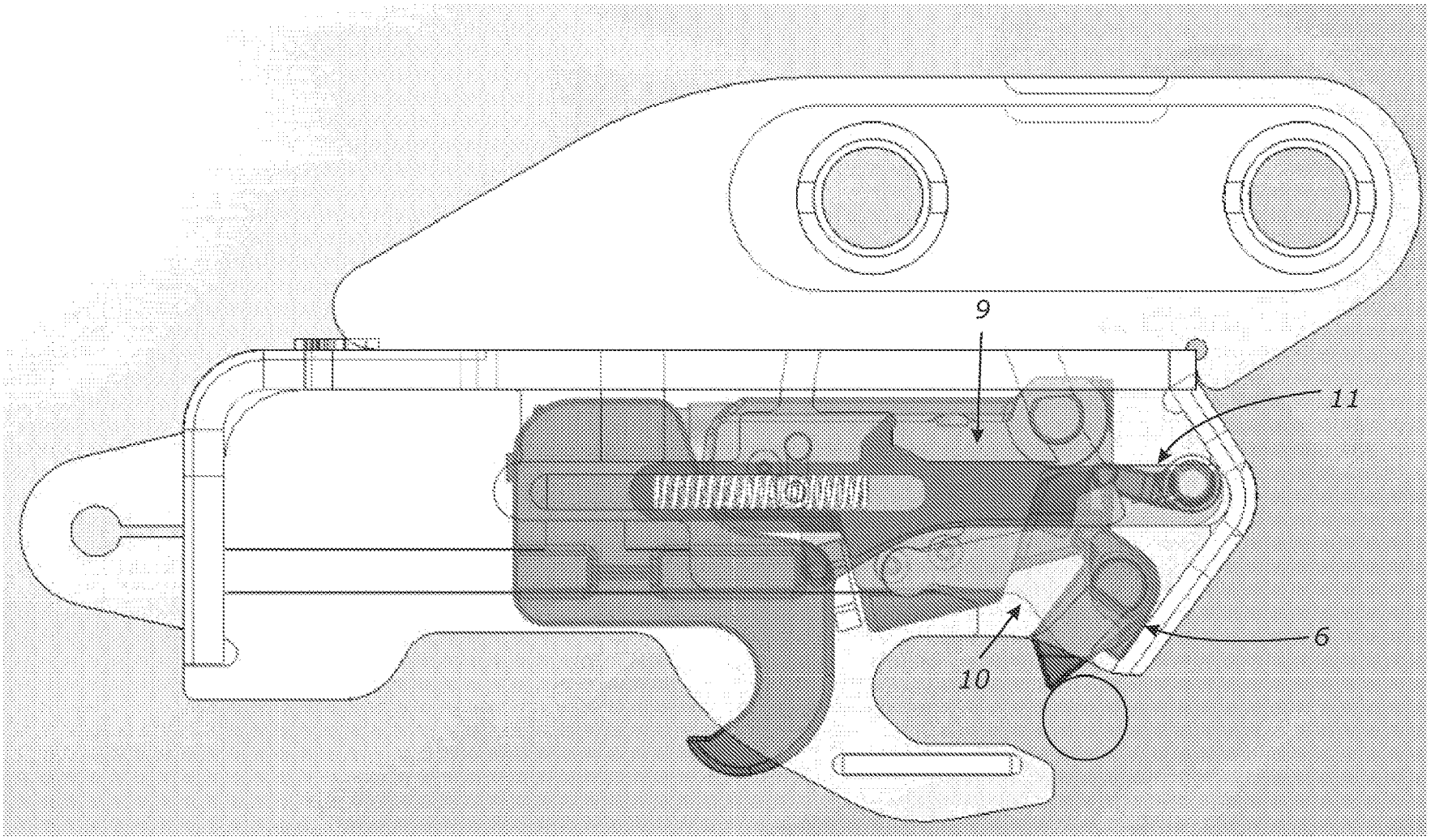

Preferably the driver actuator 9 is biased by a spring 31 that biases the driver actuator 9 to move the driver to the retaining position 11A as shown in FIG. 97. Where the retaining position 11A position is a position that allows the retainer 6 to be in the passage occluding position 6A FIG. 97 shows the driver actuator 9 starting to be actuated and lifting the retainer up. FIG. 98 shows the retainer 6 fully lifted up, and this also relates to the extent of actuation of the hydraulic ram 40 and driver actuator 9. FIG. 99 shows the pin leaving the passage after tripping the trigger 10, and the retainer 6 being decoupled from the driver 11, so it can bias back down into the passage. Once the operator actuates the hydraulic ram 40 to again extend the retainer 3, the driver actuator 9 can reset back to position 9A, and also couple again with the driver 11.

Driver Version 3 of the Driver Actuator

Figure 100:
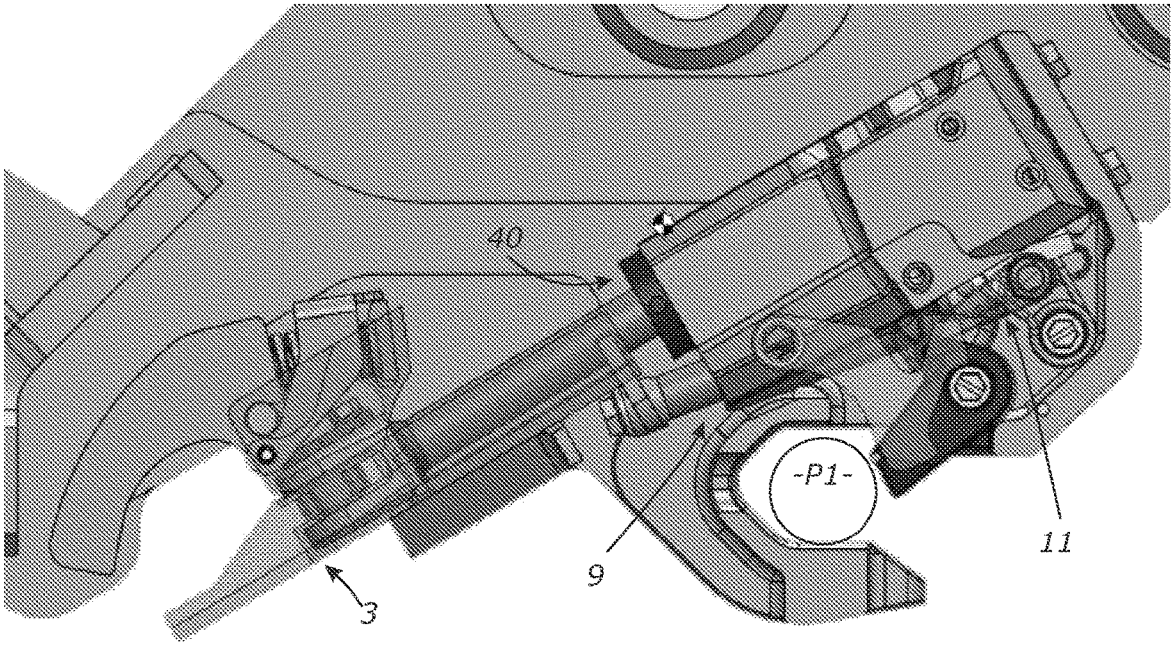
FIGS. 100-104: shows side schematic views of a retaining system with a third alternative driver actuator, and a version two retaining system being retracted to allow a pin of an attachment to egress the coupler.
Figure 101:
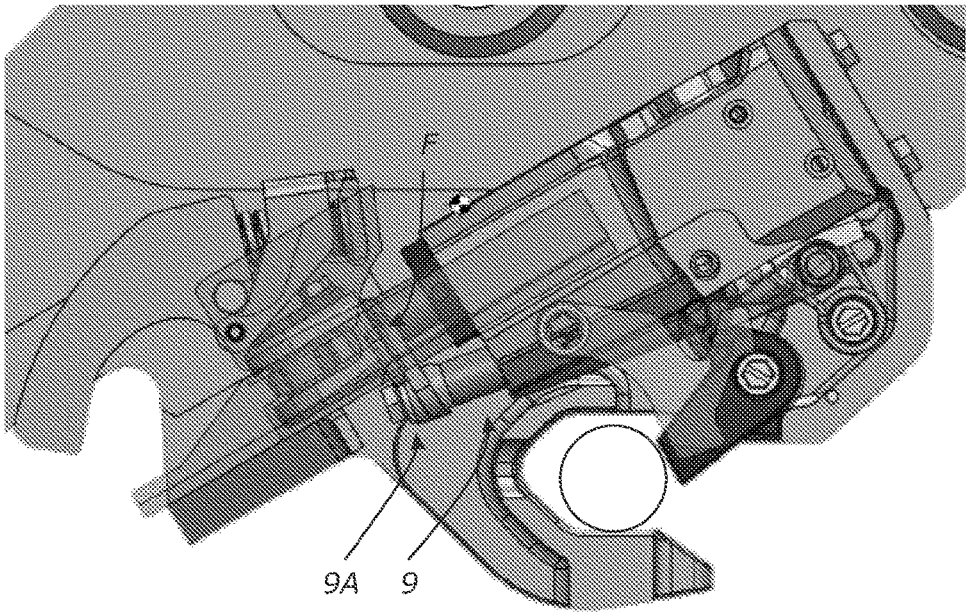
Figure 102:
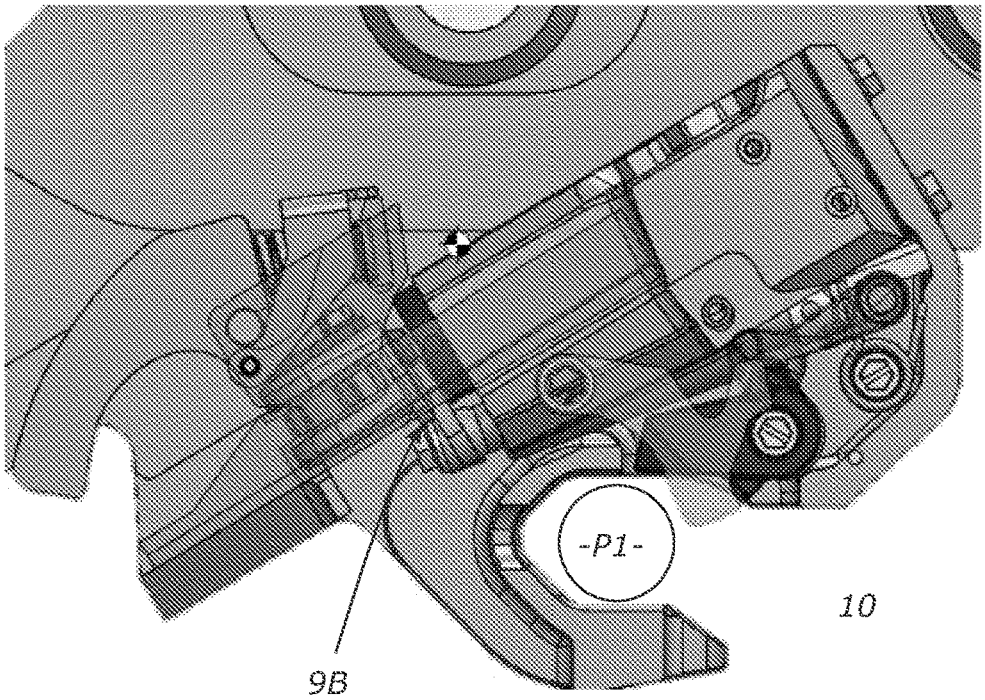
Figure 103:
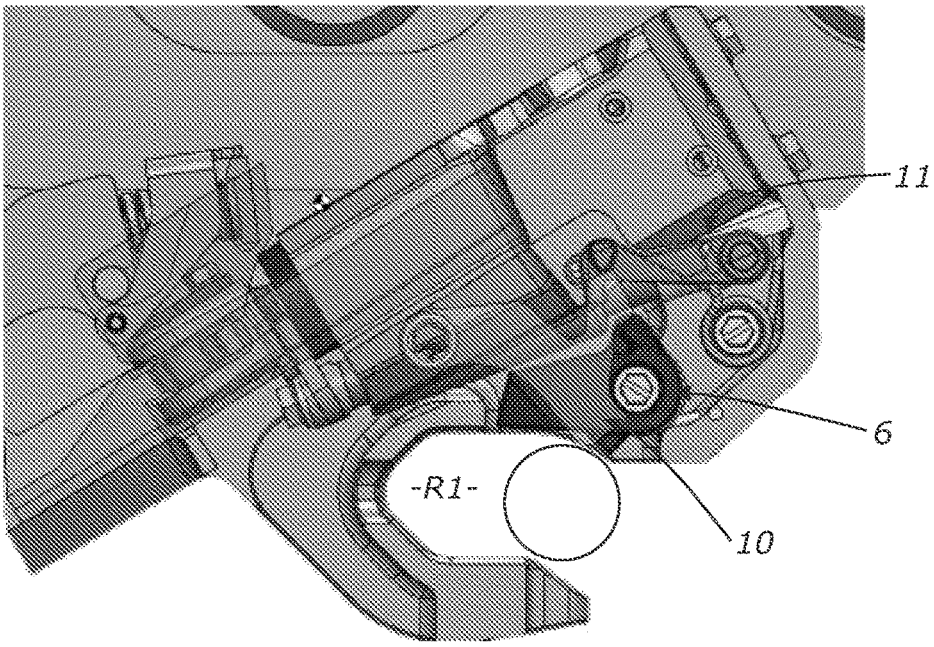
Figure 104:
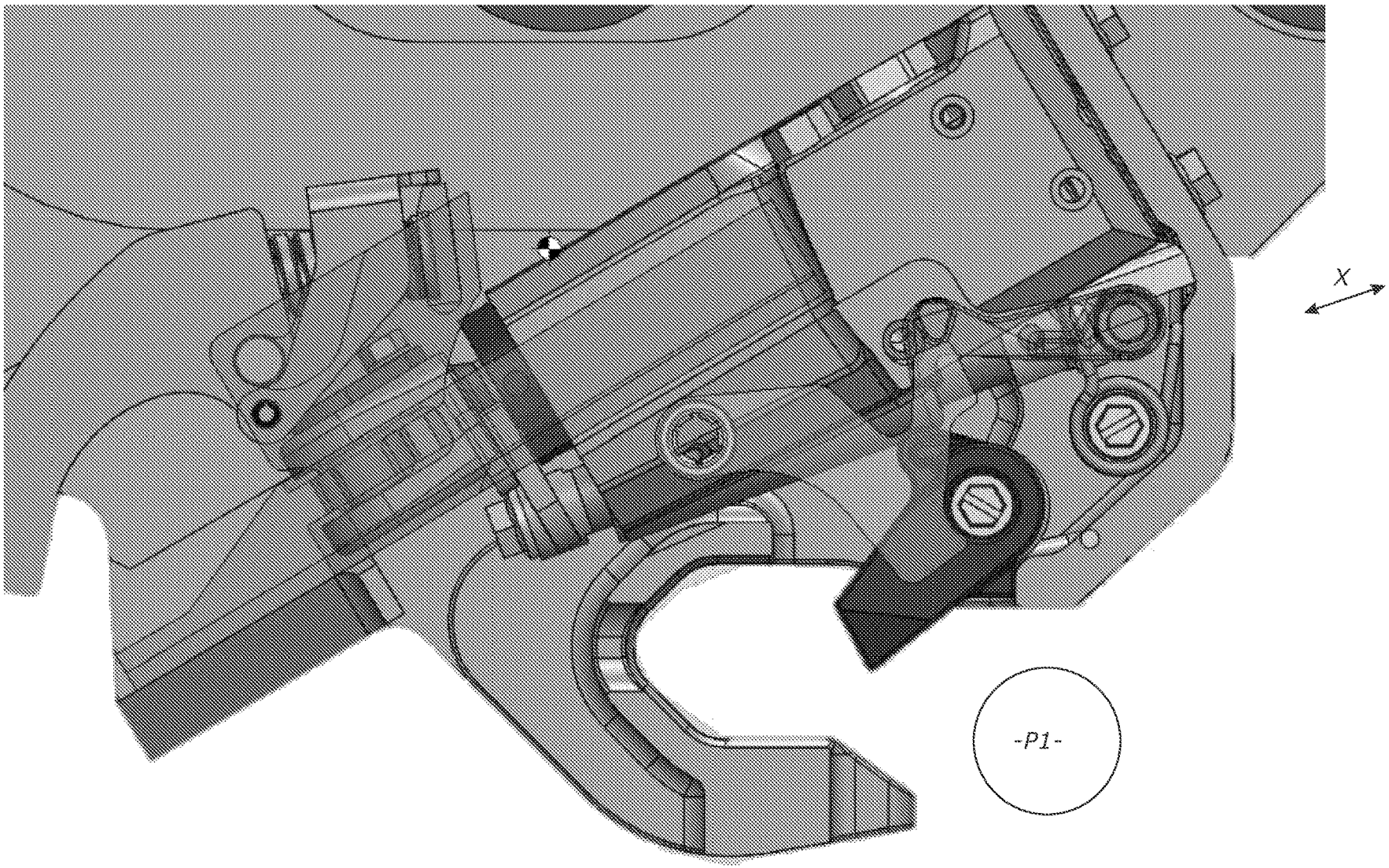

A third version of a mechanical driver actuator 9, similar to version two, is shown in FIGS. 100-104. Where the driver actuator is again a rigid arm, acting as a push-rod, extending between the hydraulic ram 40 and the driver 11. Like the previous embodiment shown, there is also lost motion between the hydraulic ram 40 and the driver actuator 9. FIGS. 100 and 101 show that a portion of the distance travelled by the hydraulic ram 40 that does not affect the driver actuator 9. At FIG. 101 the driver 9 is actuated by the hydraulic ram 40 or the retainer 3 to drive the driver actuator 9 from its position 9A to its position 9B as shown in FIG. 102. FIG. 103 shows a pin PI the egressing from the receptacle R1 to move the trigger 10 that will decouple the driver 11 from retainer 6. FIG. 104 shows the retainer 6 being fully decoupled from the driver 11.

In version three, like the previous version two, the driver actuator 9 is permanently connected by a rotatable connection to the driver 11. It is envisaged that a permanent connection is not essential, and a disengageable connection could be used. In this embodiment, due to the driver actuator 9 being at an angle from the hydraulic ram 40, there is an abutting/sliding connection F between the hydraulic ram 40 and the driver actuator 9. As such, the driver actuator 9 comprises a bias, i.e. a spring bias 31 or similar, as shown in FIG. 104, that biases the driver actuator in the de-actuation direction X.

Other embodiments of the driver actuator 9 are possible, where the driver actuator 9 arm is a telescopic arm containing an internal or external spring/air spring. The driver actuator 9 may be in contact with the hydraulic ram 40 at all times, and the lost motion will be achieved by the spring taking up in the stack until the spring reaches a certain critical compression point which would then allow the arm to drive the driver 11. This embodiment not shown.

Driver Version 4 of the Driver Actuator

A fourth version of a driver actuator 9 is shown in FIGS. 105 and 106. These figures are simplified for clarity. In this embodiment the driver actuator 9 is a combination of two hydraulic rams hydraulically linked together. A first hydraulic ram 71 is configured to actuate the driver 11 (not shown) to in turn drive the retainer 6. The first ram 71 is hydraulically linked via a hydraulic line 70 to a second hydraulic ram 72 which is able to be driven by the hydraulic actuator 40 which drives the retainer 3. There is no hydraulic connection between the hydraulic actuator 40 and the driver actuator 9. In a first position as shown in FIG. 105, the retainer 3 is in an extended position to occlude the passage of the second receptacle R.2. In this position, a mechanism such as an arm 73 or linkage of the driver actuator 9 is not engaging the second ram 72. As the hydraulic actuator 40 is retracted to retract the retainer 3, the mechanism or arm 73 connected to the hydraulic actuator 40 or retainer 3 is retracted back to engage with the second ram 72. The second ram 72 is then plunged by the arm 73 to hydraulically actuate the first ram 71 to in turn actuate the driver and retainer 6 as shown in FIG. 106.

In this system the driver actuator 9 is hydraulically independent from the hydraulic actuator 40 and the systems do not share any of fluid. The driver actuator 9 does not comprise a hydraulic pump 9 and fluid is conserved within the system.

A similar lost motion system may be utilised as previously described where the stroke of the retainer 3 is larger than the stroke required to plunge the second ram 72 of the driver actuator 9. Preferably the first and second hydraulic rams of the driver actuator 9 are of different sizes that will be configured appropriately for the stroke and power required to drive the driver and retainer 6. As described above, the system May also utilise a bias to retract the first ram 71.

This system may be modified and varied in a number of ways, for example how the second ram 72 is actuated by the hydraulic actuator 40. A skilled person in the art will realise the basic concept behind this system, and will determine the details accordingly. Version 4 of the driver actuator may be preferable to use in larger couplers where the distance between the retainer 3/hydraulic actuator 40 is further away from the retainer 6. In smaller couplers the version 2 and 3 driver actuators 9 may be more appropriate.

Driver Version 5 of the Driver Actuator

A fifth version of a driver actuator 9 is shown in FIG. 107. This figure is simplified for clarity, and a trigger mechanism/retaining system is not shown. The trigger mechanism may be any of those described herein. Version 5 of the driver actuator 9 is similar to the push-rod styles of version 2 and version 3, however in version 5 a push-rod 82 is driven by a cam type system 81. There may be one or more cams 81 that are driven directly or indirectly by the hydraulic ram 40 or retainer 3. In the preferred embodiment, the hydraulic ram 40 (instead of the retainer 3) actuates the cam 81 as it is closer that the retainer 3 to the front receptacle 1 retaining system. The cam/s 81 can in turn, drive directly or indirectly the driver 11 (not shown in FIG. 107).

In the preferred version, the cam 81 drives a follower 83 of the push rod 82. The push rod 82 in turn drives the driver 11. The cam 81 also has a follower 86 that is complementary to a driver abutment 87 on the hydraulic ram 40. The abutment 87 can engage with the follower 86 to rotate the cam 81.

The cam 81 is spring biased, by a spring 85, to rotate in a direction to cause the cam to follow the hydraulic ram 40, and also to allow the push rod 82 to move in the direction X that allows to retainer to move to its retaining position 6A.

The rotation of the cam 81 may be limited by a stop 88 that prevents the cam 81 from over-rotating and following the hydraulic ram 40 too far. The rotation of the cam 81 is about its cam rotational axis 87. Preferably the rotational axis 87 is orthogonal to the actuation direction X of the hydraulic ram 40 and/or push rod 82 movement direction.

Having the driver actuator 9 comprise the cam 81 or cams allows the translation rate of the driver actuator 9 to be modified so it is not directly proportional to the rate of movement of the hydraulic ram 40. The cam shape can also incorporate lost motion between the hydraulic ram 40 and the driver actuator 9 push rod. This lost motion is in the form of the cam 81 having a portion 89 of a the cam periphery 88 that does not extend driver actuator 9 push rod when the cam 81 is rotated.

Alternatively, or in combination, the driver actuator 9 may comprise stops that prevent the cam from following the hydraulic ram 40 at certain positions.

As with the other versions, the push rod 82 will be biased, likely spring, to keep the follower 83 engaged with the cam 81. A spring 84 is shown in FIG. 107 that will keep the follower 83 of the driver actuator push-rod 82 engaged with the cam 81. This spring 85 keeps the driver biased in the driver retracted 9A position—as shown in FIG. 107.

Other biases that may be possible in any of the versions is hydraulic damping, such as air or other gases that are able to compress, and are biased to expand in volume to push or extend the driver actuator 9. Likewise elastic stops or formations could be used also. In other embodiments the driver actuator 9, or other features, may rely on gravity to move back to a biased position.

The system is shown in a simplified side on view in the figures, the versions may comprise multiple features of the features described, but side by side. For example, in larger couplers, there may be multiple driver actuators 9.

OTHER DETAILS

In an alternative embodiment (not shown) the retaining system may not comprise a driver 11, but may instead have a configuration to allow the trigger 10 to couple and decouple the driver actuator 9 from the retainer 6 directly. This will mean that the driver actuator will be configured to pivot or similar to allow decoupling with the retainer 6/lug 8.

In some embodiments a sound may be emitted via a speaker 43 when the operator enters a particular mode. In a preferred embodiment as shown in FIG. 52 a lock out switch 44 is present also. When the switch 44 is activated by the operator, the coupler hydraulic system can be used. In the preferred embodiment, simultaneously when the switch 44 is activated, a buzzer 43 sounds. In this preferred embodiment, there can be no accidental release of any pins PI or P2 without activation of the switch 44, which would allow the hydraulics system to be operate, to release either of the retainers 3 and 6.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

The invention claimed is:

1. A coupler for securing an attachment to an earth working machine, the coupler comprising a coupler body that comprises a receptacle comprising a mouth opening via which a pin of the attachment can pass to move through a passage of the receptacle to a captive region of the receptacle, the passage of the receptacle able to be occluded sufficient to prevent the pin from moving out of the captive region by a retainer moveably presented from and relative to the coupler body, the retainer being biased to a passage occluded first position at which the retainer prevents the pin from moving out of the captive region and being movable to a second position relative the passage to allow:

(i) ingress of said pin into the captive region by forcing said pin against the retainer to move the retainer against its bias towards said second position; and (ii) egress of said pin from the captive region, by a driver able to be moved relative the coupler body to be (a) coupled with the retainer, to allow the retainer to be moved by the driver to its second position and (b) decoupled from the retainer, preventing the driver from controlling the retainer's movement between its first and second positions, wherein the driver is coupled to or engageable with a driver actuator to cause the driver to move in a manner able to move the retainer, wherein a second receptacle is provided by the coupler body at a location away from said first mentioned receptacle, said second receptacle provided to receive and retain a second pin of the attachment when said first receptacle is retaining said first pin, wherein a second retainer is provided, the second retainer able to be moved relative the coupler body between a second retainer first position where it prevents the second pin located in the second receptacle from moving out of the second receptacle, and a second retainer second position where the retained second pin can be released from the second receptacle, wherein the second retainer is actuated for movement by a second retainer actuator between the second retainer's first position and second position, and wherein the driver actuator is actuated directly or indirectly by the second retainer actuator.

2. The coupler as claimed in claim 1, further comprising a trigger that is movable relative the coupler body in a manner to be engaged and able to be moved by said pin as the pin moves through the passage in a manner so that the trigger can, when so moved by said pin, cause the driver to decouple from the retainer.

3. The coupler as claimed in claim 2, wherein the trigger can cause the coupled retainer and driver to decouple so that the retainer, if not in its first position, is able to move to its first position under influence of the bias, and wherein the trigger can cause the coupled retainer and driver to move relative each other to decouple so that the retainer is not held from moving to its first position by the driver.

4. The coupler as claimed in claim 1, wherein the driver is able to move between a coupled and decoupled condition with the driver actuator.

5. The coupler as claimed in claim 2, wherein the retainer is mounted to move in a rotational manner relative the coupler body about a retainer rotational axis.

6. The coupler as claimed in claim 1, wherein the driver is permanently connected to the driver-actuator by a rotatable connection.

7. The coupler as claimed in claim 2, wherein the driver actuator when actuated, is able to cause the driver to move in an actuation direction to, when the driver is coupled to the retainer, move the retainer to or towards its second position.

8. The coupler as claimed in claim 7, wherein the driver actuator, when de-actuated, will allow the driver to move in a de-actuation direction opposite the actuation direction, when coupled to the retainer, to allow the retainer to move to or towards its first position.

9. The coupler as claimed in claim 5, wherein the trigger is mounted relative the coupler body to translate in a trigger direction relative the coupler body and orthogonal to the retainer rotational axis.

10. The coupler as claimed in claim 8, wherein the driver is mounted on the trigger to slidably translate in the actuation/de-actuation direction relative the trigger for moving the retainer between the retainer first position and retainer second position.

11. The coupler as claimed in claim 2, wherein the trigger is configured to have a linear translatable movement with respect to the coupler body, and the driver is carried by the trigger such that the driver translates with the trigger.

12. The coupler as claimed in claim 11, wherein the driver has an abutting and/or sliding engagement with the driver actuator.

13. The coupler as claimed in claim 8, wherein the driver is biased in the de-actuation direction.

14. The coupler as claimed in claim 1, wherein the driver is configured to move laterally between a driver first position where the driver is coupled with the retainer when the retainer is in the retainer first position; a driver second position where the driver is coupled with the retainer when the retainer is in the retainer second position; and a driver third position where the driver is decoupled from the retainer.

15. The coupler as claimed in claim 1, wherein the driver is kept in contact with the driver actuator via a bias.

16. The coupler as claimed in claim 11, wherein the driver is configured to lose contact, or decouple, from the driver actuator when the trigger causes the driver to decouple from the retainer.

17. The coupler as claimed in claim 14, wherein in the driver third position the driver is decoupled from the driver actuator.

18. The coupler as claimed in claim 1, wherein the driver actuator is a push-rod configured to be engaged by the second retainer actuator or second retainer when they are retracted to an engaging position, and once at or past the engaging position the push-rod moves with the second retainer actuator or second retainer to simultaneously move the driver.

19. The coupler as claimed in claim 1, wherein the driver actuator is a combination of a first hydraulic actuator and a second hydraulic actuator connected hydraulically together.

20. The coupler as claimed in claim 1, wherein the driver actuator comprises an arm driven by the second retainer or second retainer actuator, and the arm hydraulically drives the first hydraulic actuator and thus the second hydraulic actuator which drives the driver.

* * * * *